US007427892B2

(12) United States Patent
Fujikura et al.

(10) Patent No.: US 7,427,892 B2
(45) Date of Patent: Sep. 23, 2008

(54) CURRENT SOURCE CIRCUIT AND METHOD OF OUTPUTTING CURRENT

(75) Inventors: Katsuyuki Fujikura, Tokyo (JP); Katsumi Abe, Tokyo (JP); Masamichi Shimoda, Tokyo (JP)

(73) Assignees: NEC Electronics Corporation, Kawasaki, Kanagawa (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/874,270

(22) Filed: Jun. 24, 2004

(65) Prior Publication Data

US 2004/0263241 A1 Dec. 30, 2004

(30) Foreign Application Priority Data

Jun. 25, 2003 (JP) ..... 2003-181901

(51) Int. Cl.
*G05F 1/10* (2006.01)

(52) U.S. Cl. ..... 327/540; 327/538; 327/541

(58) Field of Classification Search ..... 327/91, 327/94, 538, 541, 543; 323/312, 313, 316
See application file for complete search history.

(56) References Cited

U.S. PATENT DOCUMENTS 4,701,694 A * 10/1987 Penney et al. ..... 323/317
4,740,743 A * 4/1988 Reisinger et al. ..... 323/316
4,827,260 A * 5/1989 Sugawa et al. ..... 341/118
5,055,844 A * 10/1991 Kasai ..... 341/144
5,099,192 A * 3/1992 Thayer et al. ..... 323/315
5,289,112 A * 2/1994 Brown et al. ..... 323/315
5,396,245 A * 3/1995 Rempfer ..... 341/145
5,491,401 A * 2/1996 Inoue et al. ..... 323/273
5,523,721 A * 6/1996 Segawa et al. ..... 330/86
6,191,994 B1 * 2/2001 Ooishi ..... 365/226
6,204,610 B1 * 3/2001 Komiya ..... 315/169.3
6,222,357 B1 * 4/2001 Sakuragi ..... 323/315
6,323,631 B1 * 11/2001 Juang ..... 323/315
6,373,454 B1 * 4/2002 Knapp et al. ..... 345/76

(Continued)

FOREIGN PATENT DOCUMENTS

CN 1370035 A 9/2002

(Continued)

OTHER PUBLICATIONS

K. Abe, et al.: "16:1: A Poly-Si TFT 6-bit Current Data Driver for Active Matrix Organic Light Emitting Diode Displays" from *EuroDisplay 2002* (pp. 279-282), 2002.

(Continued)

*Primary Examiner*—N. Drew Richards
*Assistant Examiner*—Thomas J Hiltunen
(74) *Attorney, Agent, or Firm*—McGinn IP Law Group, PLLC

(57) ABSTRACT

A current source circuit includes a voltage output section which outputs a voltage signal; a current source section and a conversion section. The current source section has at least one current source block comprising a plurality of current sources, each of which outputs an output current. The conversion section is provided between the voltage output section and the current source section and outputs a reference current to the plurality of current sources of the at least one current source block based on the voltage signal such that the output current from each of the plurality of current sources is set based on the reference current.

21 Claims, 43 Drawing Sheets

U.S. PATENT DOCUMENTS

| | | | | |
|---|---|---|---|---|
| 6,535,185 | B2 * | 3/2003 | Kim et al. | 345/76 |
| 6,542,026 | B2 * | 4/2003 | Wu et al. | 327/540 |
| 6,819,165 | B2 * | 11/2004 | Ho et al. | 327/541 |
| 6,922,182 | B2 * | 7/2005 | Sase | 345/76 |
| 2002/0033786 | A1 * | 3/2002 | Akimoto et al. | 345/87 |
| 2002/0105373 | A1 * | 8/2002 | Sudo | 327/538 |
| 2002/0135309 | A1 * | 9/2002 | Okuda | 315/169.1 |
| 2003/0020413 | A1 * | 1/2003 | Oomura | 315/169.3 |
| 2003/0030603 | A1 * | 2/2003 | Shimoda | 345/76 |
| 2003/0103029 | A1 * | 6/2003 | Kokubun et al. | 345/99 |
| 2004/0239668 | A1 * | 12/2004 | Morosawa et al. | 345/212 |
| 2007/0120784 | A1 * | 5/2007 | Tsuge | 345/76 |

FOREIGN PATENT DOCUMENTS

| | | | |
|---|---|---|---|
| JP | 2000-148089 | | 5/2000 |
| JP | 2000-293245 | | 10/2000 |
| JP | 2002-215095 | | 7/2002 |
| JP | 2003-066904 | | 3/2003 |
| JP | 2003-066906 | | 3/2003 |
| JP | 2003-122307 | | 4/2003 |
| WO | WO 03/038794 | A1 | 5/2003 |

OTHER PUBLICATIONS

S.J. Daubert, et al.; "Current Copier Cells" from *Electronics Letters*, vol. 34, No. 25, Dec. 8, 1988 (pp. 1560-1562).
Chinese Office Action Nov. 10, 2006 with an English translation.

* cited by examiner

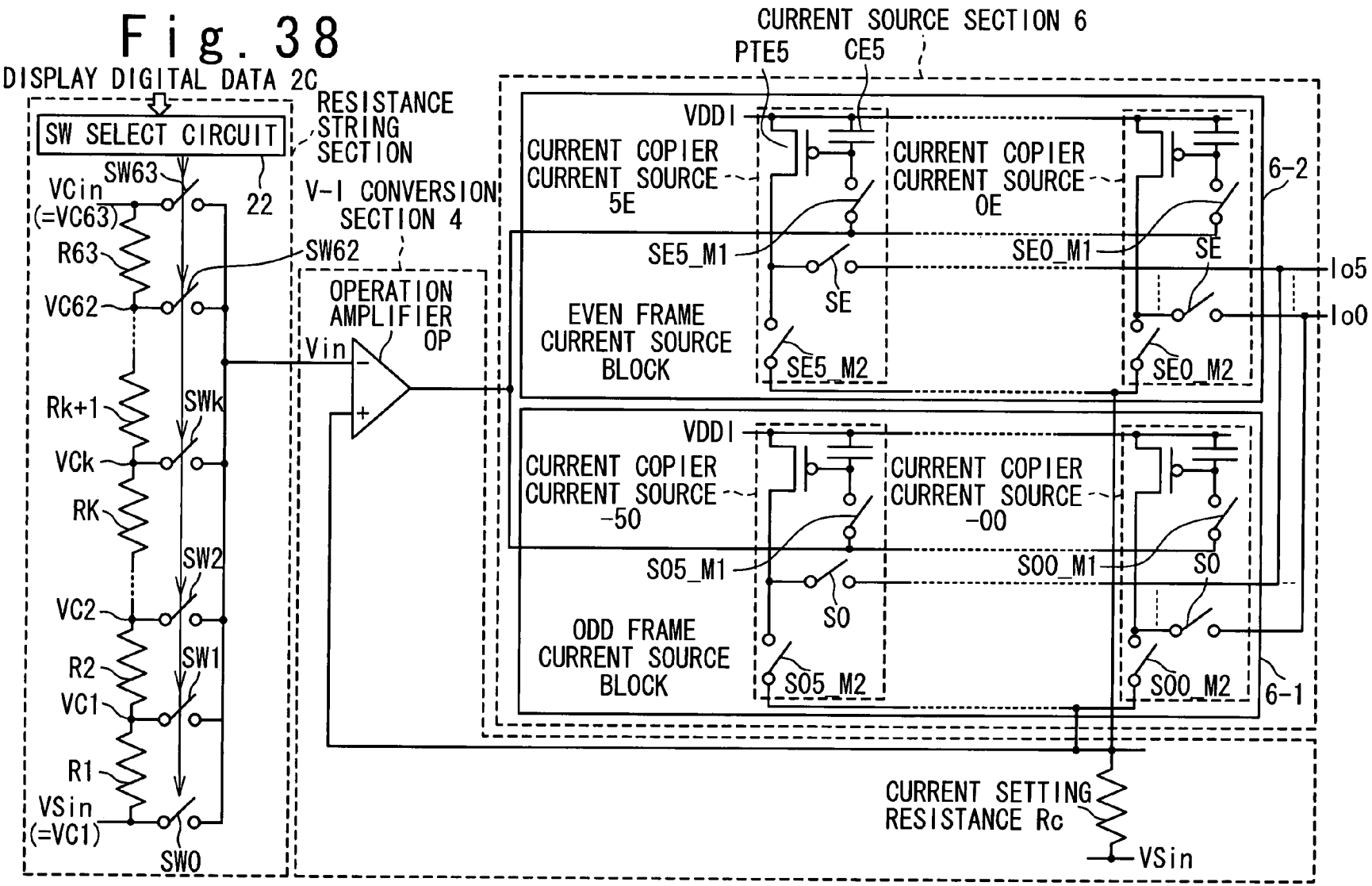
Fig. 38
DISPLAY DIGITAL DATA 2C
RESISTANCE STRING SECTION
SW SELECT CIRCUIT
22
V-I CONVERSION SECTION 4
SW62
OPERATION AMPLIFIER OP
Vin
CURRENT SOURCE SECTION 6
CE5
PTE5
VDDI
CURRENT COPIER CURRENT SOURCE 5E
CURRENT COPIER CURRENT SOURCE 0E
SE5_M1
SE0_M1
SE
SE5_M2
SE0_M2
EVEN FRAME CURRENT SOURCE BLOCK
CURRENT COPIER CURRENT SOURCE -50
CURRENT COPIER CURRENT SOURCE -00
SO5_M1
SO00_M1
SO
SO5_M2
SO00_M2
ODD FRAME CURRENT SOURCE BLOCK
6-2
6-1
Io5
Io0
CURRENT SETTING RESISTANCE Rc
VSin
SW63
SWk
SW2
SW1
SW0
VCin (=VC63)
R63
VC62
Rk+1
VCk
RK
VC2
R2
VC1
R1
VSin (=VC1)

CURRENT SOURCE CIRCUIT AND METHOD OF OUTPUTTING CURRENT

BACKGROUND OF THE INVENTION

1. Field of the Invention

The present invention relates to a current source circuit, and more particularly to a current source circuit and a method of outputting output currents, which is used for current-driving an apparatus such as an organic EL apparatus.

2. Description of the Related Art

An organic EL display apparatus is of a spontaneously luminous type, and has a faster response speed. Also, the organic EL display apparatus has features of a thin shape, a light weight, and a wide viewing angle. For these reasons, the organic EL display apparatus is suitable for a video display and has high quality. As shown in FIG. 1, in a passive matrix (PM)-type organic EL display apparatus, each pixel is composed of only an organic EL device and wiring lines, and in an activist matrix (AM)-type organic EL display apparatus, each pixel is composed of an organic EL device and a pixel circuit which supplies the organic EL device with a current.

In the organic EL display apparatus, horizontal scanning is repeated in accordance with a signal from a horizontal scanning control circuit to select an organic EL device or a pixel circuit on the horizontal line. During a period corresponding to the horizontal line, a suitable voltage or current is supplied to each organic EL device or each pixel circuit on the horizontal line from a drive circuit for the organic EL display apparatus via data lines. A current that flows through the organic EL device is determined based on the supplied voltage and current, so that the brightness of the organic EL device is controlled for a display. The brightness and the supplied current to the organic EL device are in a linear relation and the brightness and the applied voltage are in a non-linear relation. Also, in the organic EL apparatus in the present situation, the brightness characteristics are degraded with the elapse of time and the brightness decreases. The time change of the brightness in case of the current supply is low compared with a case of the voltage application. Therefore, it is possible to achieve a higher quality display in a current drive method to the organic EL apparatus.

In the activist matrix-type organic EL display apparatus, it is necessary to suppress a deviation of currents supplied from drive transistors to a pixel circuit of an organic EL apparatus for prevention the decrease of the display quality, even if there is a deviation in the current characteristic of the drive transistors. For example, in the voltage application method to a pixel circuit shown in FIG. 2, the currents supplied to the organic EL devices are deviated depending on a deviation of drive transistors in the characteristic. At this time, the brightnesses of the organic EL devices are deviated so that unevenness in color appears on the display. On the other hand, the pixel circuit shown in FIG. 3 is composed of a mirror circuit of a mirror transistor and a drive transistor. Therefore, if there is no deviation between the mirror transistor and the drive transistor, a difference in the current supplied from a drive circuit to the organic EL device can be suppressed.

In the above-mentioned situation, as the drive circuit for driving the organic EL device or the pixel circuit, a drive circuit is proposed which has a digital-analog conversion function to output an analog current in accordance with a digital display data. As such drive circuits, there are a first type drive circuit shown in FIG. 4 which requires a single reference current for a single output current and a second type drive circuit shown in FIG. 5 which requires a plurality of reference currents for the single output current.

The first type drive circuit shown in FIG. 4 is composed of a mirror circuit of a mirror transistor supplied with a single reference current and a plurality of output transistors whose channel widths are different to have a suitable current drive ability ratio. A switch is connected with a drain of each output transistor and is switched based on in accordance with the digital display data. In this case, a summation of the currents from the output transistors which are turned on is outputted, as shown by arrows in a lower portion of FIG. 4.

Also, the second type drive circuit shown in FIG. 5, a mirror circuit is provided for each of the reference currents and has a mirror transistor and an output transistor. Thus, the output currents with a proper current ratio are outputted from the output transistors. At this time, a switch connected with a drain of each output transistor is switched in accordance with the digital display data. Thus, a summation of the currents from the output transistors which are turned on is outputted, as shown by arrows in a lower portion of FIG. 5.

In the above second type drive circuit, the transistors for the current mirror circuit can be arranged closer, because the current mirror circuit is provided for every reference current. Therefore, a deviation of the transistors in the characteristic due to the manufacturing processes can be suppressed low and the precision of the output currents can be improved. On the other hand, in the first type drive circuit, because the mirror transistor is single and the plurality of output transistors exist, current mirror is composed by equal to or more than two plurality of transistors, a deviation of the transistors in the characteristic due to the manufacturing processes is large, compared with the second type drive circuit. Therefore, the precision of the output currents is low, compared with the second type drive circuit.

FIG. 6 shows a third type drive circuit, in which a plurality of reference currents with a suitable current ratio are required like the second type drive circuit. This conventional example is disclosed in EuroDisplay 2002 Proceeding (pp.279-281). In the third type drive circuit, not a current mirror circuit but a current copier circuit is adopted. The current copier circuit has two operation states, i.e., a current setting operation and a current outputting operation. In the current setting operation, a reference current is supplied to an output transistor in the state that the gate and drain of the output transistor are short-circuited. In this way, the gate voltage of output transistor is set and held to a voltage corresponding to the reference current. In the current outputting operation, a path between the gate and drain of the output transistor is opened and an output current with a same value of as the reference current can be outputted based on the set gate voltage. In this way, the current copier circuit can theoretically output the current with the same value as the reference current regardless of the characteristic of the transistor, because a single transistor is used. The third type drive circuit can suppress an output current deviation caused by a deviation of the transistors in characteristics, compared with the second type drive circuit.

The display quality of the organic EL display apparatus depends on the current which the drive circuit supplies to an organic EL device or a pixel circuit. Therefore, it is possible to improve the display quality of the organic EL display apparatus by adopting the above second or third drive circuit. However, in the above second and third drive circuits, the current source circuit is required to supply a plurality of reference currents with a suitable current ratio to the drive circuit.

In addition to the above description, a conventional current source circuit is disclosed in Japanese Laid Open Patent Application (JP-P2000-293245A). This conventional current source circuit can generate a plurality of reference currents to the above drive circuit. As shown in FIG. 7, this conventional current source circuit is composed of a V-I conversion circuit including an operation amplifier, a current setting resistance Rc, and a transistor Tr1, and a current mirror circuit including transistors Tr2 to Tr5. The V-I conversion circuit operates to supply a current having a value obtained by dividing a voltage applied to the non-inversion input of the operation amplifier by the resistance Rc, to a wiring line of the transistors Tr1 and Tr2 and the resistance Rc. In the current mirror circuit, because the transistors Tr3 to Tr5 have the same voltages between the gate and the source, the transistors Tr3 to Tr5 flow currents determined based on their current abilities and the current flowing through the mirror transistor Tr2. Therefore, if the channel length is same in the transistors Tr3 to Tr5 and a ratio of the channel widths of the transistors Tr3 to Tr5 is 1:2:4, the transistors Tr3 to Tr5 can supply the currents with 1 time, 2 times and 4 times of the current flowing through the transistor Tr2.

Also, Japanese Laid Open Patent Application (JP-P2000-148089A) discloses a technique similar to the Japanese Laid Open Patent Application (JP-P2000-293245A).

Also, Japanese Laid Open Patent Application (JP-P2003-066904A) discloses a technique in which a current is time-divided into N currents by transistors POUT1 to POUTN arranged redundantly to suppress a deviation of outputs from current sources.

Also, Japanese Laid Open Patent Application (JP-P2003-066906A) discloses a technique similar to the Japanese Laid Open Patent Application (JP-P2003-066904A).

In addition, a drive circuit for a current driven type display panel is disclosed in Japanese Laid Open Patent Application (JP-P2003-122307A). In this conventional example, the drive circuit is formed of a polysilicon TFT (thin film transistor) integrated circuit, and uses a current mirror circuit in which a value of a current which flows through the thin film transistor on a reference side is copied to the thin film transistor on a mirror side. The threshold of the thin film transistor on the reference side and the threshold of the thin film transistor on the mirror side are detected for every predetermined period. A change in the threshold of the thin film transistor on the reference side and the threshold of the thin film transistor on the mirror side is corrected based on the detection result. Thus, a change in the current value of the current mirror circuit is corrected.

In the above conventional example, the output currents of the current source circuit are determined based on a ratio of the current abilities between the mirror transistors Tr2 and the output transistors Tr3 to Tr5. However, even if the ratio of the current abilities is set by changing the channel widths, there is a case that the ratio of the current abilities is not a value as designed. In this case, the precision of the output currents decreases. For example, when the transistors are formed as a LTPS TFT (Low Temperature Polysilicon Thin Film Transistor) or an a-Si TFT (Amorphous Silicon TFT), the precision decreases largely, because these transistors have a large deviation of the current characteristic.

SUMMARY OF THE INVENTION

An object of the present invention is to provide a current source circuit and a method of outputting output current, in which a deviation of output currents can be suppressed.

An object of the present invention is to provide a current source circuit and a method of outputting output current, in which a current copier or a mirror circuit is adopted for a current source.

An object of the present invention is to provide a current source circuit and a method of outputting output current, in which transistors of a current mirror are sued in a current source.

Another object of the present invention is to provide a current source circuit and a method of outputting output current, in which desired output currents can be obtained by a simple adjustment.

In an aspect of the present invention, a current source circuit includes a voltage output section which outputs a voltage signal; a current source section and a conversion section. The current source section has at least one current source block comprising a plurality of current sources, each of which outputs an output current. The conversion section is provided between the voltage output section and the current source section and outputs a reference current to the plurality of current sources of the at least one current source block based on the voltage signal such that the output current from each of the plurality of current sources is set based on the reference current.

Here, the setting of the output current may be carried out in time series over the plurality of current sources.

Also, the current source section may include two of the current source blocks as first and second current source blocks. The first current source block alternately carries out a current setting operation to set a value of the output current and a current outputting operation to output the output currents. The second current source block carries out the current setting operation when the first current source block carries out the current outputting operation and the current outputting operation when the first current source block carries out the current setting operation.

Also, the voltage output section may include a plurality of resistances connected in series between a first voltage and a second voltage; and a switch set connected with the plurality of resistances to output as the voltage signal, one of voltages which are generated by the plurality of resistances and the first and second voltages. In this case, a value of the output current may be adjusted based on the first voltage. Also, the voltage output section may further include a switch circuit which determines the voltage signal based on a display data. In this case, the current source circuit drives an organic EL display apparatus, and the display data is for display on the organic EL display apparatus.

Also, each of the plurality of current sources may include a transistor. The conversion section may include a current setting resistance and an amplifier which outputs the reference current based on the voltage signal, the current setting resistance and the transistor in the each current source. In this case, the conversion section may further include an offset canceling section which cancels an offset of the amplifier. Also, the voltage output section may include a plurality of resistances connected in series between a first voltage and a second voltage; and a switch set connected with the plurality of resistances to output as the voltage signal, one of voltages which are generated by the plurality of resistances and the first and second voltages. The amplifier is an operation amplifier which has an inversion input connected with the voltage signal from the voltage output section and an non-inversion input connected with one end of the current setting resistance, the other end of the current setting resistance being connected with a third voltage. The operation amplifier outputs the reference current.

In this case, the second voltage may be same as the third voltage, or the second voltage may be different from the third voltage.

Also, each of the plurality of current sources may include first and second transistors connected in series, wherein a source of the first transistor is connected with a fourth voltage, a gate of the first transistor is connected with a drain of the first transistor via a first switch, and a gate of the second transistor is connected with the reference current via a second switch; a first holding capacitance which is connected between the fourth voltage and the gate of the first transistor; and a second holding capacitance which is connected between the fourth voltage and the gate of the second transistor. A drain of the transistor may be connected with a conversion common node via a third switch, and the output current may be outputted from the drain of the second transistor.

Also, each of the plurality of current sources may include a transistor which has a source connected with a fourth voltage; a holding capacitance connected between the fourth voltage and a gate of the transistor which is connected with the reference current via a first switch. A drain of the transistor is connected with a conversion common node via a second switch, and the output current is outputted from the drain of the transistor. In this case, the conversion section may include a current setting resistance; and an operation amplifier which has an inversion input connected with the voltage signal from the voltage output section and a non-inversion input connected with one end of the current setting resistance as the conversion common node, the operation amplifier outputting the reference current. Also, the current source circuit may include a plurality of current driver ICs, each of which contains the voltage output section, the current source section and the conversion section other than the current setting resistance. The current setting resistance is common to the plurality of current driver ICs. Also, the current source circuit comprises a plurality of current driver ICs, each of which contains the current source section and the conversion section other than the current setting resistance. The voltage output section and the current setting resistance may be common to the plurality of current driver ICs, and may be respectively connected via two switches with each of the plurality of current driver ICs. Also, the current source circuit may be a plurality of current driver ICs, each of which contains the current source section. A set of the voltage output section and the conversion section other than the current setting resistance and the current setting resistance may be common to the plurality of current driver ICs, and may be respectively connected via two switches with each of the plurality of current driver ICs.

Also, each of the plurality of current sources may include first and second transistor, each of which has a source connected with a fourth voltage and which constitute a current mirror; and a holding capacitance connected between the fourth voltage and gates of the first and second transistor, the holding capacitance is connected with the reference current via a first switch. A drain of the first transistor may be connected with a conversion common node via a second switch, and the output current may be outputted from the drain of the second transistor. In this case, the conversion section may include a current setting resistance; and an operation amplifier which has an inversion input connected with the voltage signal from the voltage output section and a non-inversion input connected with one end of the current setting resistance, the operation amplifier outputting the reference current. In this case, the current source circuit may be a plurality of current driver ICs, each of which contains the voltage output section, the current source section and the conversion section other than the current setting resistance. The current setting resistance may be common to the plurality of current driver ICs.

Also, the current source circuit may include a plurality of current driver ICs, each of which contains the current source section and the conversion section other than the current setting resistance. The voltage output section and the current setting resistance may be common to the plurality of current driver ICs, and may be respectively connected via two switches with each of the plurality of current driver ICs. Also, the current source circuit may be a plurality of current driver ICs, each of which contains the current source section. A set of the voltage output section and the conversion section other than the current setting resistance and the current setting resistance may be common to the plurality of current driver ICs, and may be respectively connected via two switches with each of the plurality of current driver ICs.

Also, each of the plurality of current sources may include a transistor which has a source connected with a fourth voltage; and a holding capacitance which is connected between the fourth voltage and a gate of the transistor and which is connected with a drain of the transistor via a first switch. The drain of the transistor may be connected with the reference current via a second switch, and the output current may be outputted from the drain of the transistor. In this case, the current source circuit may include a plurality of current driver ICs, each of which contains the current source section. The reference current may be common to the plurality of current driver ICs and may be connected with each of the plurality of current driver ICs via a third switch.

Also, each of the plurality of current sources may include first and second transistor, each of which has a source connected with a fourth voltage and which constitute a current mirror; and a holding capacitance which is connected between the fourth voltage and gates of the first and second transistor, and which is connected with a drain of the first transistor via a first switch. The drain of the first transistor may be connected with the reference current via a second switch, and the output current may be outputted from the drain of the second transistor. The current source section may further include an input current copier which is provided in common to the plurality of current sources and which may include a third transistor having a drain connected with the reference current, a source connected with a fifth voltage, and a gate connected with the reference current via a third switch; and a second holding capacitance connected between the source and gate of the third transistor. In this case, the current source circuit may include a plurality of current driver ICs, each of which contains the current source section, and the reference current may be common to the plurality of current driver ICs and may be connected with each of the plurality of current driver ICs via a third switch.

In another aspect of the present invention, a method of outputting output currents, is achieved by outputting a voltage signal from a voltage output section; by outputting a reference current to a current source section from a conversion section based on the voltage signal and a voltage drop across a current setting resistance in the conversion section; by carrying out a current setting operation of setting a value of an output current to each of a plurality of current sources in the current source section based on the reference current, wherein the current source section has at least one current source block comprising the plurality of current sources; and by carrying out a current outputting operation of outputting the output current of the set value from each of the plurality of current sources.

Here, the carrying out a current setting operation may be achieved by sequentially carrying out the current setting operation to the plurality of current sources during a period. The carrying out a current outputting operation may be achieved by sequentially carrying out the current outputting operation to the plurality of current sources during a period next to the period.

Also, the current source section may include two of the current source blocks as first and second current source blocks. The carrying out a current setting operation may be achieved by sequentially carrying out the current setting operation to the first and second current source blocks. The carrying out an current outputting operation may be achieved by carrying out the current outputting operation to the second current source block when the current setting operation is carried out to the first current source block; and carrying out the current outputting operation to the first current source block when the current setting operation is carried out to the second current source block.

Also, the outputting a voltage signal may be achieved by outputting as the voltage signal, one of voltages which are generated by a plurality of resistances connected in series between first and second voltages. The method may further include adjusting the first voltage to adjust a value of the output current. Also, the outputting one of voltages may include outputting as the voltage signal, one of the voltages based on a display data.

Also, the one end of the current setting resistance may be connected with a third voltage. The method further may be achieved by adjusting the second voltage and the third voltage independently.

Also, the conversion section includes an amplifier having an offset. The outputting a reference current may be achieved by canceling the offset of the amplifier.

Also, each of the plurality of current sources may include a transistor which has a source connected with a fourth voltage; a holding capacitance connected between the fourth voltage and a gate of the transistor which is connected with the reference current via a first switch.

A drain of the transistor is connected with the current setting resistance via a second switch. The output current may be outputted from the drain of the transistor via a third switch. The sequentially carrying out the current outputting operation may be achieved by turning on the first and second switches in order in the plurality of current sources; and by turning off the third switch in order in the plurality of current sources. The sequentially carrying out the current outputting operation may be achieved by turning off the first and second switches in all of the plurality of current sources; and by turning on the third switch in all of the plurality of current sources.

Also, each of the plurality of current sources may include first and second transistor, each of which has a source connected with a fourth voltage and which constitute a current mirror; a holding capacitance connected between the fourth voltage and gates of the first and second transistor, the holding capacitance is connected with the reference current via a first switch. A drain of the first transistor may be connected with the current setting resistance via a second switch, and the output current may be outputted from the drain of the second transistor. The sequentially carrying out the current outputting operation may be achieved by turning on the first and second switches in order in the plurality of current sources. The sequentially carrying out the current outputting operation may be achieved by turning on the first and second switches in all of the plurality of current sources. The sequentially carrying out the current outputting operation and the sequentially carrying out the current outputting operation are carried out at a same time.

Also, each of the plurality of current sources may be achieved by first and second transistors connected in series, wherein a source of the first transistor is connected with a fourth voltage, a gate of the first transistor is connected with a drain of the first transistor via a first switch, and a gate of the second transistor is connected with the reference current via a second switch; a first holding capacitance which is connected between the fourth voltage and the gate of the first transistor; and a second holding capacitance which is connected between the fourth voltage and the gate of the second transistor. A drain of the transistor may be connected with the current setting resistance via a third switch. The output current may be outputted from the drain of the second transistor via a fourth switch. The sequentially carrying out the current outputting operation may be achieved by turning on the first to third switches in order in the plurality of current sources; and by turning off the fourth switch in order in the plurality of current sources. The sequentially carrying out the current outputting operation may be achieved by turning off the first to third switches in all of the plurality of current sources; and by turning on the fourth switch in all of the plurality of current sources.

BRIEF DESCRIPTION OF THE DRAWINGS

FIG. 38 is a diagram showing the circuit structure of the reference current source circuit in a fourteenth embodiment of the present invention;

DESCRIPTION OF THE PREFERRED EMBODIMENTS

Figure 1:
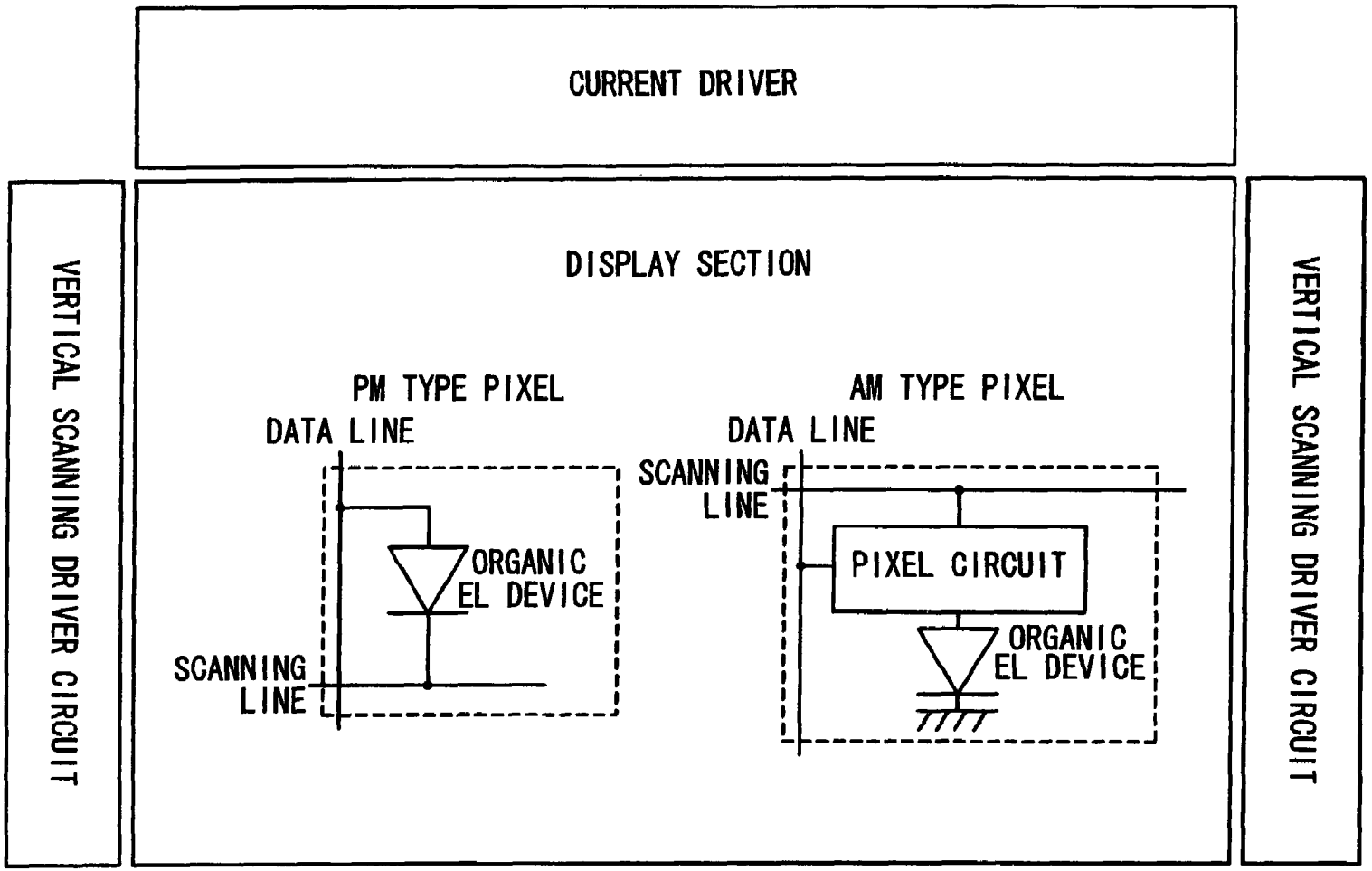
Fig. 1 (RELATED ART)
FIG. 1 is a diagram showing the structure of an organic EL display apparatus.
Figure 2:
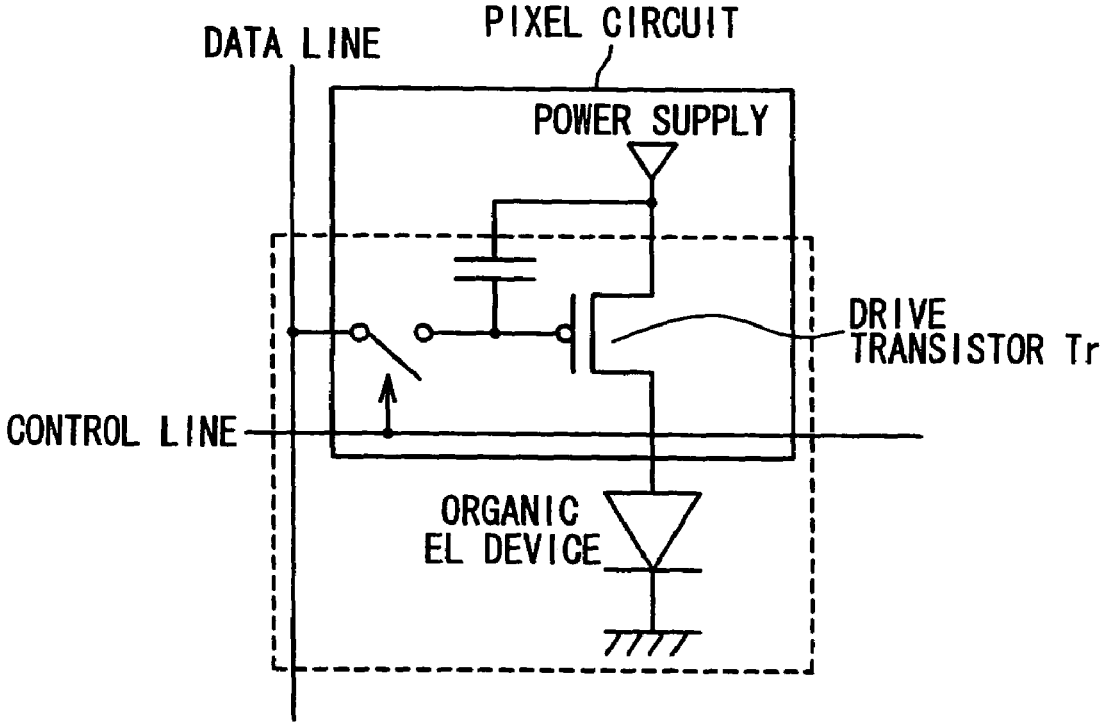
Fig. 2 (RELATED ART)
FIG. 2 is a diagram showing a first example of a pixel circuit.
Figure 3:
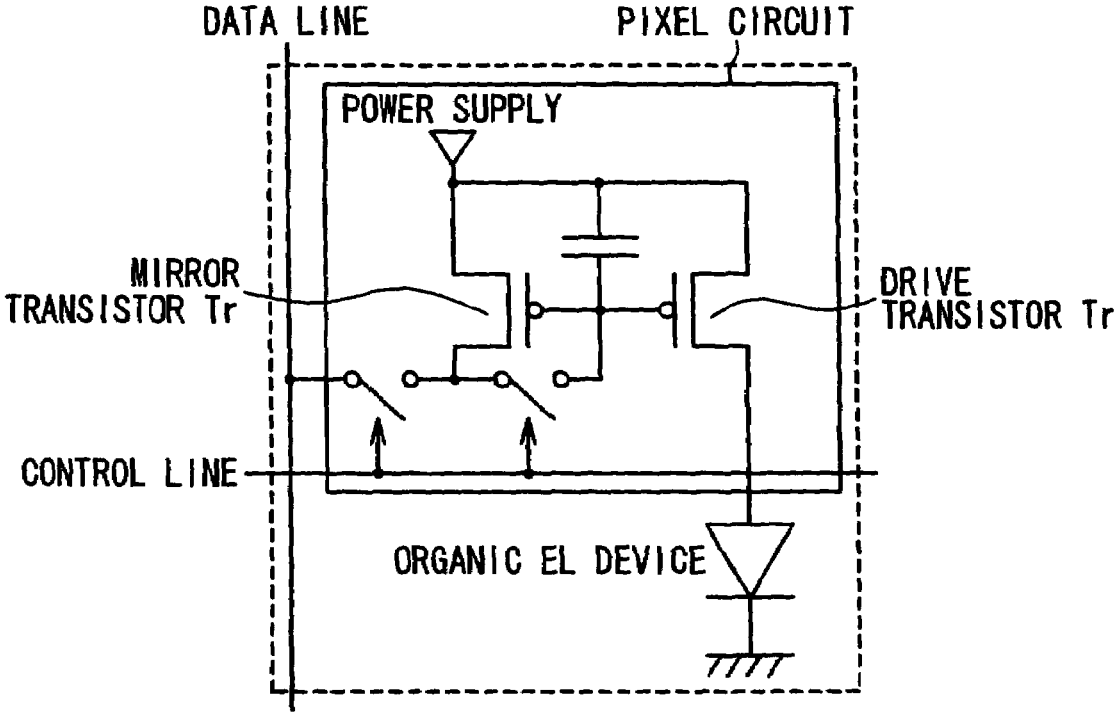
Fig. 3 (RELATED ART)
FIG. 3 is a diagram showing a second example of the pixel circuit.
Figure 4:
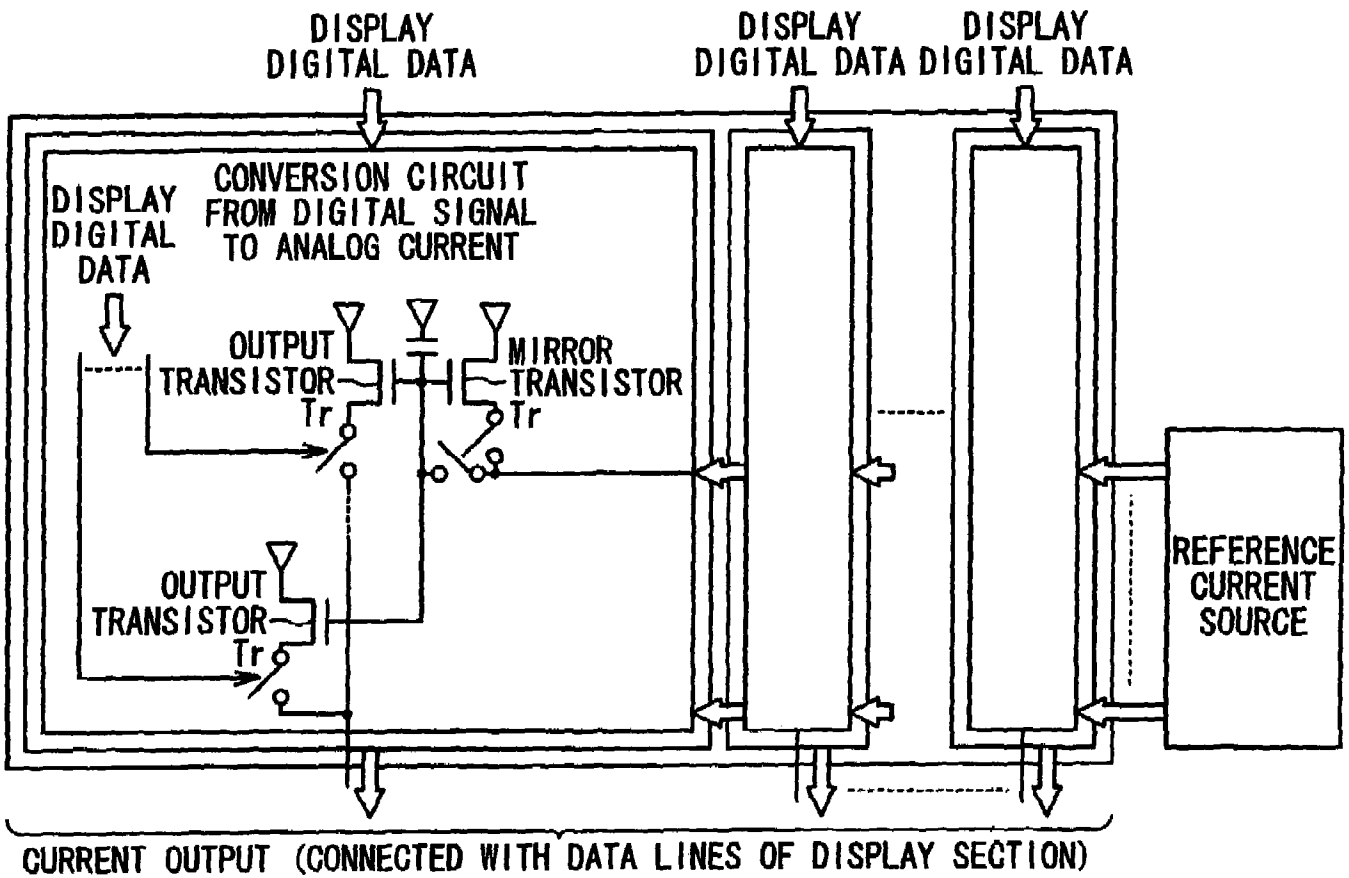
Fig. 4 (RELATED ART)
FIG. 4 is a diagram showing a first conventional example of a current driver circuit.
Figure 5:
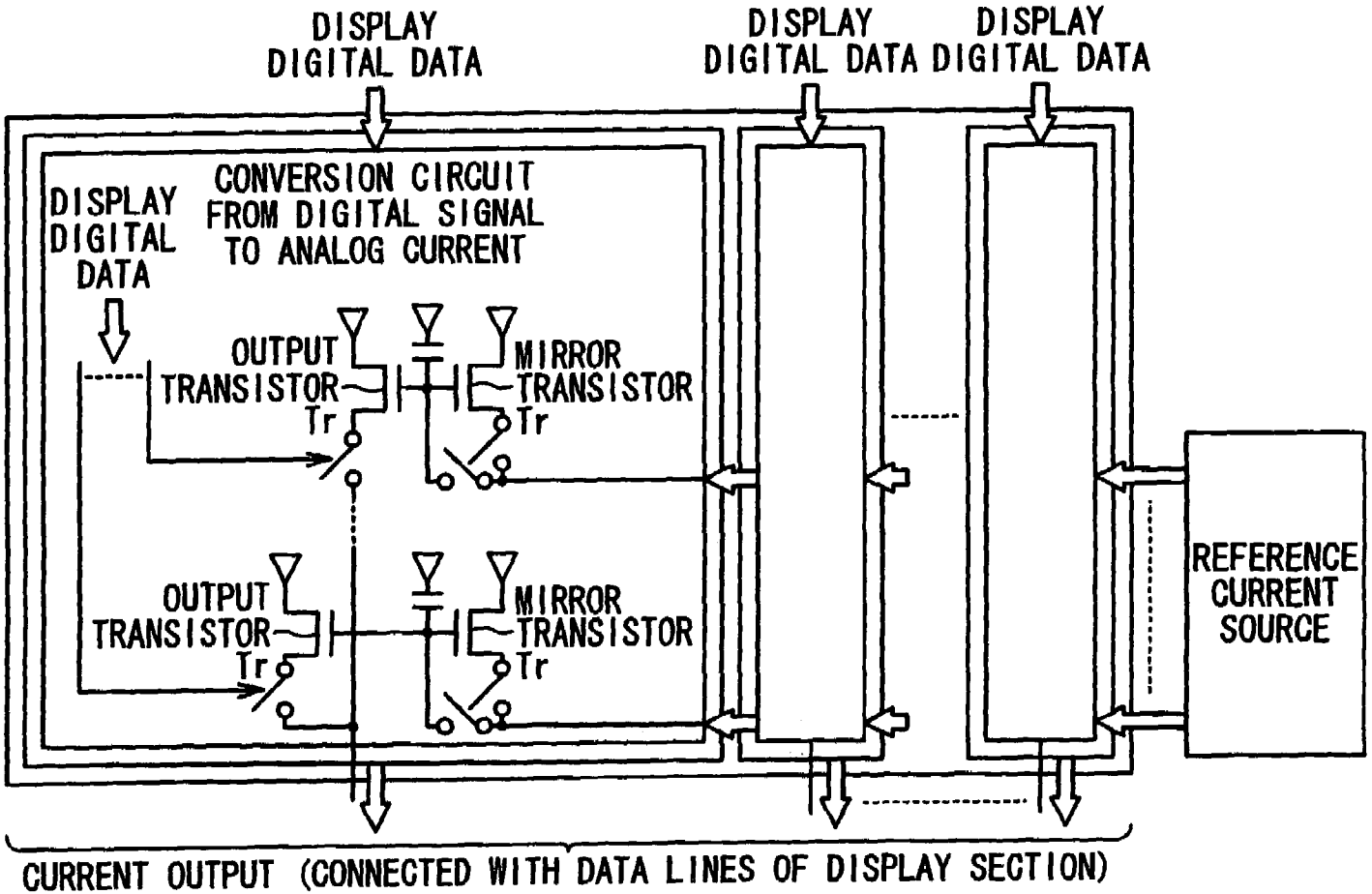
Fig. 5 (RELATED ART)
FIG. 5 is a diagram showing a second conventional example of the current driver circuit.
Figure 6:
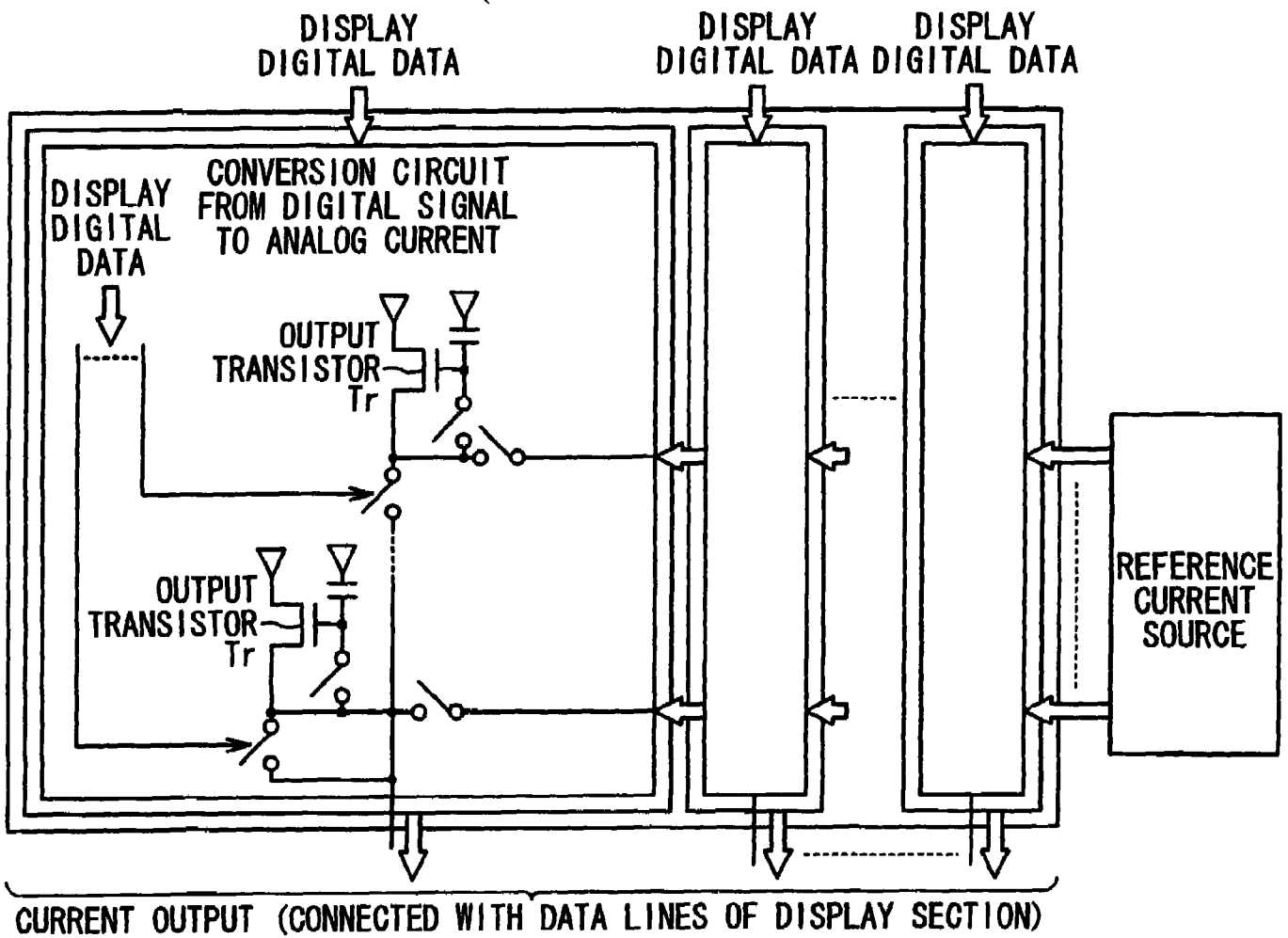
Fig. 6 (RELATED ART)
FIG. 6 is a diagram showing a third conventional example of the current driver circuit.
Figure 7:
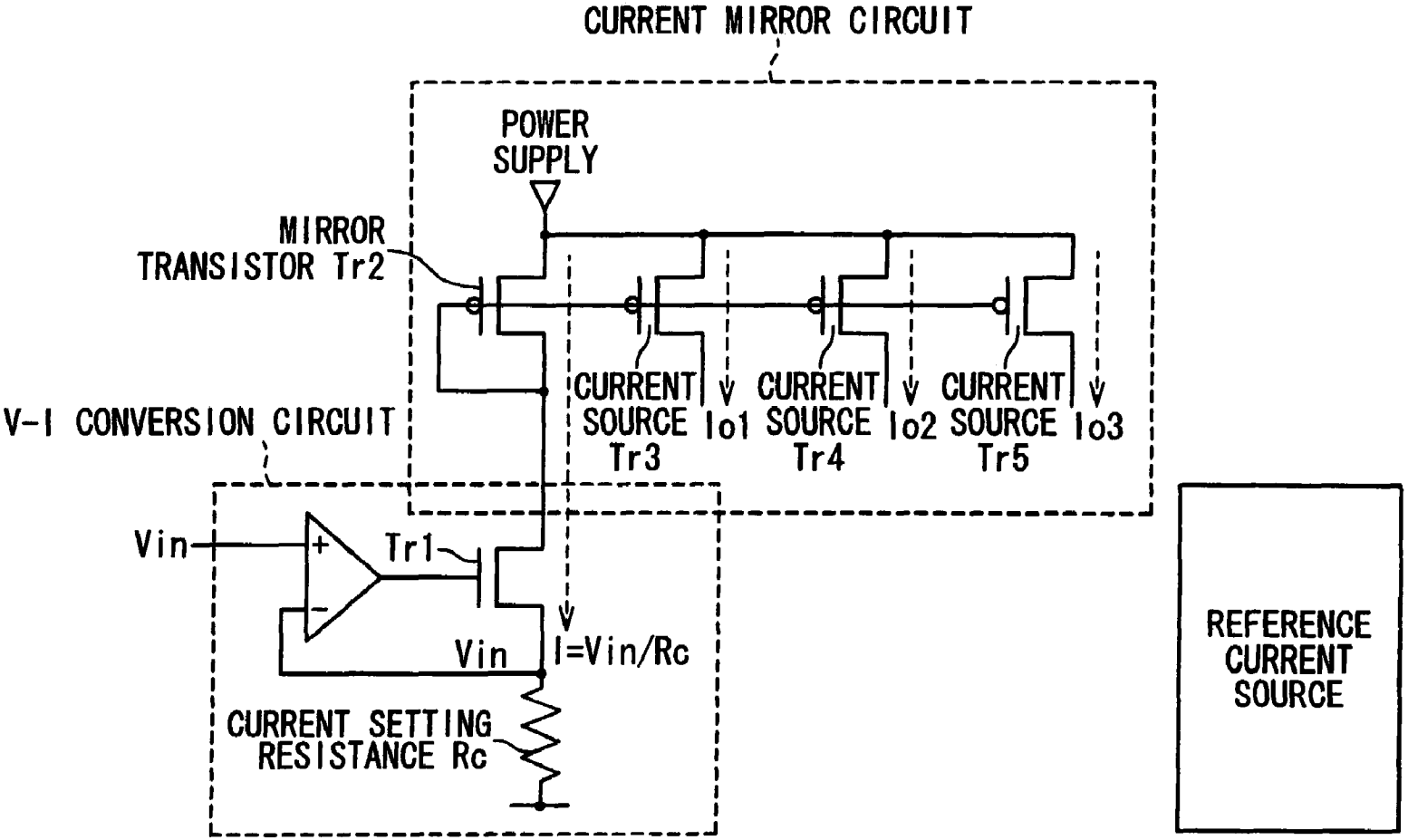
Fig. 7 (RELATED ART)
FIG. 7 is a diagram showing a conventional example of a current source circuit.
Figure 8:
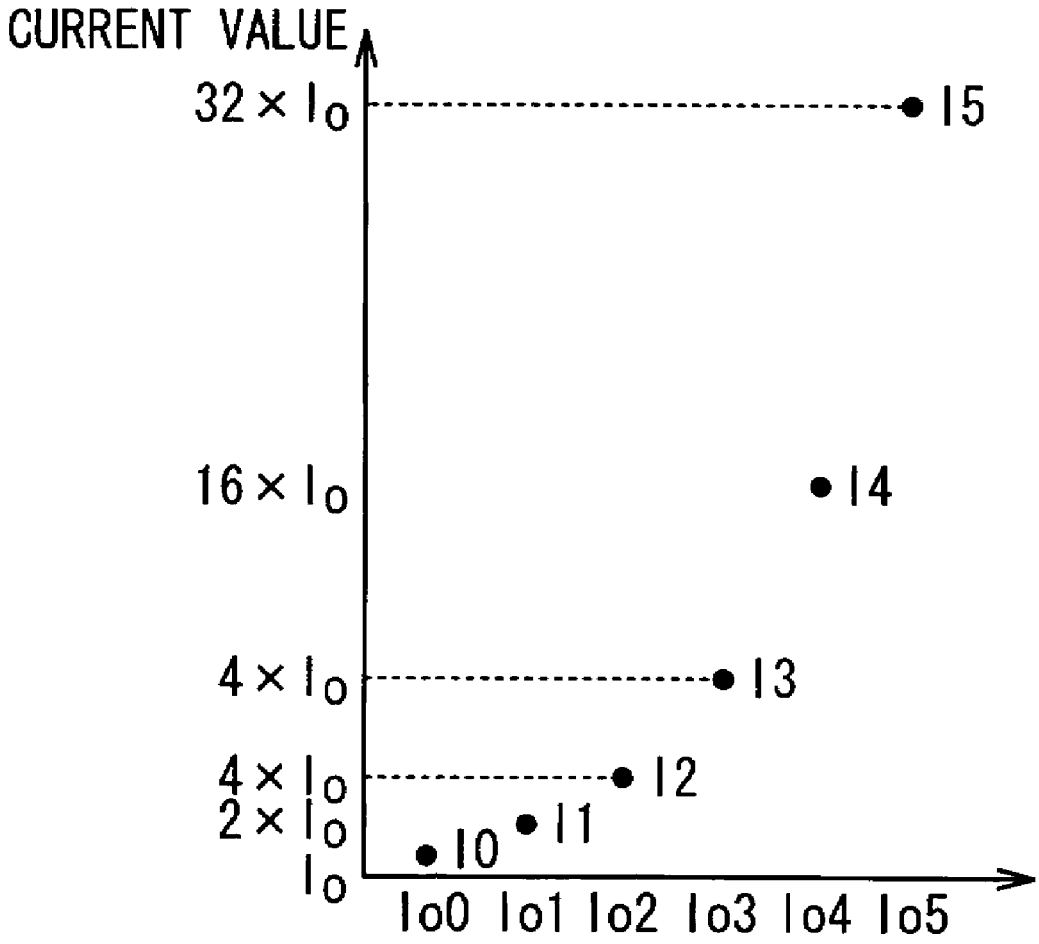
FIG. 8 is a graph showing a relation between a reference current and an output current.
Figure 9:
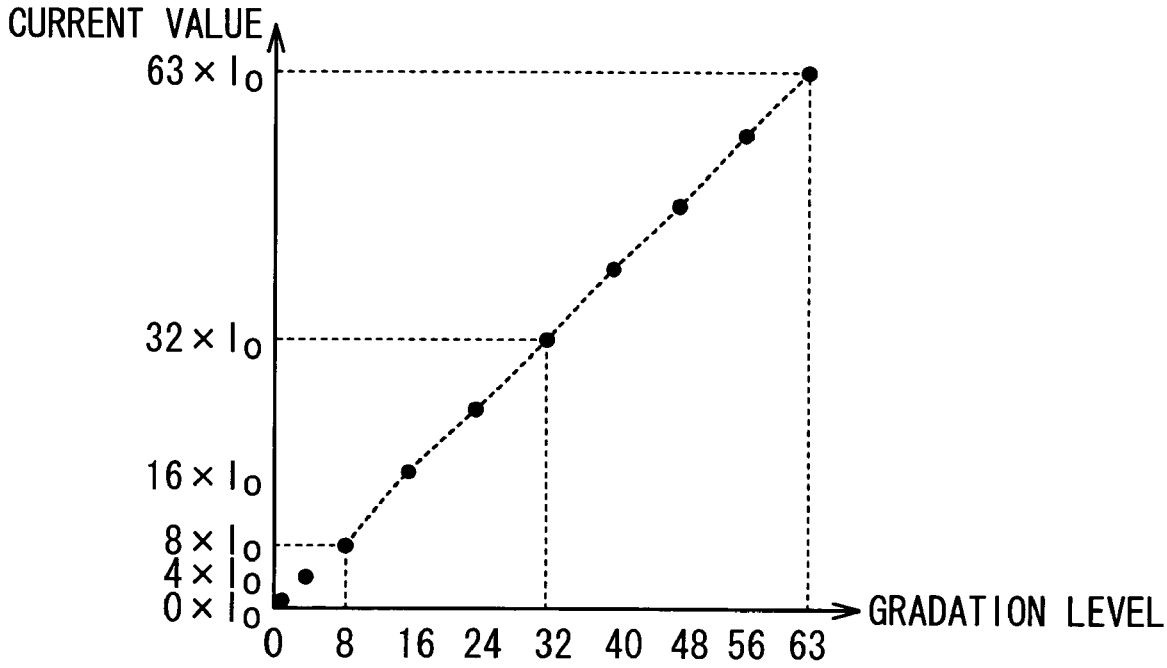
FIG. 9 is a graph showing a relation between gradation and current driver output.

Hereinafter, a reference current source circuit of semiconductor devices, and an organic EL display apparatus using the same of the present invention will be described in detail with reference to the attached drawings. In this embodiment, the current source circuit outputs six kinds of currents having a current ratio of 1:2:4:8:16:32, as shown in FIG. 8. The current output with 64 gradation levels from 0 gradation level to 63 gradation level can be realized based on a display digital data of 6 bits, as shown in FIG. 9. Thus, an organic EL display apparatus using the current source circuit is possible to display 64 gradation levels. It should be noted that a capacitor is sometimes referred to as a capacitance and a resistor is sometimes referred to as a resistance, in the following description. Also, the present invention can be applied in the same way even when the number of outputs and the current ratio are changed. However, when the number of outputs is one or two, a resistance string section to be described later is not needed. Instead, only one or two voltage inputs become necessary. Also, a transistor to be used in the following description is a field effect transistor (FET) and a kind of the FET is not limited as far as it is not specified. The transistor may be of a TFT type. In the following description, components having same or similar functions are allocated with same or similar reference numerals or symbols.

First Embodiment

Figure 10:
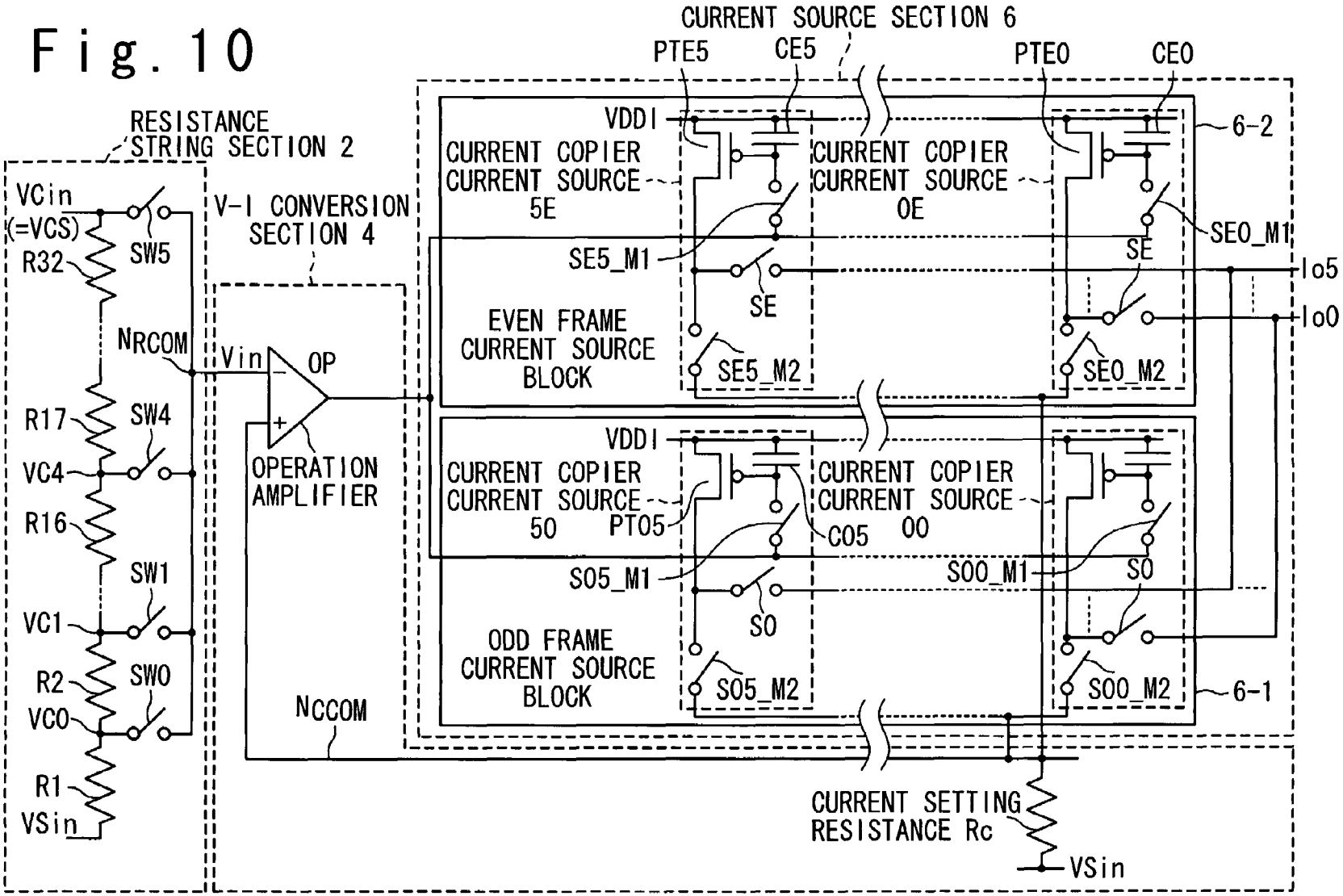
FIG. 10 is a diagram showing the circuit structure of a reference current source circuit according to a first embodiment of the present invention.

As shown in FIG. 10, the current source circuit according to the first embodiment of the present invention is composed of a resistance string section 2, a V-I conversion section 4, and a current source section 6.

The resistance string section 2 is composed of 32 resistances R1, R2, . . . , R32, and six switches SW0, SW1, SW2, . . . SW5. The switches are supplied with control signals which are given the same names as the switches. The 32 resistances have a same resistance value and are connected in series. Voltages VCin (VCS) and VSin are applied across both ends of the resistance string. Each of the six switches is connected at one end with a common node $N_{RCOM}$ as an output of the resistance string section 2 to output a voltage Vin. The other end of each of the six switches is connected with one of a node between the resistances R1 and R2 (VC0), a node between the resistances R2 and R3 (VC1), a node between the resistances R4 and R5 (VC2), a node between the resistances R8 and R9 (VC3), a node between the resistances R16 and R17 (VC4), and a node to which the voltage Vcin (=VC5) is applied. Here, it should be noted that signal lines for the above control signals are not shown in FIG. 10. Also, each of the six switches is controlled in response to the control signal, and is turned on when the control signal is in a high level and is turned off when the control signal is in a low level. This is similar to the following description, as far as there is not a specific description. In the above situation, it is supposed that the relation of a voltage ratio of (VC0−VSin):(VC1−VSin):(VC2−VSin):(VC3−VSin):(VC4−VSin):(VC5−VSin)=1:2:4:8:16:32 is met.

The V-I conversion section 4 is composed of a current setting resistance Rc and an operation amplifier OP. One end of the current setting resistance Rc is connected with the voltage Vsin. The other end of the current setting resistance Rc is connected with a common node $N_{CCOM}$. The voltage Vin outputted from the resistance string section 2 is connected with the inversion input of the operation amplifier OP. The non-inversion input of the operation amplifier OP is connected with the common node $N_{CCOM}$. The output of the operation amplifier OP is connected with an input of the current source section 6.

The current source section 6 is composed of an odd frame current source block 6-1 and an even frame current source block 6-2. The odd frame current source block 6-1 is composed of six current copier current sources 0O to 5O, and the even frame current source block 6-2 is composed of six current copier current sources 0E to 5E. Each of the six current copier current sources 0E to 5E in the even frame current source block 6-2 is composed of a P-type transistor PTEi (i is an integer and $0 \leqq i \leqq 5$), a capacitance CEi, three switches SEi_M1, SE and SEi_M2. The source of the P-type transistor PTEi is connected with a power supply voltage VDDI, and the capacitance CEi is connected between the power supply voltage VDDI and the gate of the P-type transistor PTEi. The switch SEi_M1 is provided between the gate of the P-type transistor PTEi and the output of the V-I conversion section 4 and is controlled in response to a control signal SEi_M1. The switch SEi_M2 is provided between the drain of the P-type transistor PTEi and the common node $N_{CCOM}$, i.e., the non-inversion input of the operation amplifier OP of the V-I conversion section 4 and is controlled by a control signal SEi_M2. The switch SE is provided between the drain of the P-type transistor PTEi and an output Ioi of the current source circuit and is controlled by a control signal SE.

Also, each of the six current copier current sources 0O to 5O in the odd frame current source block 6-1 is composed of a P-type transistor PTOi (i is an integer and $0 \leqq i \leqq 5$), a capacitance COi, three switches SOi_M1, SO and SOi_M2. The source of the P-type transistor PTOi is connected with the power supply voltage VDDI, and the capacitance COi is connected between the power supply voltage VDDI and the gate of the P-type transistor PTOi. The switch SOi_M1 is provided between the gate of the P-type transistor PTOi and the output of the V-I conversion section 4 and is controlled in response to a control signal SOi_M1. The switch SOi_M2 is provided between the drain of the P-type transistor PTOi and the common node $N_{CCOM}$, i.e., the non-inversion input of the operation amplifier OP of the V-I conversion section 4 and is controlled by a control signal SOi_M2. The switch SO is provided between the drain of the P-type transistor PTOi and an output Ioi of the current source circuit and is controlled by a control signal SO.

Next, an operation of the current source section will be described below. Each of the odd frame and even frame current source blocks 6-1 and 6-2 of the present invention has two operation states: one is a current setting operation and the other is a current outputting operation. The even frame current source block 6-2 of the current source section 6 carries out the current setting operation in an odd frame period and the current outputting operation in an even frame period. On the other hand, the odd frame current source block 6-1 carries out the current outputting operation in the odd frame period and the current setting operation in the even frame period.

FIGS. 11A to 11J show timing charts of the operations. Referring to FIGS. 11A to 11J, the current setting operation of the even frame current source block 6-2 will be described.

Figures 11A, 11B, 11C, 11D, 11E, 11F, 11G, 11H, 11I, 11J:
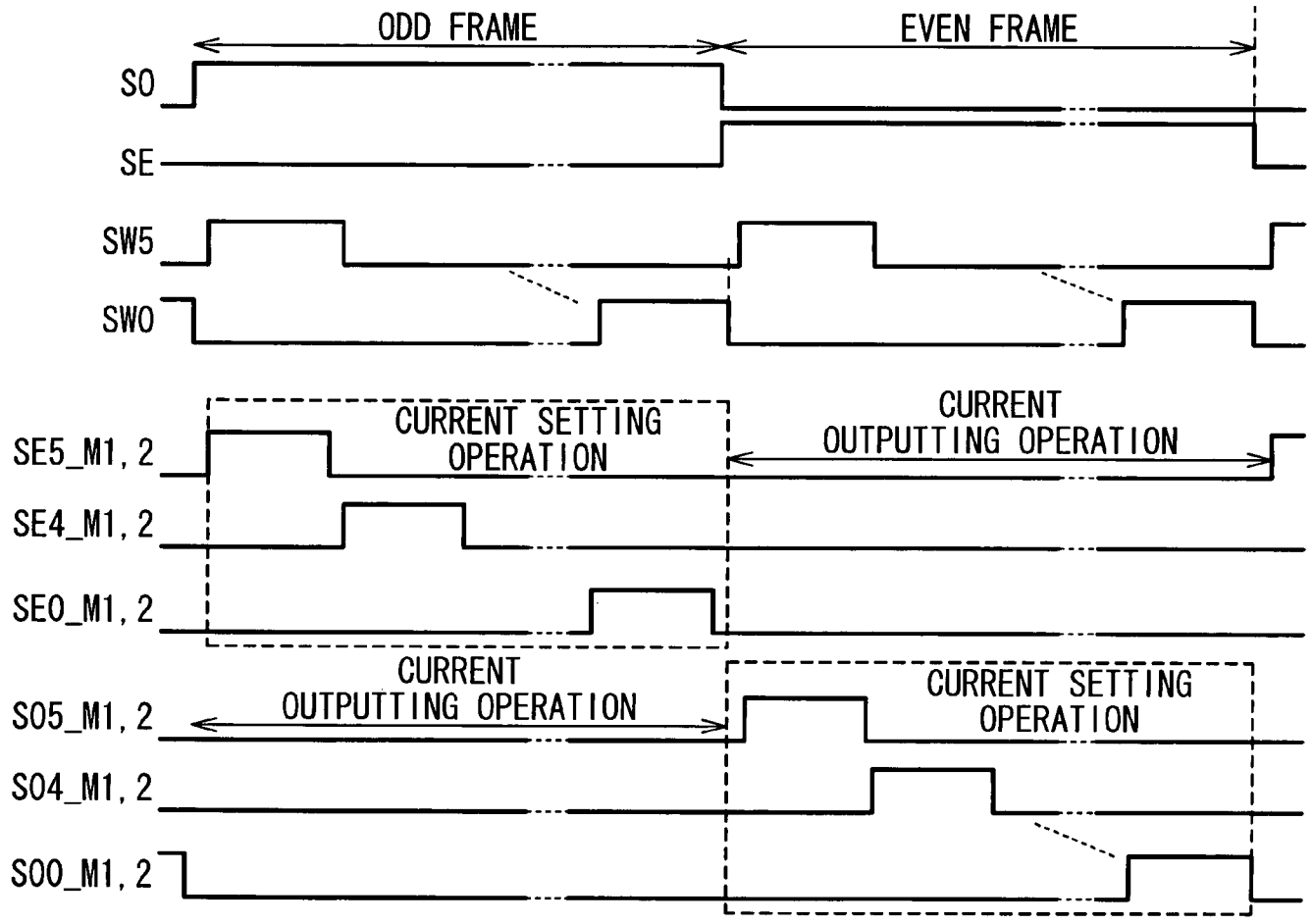
FIGS. 11A to 11J are timing charts showing an operation of the reference current source circuit in the first embodiment.

The even frame current source block 6-2 carries out the current setting operation in the odd frame period. In this period, in each of the current copier current sources iE of the even frame current source block 6-2, the switches SO are turned on as shown in FIG. 11A, and the switch SE is turned off as shown in FIG. 11B. As a result, the outputs IoO to Io5 are disconnected from all the current copier current sources iE in the even frame current source block 6-2 and connected with all the current copier current sources iO in the odd frame current source block 6-1.

Figure 12:
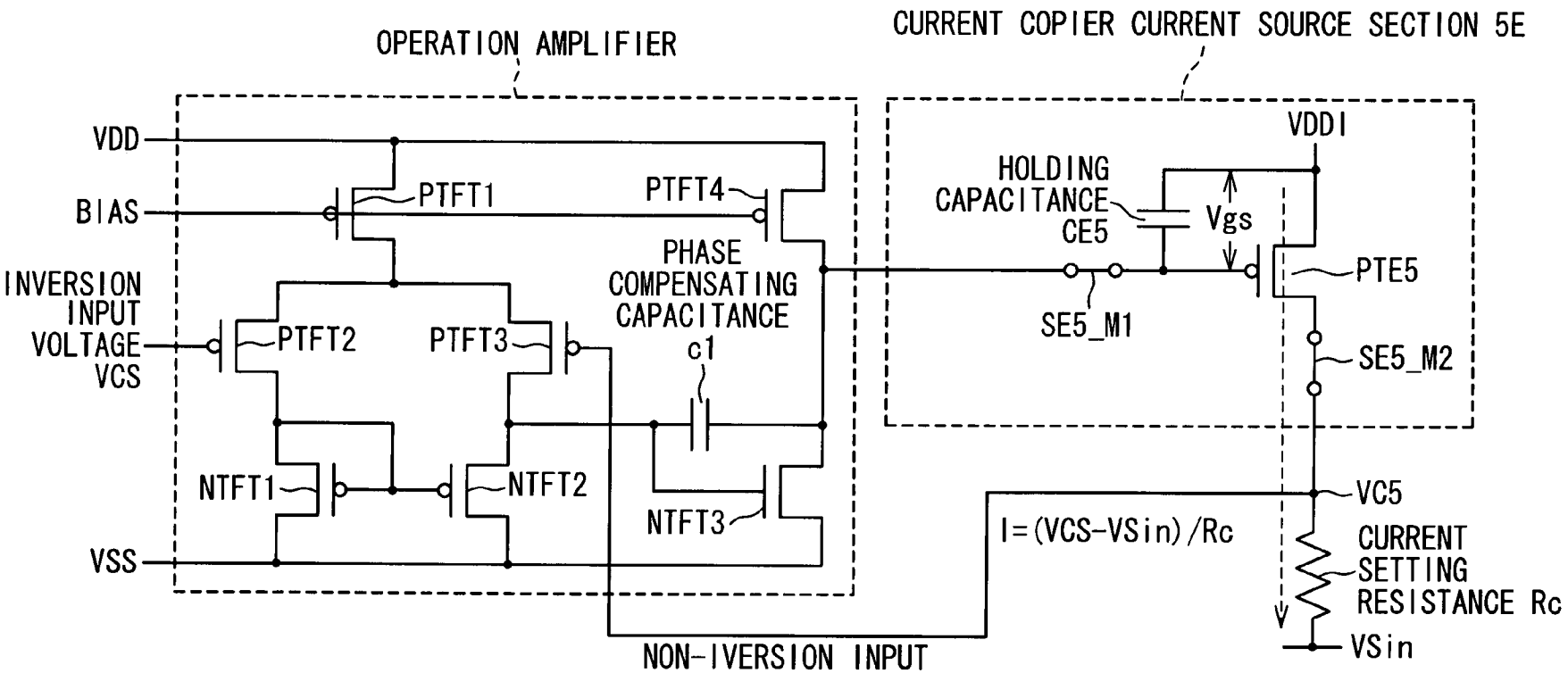
FIG. 12 is a circuit diagram showing a setting operation of I5 current in the reference current source circuit of the first embodiment.

Also, in the odd frame period, the switch SW5 in the resistance string section 2, and the switches SE5_M1 and SE5_M2 in the current copier current source 5E of the even frame current source block 6-2 are turned on in response to the control signals SW5, SE5_M1 and SE5_M2, as shown in FIG. 11E. In this case, the connection between the V-I conversion section 4 and the current copier current source 5E of the even frame current source block 6-2 is set as shown in FIG. 12. The operation amplifier OP of the V-I conversion section 4 shown in FIG. 12 is the most popular 2-stage operation amplifier OP with a power supply voltage VDD and a ground voltage VSS. However, the operation amplifier OP is not restricted by the structure shown in FIG. 12 and any operation amplifier OP which carries out the following operation is available.

In the operating state, the voltage VC5 (=VCin) is applied to the inversion input of the operation amplifier OP in the V-I conversion section 4, and the non-inversion input of the operation amplifier OP is connected with the current setting resistance Rc. At this time, the operation amplifier OP, the P-type transistor PTE5 in the current copier current source 5E and the current setting resistance Rc constitute a new operation amplifier. In other words, a voltage follower is formed in which the non-inversion input of the original operation amplifier OP functions as the inversion input, the inversion input of the original operation amplifier OP functions as the non-inversion input, the P-type transistor PTE5 of the current copier current source 5E and the current setting resistance Rc become an output stage. Therefore, the output voltage of the new voltage follower is VC5, and current I5 (=(VC5−VSin)/Rc) flows through the P-type transistor in the current copier current source 5E and the current setting resistance Rc. At this time, a voltage is applied to the gate of the P-type transistor PTE5 in the current copier current source 5E such that the current I5 flows between the drain and the source of the P-type transistor PTE5 (see FIG. 12). Subsequently, the switches SE5_M1 and SE5_M2 are turned off in response to the control signals SE5_M1 and SE5_M2, as shown in FIG. 11E. At this time, the gate voltage of the P-type transistor PTE5 of the current copier current source 5E is held by the holding capacitance CE5 to a voltage at which the current I5 flows through the P-type transistor PTE5.

Next, the control signal SW5 is set to the low level and the control signals SW4, SE4_M1 and SE4_M2 are set to the high level, as shown in FIG. 11F. Thus, the switch SW5 of the resistance string section 2 is turned off and the switch SW4 of the resistance string section 2 and the switches SE4_M1 and SE4_M2 in the current copier current source 4E of the even frame current source block 6-2 are turned on. At this time, because the voltage VC4 is applied to the inversion input of the operation amplifier OP of the V-I conversion section 2, a current I4 (=(VC4−VSin)/Rc) flows through the P-type transistor PTE4 of the current copier current source 4E and the current setting resistance Rc, in the same way as the operation described above. At this time, a voltage is applied to the gate of the P-type transistor in the current copier current source 4E such that the current I4 flows between the drain and the source of the P-type transistor PTE4.

Next, the switches SE4_M1 and SE4_M2 are turned off in response to the control signals SE4_M1 and SE4_M2. At this time, the gate voltage of the P-type transistor PTE4 of the current copier current source 4E is held to a voltage by the holding capacitance CE4 such that the current I4 flows between the drain and the source of the P-type transistor PTE4.

In the odd frame period, the current copier current sources 3E, 2E, 1E and 0E in the even frame current source block 6-2 carry out the same operation as described above. Thus, the voltages held by the holding capacitances CE3, CE2, CE1, and CE0 are applied to the gates of the P-type transistors PTE3, PTE2, PTE1 and PTE0 in the current copier current sources 3E, 2E, 1E and 0E in the even frame current source block 6-2 such that the currents I3 (=(VC2−VSin)/Rc), I2 (=(VC2−VSin)/Rc), I1 (=(VC1−VSin)/Rc), I0 (=(VC0−VSin)/Rc) flow through the respective P-type transistors.

Through the above-mentioned process, the current setting operation ends.

Here, an attention should be paid to the timing of the switch control. In this embodiment, it is necessary that the control signals SWi, SEi_M1 and SEi_M2 (i is an integer and $0 \leqq i \leqq 5$) are generated such that the switches SEi_M2 and SWi are turned off at a same time as the switch SEi_M1 or at a time later than the switch SEi_M1. This is applied to the even frame current source block 6-2 in the same way. The first reason is to set the voltage of the holding capacitance to the voltage of the state in which the current is flowing. The second reason is to restrain the noise generated in response to an operation of another switch as less as possible, i.e., to remove the influence of the noise. The timing charts of this embodiment shown in FIGS. 11A to 11J is an example and the switches SEi_M1 and SEi_M2 may be simultaneously turned off and then the switch SWi may be turned off.

In the next even frame period, the output Io0 to Io5 of the whole current source circuit are respectively connected with the drains of the P-type transistors PTE5 to PTE0 of the current copier current sources 5E to 0E in the even frame current source block 6-2 by the switches SE of the current copier current sources 5E to 0E in the even frame current source block 6-2 in accordance with the control signals SE, and the reference current outputting operation is carried out, such that the current I0 to I5 are outputted.

On the other hand, in the even frame period, the current setting operation is carried out in the odd frame current source block 6-1 in the same way as the even frame current source block 6-2.

The above-mentioned operation is repeats for each frame, and the current source circuit can always output the current I0 to I5.

In this embodiment of the present invention, the transistor which sets the current and the transistor which outputs the current are same in the current copier circuit. In other words, in the current setting operation, by forming a short-circuit between the gate and drain of the P-type transistor in the current copier current source, and by applying through the P-type transistor the currents I5 to I0 based on the current setting resistance and the inversion input voltage of the operation amplifier OP of the V-I conversion section 4, the gate voltage of the P-type transistor PTEi or PTOi in the current copier current source iE or iO can be set to the voltage by which the current between the drain and the source in the saturated operation region of the transistor is set to either of the currents I5 to I0. On the other hand, in the current outputting operation, the P-type transistor PTEi or PTOi in the current copier current source iE or iO outputs the currents I5 to I0 in accordance with the set gate voltage. In this way, the gate voltage of the P-type transistor in the current copier current source is held in the state in which either of the current I5 to I0 flows actually between the drain and the source, and the either of the currents I5 to I0 is outputted from the same transistor. Thus, it is possible to output the currents I5 to I0 regardless of a deviation of the current characteristics between the P-type transistors Also, in the current copier current source, it is necessary that the period during which the current is set is provided separately from the period during which the current is outputted. Therefore, the current can not be always outputted. In order to solve the problem, the two current source blocks for the even frame and the odd frame are provided in the present invention. During the period during which the current is set in one of the two current source blocks, the other outputs the current. Thus, the current can be always outputted.

Also, in the present invention, the current value set to the current copier current source is determined based on the voltage which has a voltage ratio to the voltage Vcin and which is determined based on a resistance ratio in the resistance string section 2 and the resistance value of the current setting resistance Rc common to all the current copier current sources. The set current value does not depend on the resistances. Thus, the current ratio with higher precision can be realized.

Moreover, the current value can be simply adjusted while keeping the current ratio, by adjusting the voltage VCin applied to the resistance string. Therefore, it is possible to simply adjust the output current value to a design value by adjusting the voltage Vcin, even if the value of the current setting resistance Rc is different from a design value.

Second Embodiment

The circuit structure of the current source circuit according to the second embodiment will be described with reference to FIG. 13. In the first embodiment, when the operation amplifier OP in the V-I conversion section has an offset voltage Voff, the output current Ii sometimes shifts by the offset voltage, for example, to I5=(VCin+Voff−VSin)/Rc. In this case, this current ratio is different from an ideal current ratio. In the second embodiment, an offset cancellation block is added to the V-I conversion section in the first embodiment.

The offset cancellation block has a capacitance and switches. The resistance string section 2 and the current source section 6 in the second embodiment are the same as those of the first embodiment.

Figure 13:
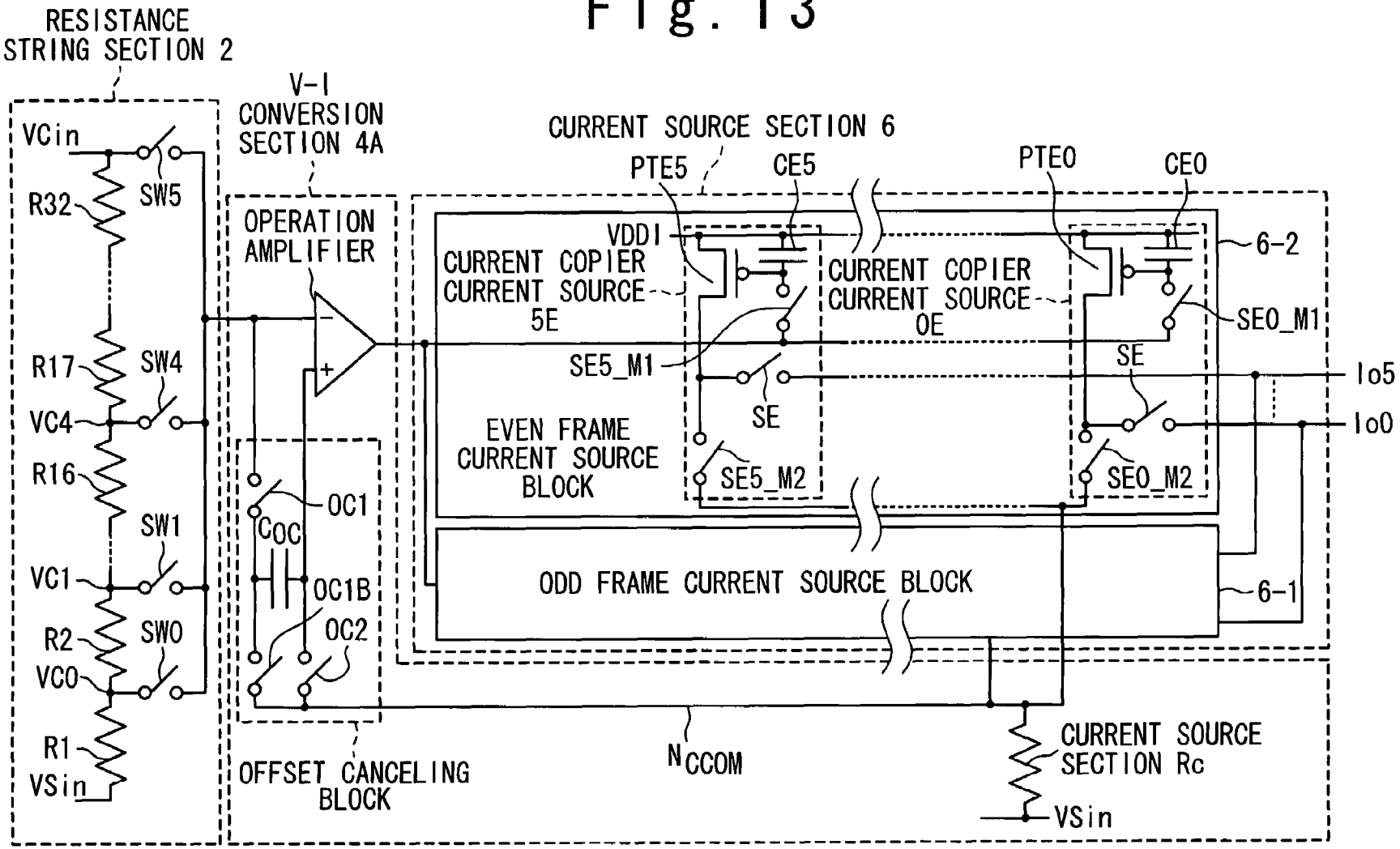
FIG. 13 is a diagram showing the circuit structure of the reference current source circuit according to a second embodiment of the present invention.
Figures 14A, 14B, 14C, 14D, 14E, 14F, 14G, 14H, 14I, 14J, 14K, 14L:
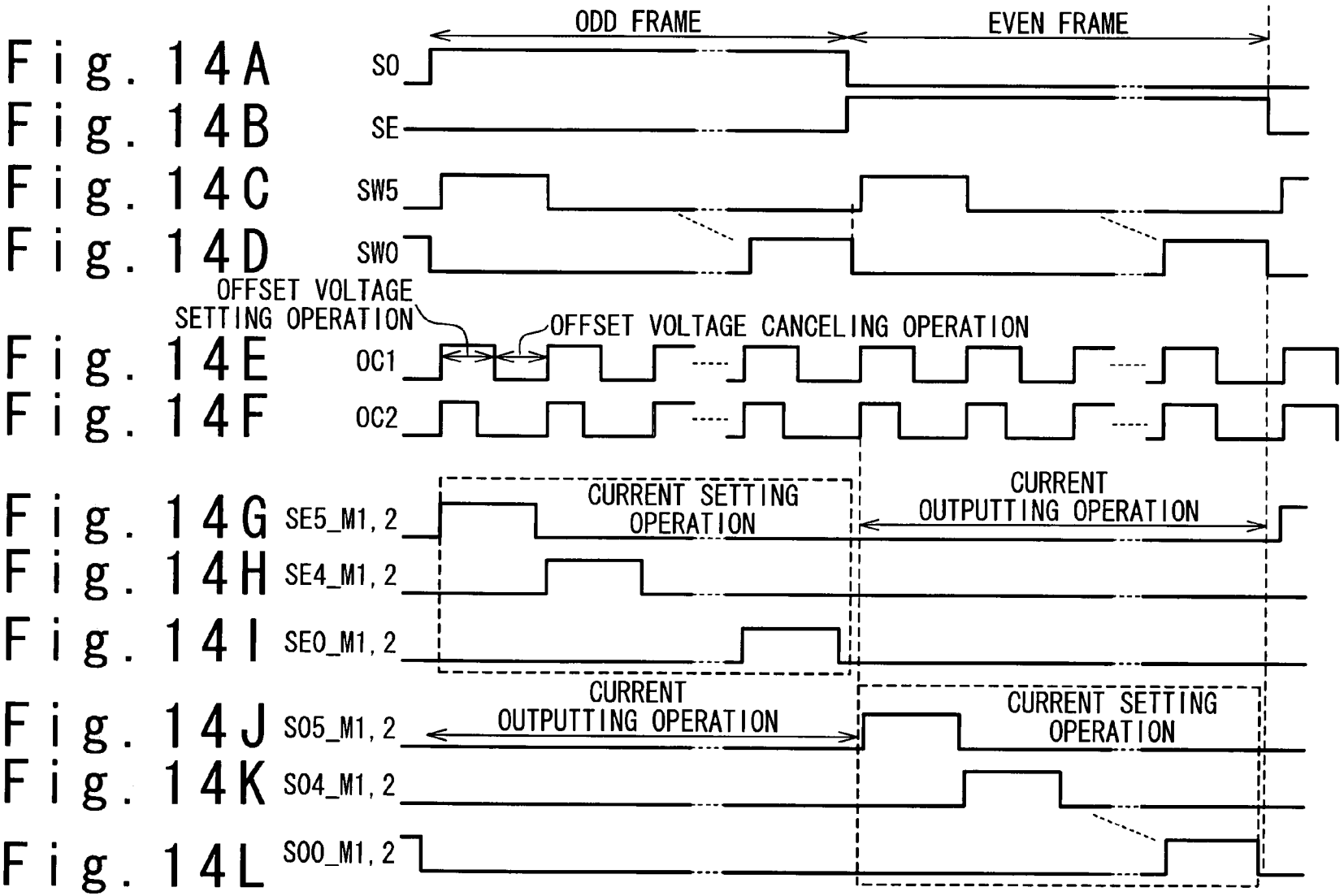
FIGS. 14A to 14L are timing charts showing an operation of the reference current source circuit in the second embodiment.

As shown in FIG. 13, the V-I conversion section 4A in the second embodiment is composed of the operation amplifier OP, the current setting resistance Rc, a capacitance Coc, and switches OC1, OC1B and OC2. The output of the resistance string section 2 is connected with the inversion input of the operation amplifier OP. The output of the operation amplifier OP is connected with the input of the current source section 6. One end of the current setting resistance Rc is connected with the voltage Vsin, and the other end thereof as the common node $N_{CCOM}$ is connected with the current source section 6, like the first embodiment. The switch OC2 is connected between the non-inversion input of the operation amplifier OP and the common node $N_{CCOM}$, and is controlled in response to a control signal OC1. The switches OC1 and OC1B are connected in series between the inversion input of the operation amplifier OP and the common node $N_{CCOM}$. These switches are controlled in response to control signals OC1 and OC1B, respectively. The capacitance Coc is connected between the non-inversion input of the operation amplifier OP and a node between the switches OC1 and OC1B.

The operation of the current source circuit 6 in the second embodiment will be described with reference to the timing charts of FIGS. 14A to 14M. The current source section 6 in the second embodiment has the odd frame current source block 6-1 and the even frame current source block 6-2, each of which has two operating states, like the first embodiment. One is the current setting operation and the other is a current outputting operation. The even frame current source block 6-2 carries out the current outputting operation in the even frame period and the current setting operation in the odd frame period. On the other hand, the odd frame current source block 6-1 carries out the current setting operation in the even frame period and the current outputting operation in the odd frame period. The current setting-operation of the even frame current source block 6-2 will be described with reference to the timing charts of FIGS. 14A to 14M.

It is in the odd frame period that the current setting operation is carried out by the even frame current source bloc 6-2. In the odd frame period, the control signal SE is set to the low level so that the switch SE in each of the current copier current sources 5E to 0E is turned off, resulting in the even frame current source block 6-2 being disconnected from the outputs Io5 to Io0.

Figure 15A:
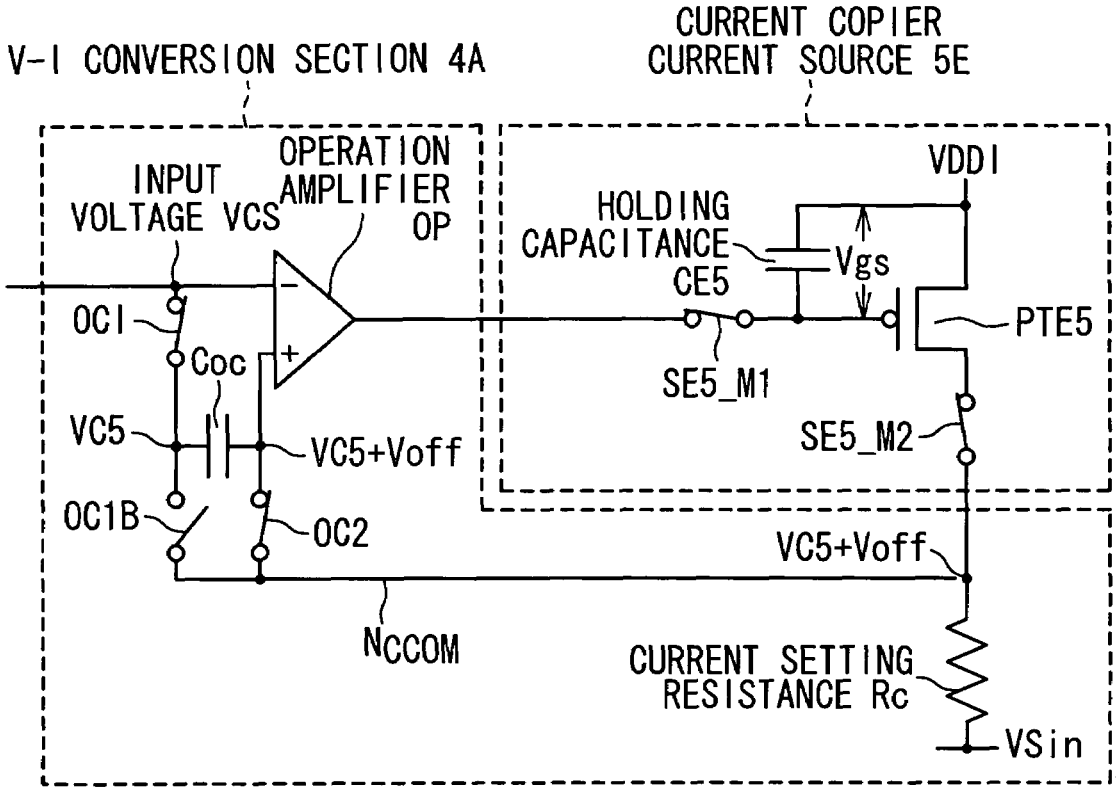
FIG. 15A is a diagram showing an offset voltage setting operation of the reference current source circuit in the second embodiment during a current setting operation period.

Subsequently, in the odd frame period, the switch SW5 in the resistance string section 2, the switches OC1 and OC2 in the V-I conversion section 2A, and the switches SE5_M1 and SE5_M2 in the current copier current source 5E of the even frame current source block 6-2 are turned on in response to the control signals SW5, OC1, OC2, OC1B, SE5_M1 and SE5_M2, as shown in FIGS. 14C to 14G. The switch OC1B in the V-I conversion section 2A is turned off. This operation state is referred to as an offset voltage setting state. FIG. 15A shows a block diagram of a portion related with the operation.

In the offset voltage setting state, a voltage VC5 is applied to the inversion input of the operation amplifier OP in the V-I conversion section 4A from the resistances of the resistance string section 2. Also, an new operation amplifier is formed by the operation amplifier OP of the V-I conversion section 4A, the current setting resistance Rc, the current copier current source 5E in the even frame current source block 6-2 to have the inversion input of the operation amplifier OP in the V-I conversion section 4A as a non-inversion input, the non-inversion input thereof as an inversion input and a node between the current setting resistance Rc and the switch SE5_M2 as an output. The new operation amplifier is connected with a voltage follower. Therefore, supposing that a offset voltage of the new amplifier is Voff', a voltage VC5+Voff' is applied to one end of the capacitance Coc on the side of the non-inversion input of the operation amplifier OP and the voltage VC5 is applied to the other end because of an imaginary short-circuit, as shown in FIG. 15A.

Figure 15B:
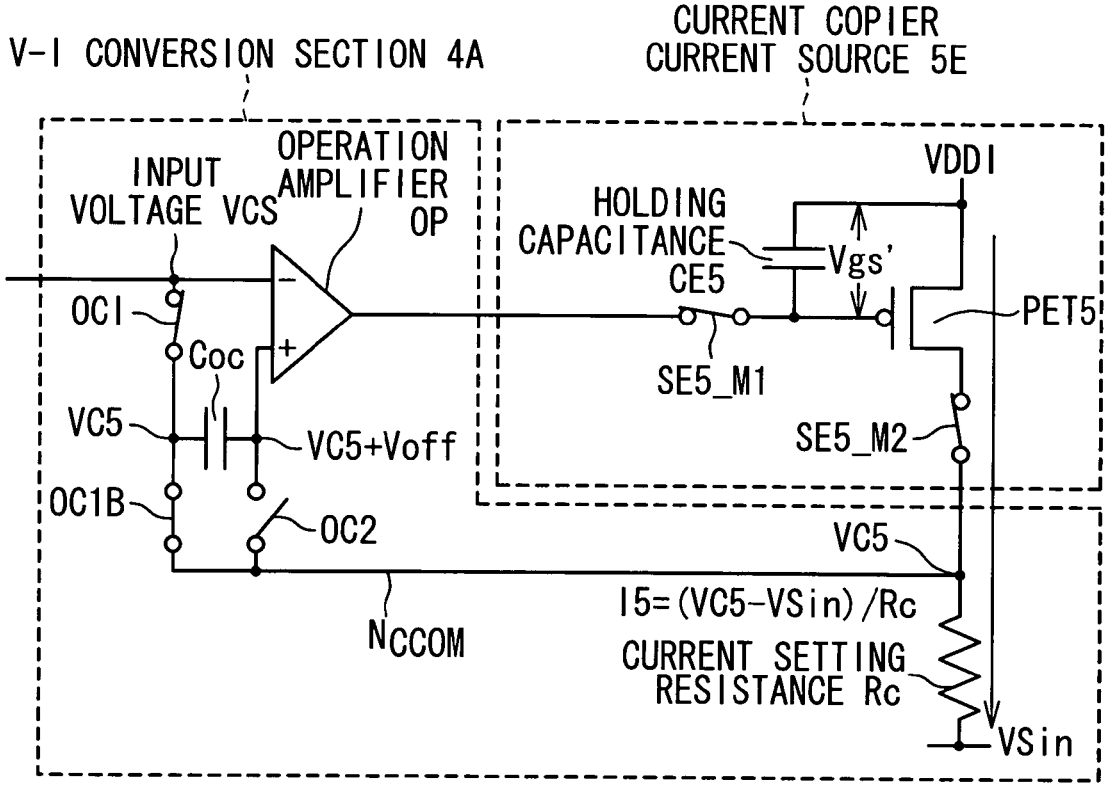
FIGS. 15B is a diagram showing an offset voltage cancellation operation of the reference current source circuit in the second embodiment.

Subsequently, the switches OC1 and OC2 are turned off, the switch OC1B is turned on in the V-I conversion section 4A in response to the control signals OC1, OC2 and OC1B, respectively. The other switches maintain the previous states. This operation state is referred to as an offset voltage canceling state. A circuit diagram at that time is shown in FIG. 15B.

In the offset voltage canceling state, the voltage VC5+Voff' is applied to the non-inversion input of the operation amplifier OP in the V-I conversion section 4A in the new amplifier. In this case, the voltages VC5+Voff' and VC5 were applied across the capacitance Coc in the offset voltage setting state. Therefore, the output of the new operation amplifier is the voltage VC5 in the operating state from the principle of conservation of charge. Thus, in the offset voltage canceling state, the voltage VC5 is applied to the current setting resistance Rc even when the operation amplifier OP of the V-I conversion section 4A has the offset voltage. In this way, the current I5=(VC5−VSin)/Rc flows through the P-type transistor PTE5 of the current copier current source 5E in the even frame current source block 6-2.

Next, the switches SE5_M1 and SE5_M2 are turned off in response to the control signals SE5_M1 and SE5_M2. At that time, the gate voltage of the P-type transistor PTE5 of the current copier current source 5E is held to the voltage by the capacitance CE5 in such a manner that the current I5 can flow through the P-type transistor PTE5. The current setting operation of the current copier current source 5E in the even frame current source block 6-2 ends through the above processes.

Subsequently, the current setting operation is carried out in order in the current copier current sources 4E to 0E of the even frame current source block 6-2 in the odd frame period, as shown in FIGS. 14C to 14I. Thus, the gates of the P-type transistors PTE4, PTE3, PTE2, PTE1 and PTE0 of the current copier current sources 4E, 3E, 2E, 1E and 0E in the even frame current source block 6-2 are held voltages by the capacitances CE4, CE3, CE2, CE1 and CE0 such that the currents I4 (=(VC4−VSin)/Rc), I3 (=(VC2−VSin)/Rc), I2 (=(VC2−VSin)/Rc), I1 (=(VC1−VSin)/Rc), I0 (=(VC0−VSin)/Rc) flow through the P-type transistors in PTE4, PTE3, PTE2, PTE1 and PTE0, respectively. Then, the current setting operation ends.

In the next even frame period, the drains of the P-type transistors PTE4, PTE3, PTE2, PTE1 and PTE0 are connected with the outputs Io5 to Io0 of the current source circuit by the switches SE of the current copier current sources 5E to 0E in the even frame current source block 6-2 in response to the control signals SE. The current outputting operation of the current Io5 to Io0, i.e., a reference current outputting operation is carried out.

On the other hand, in the even frame period, the odd frame current source block 6-1 carries out the same current setting operation in the odd frame period as the even frame current source block 6-2. The above operations are repeated in every two frames and the current source circuit can always output the current of I5 to I0. Also, an attention as in the first embodiment is to be paid to for the control timing of the switches SWi, SEi_M1 and SEi_M2, SOi_M1 and SOi_M2 ($0 \leqq i \leqq 5$, i is an integer).

The second embodiment has an advantage that the offset voltage can be cancelled when the offset voltage exists in the operation amplifier OP of the V-I conversion section 4A, in addition to the advantage of the first embodiment. By adopting the structure, in the second embodiment, the reference currents can be outputted while which a current ratio is kept in a high precision.

Third Embodiment

Figure 16:
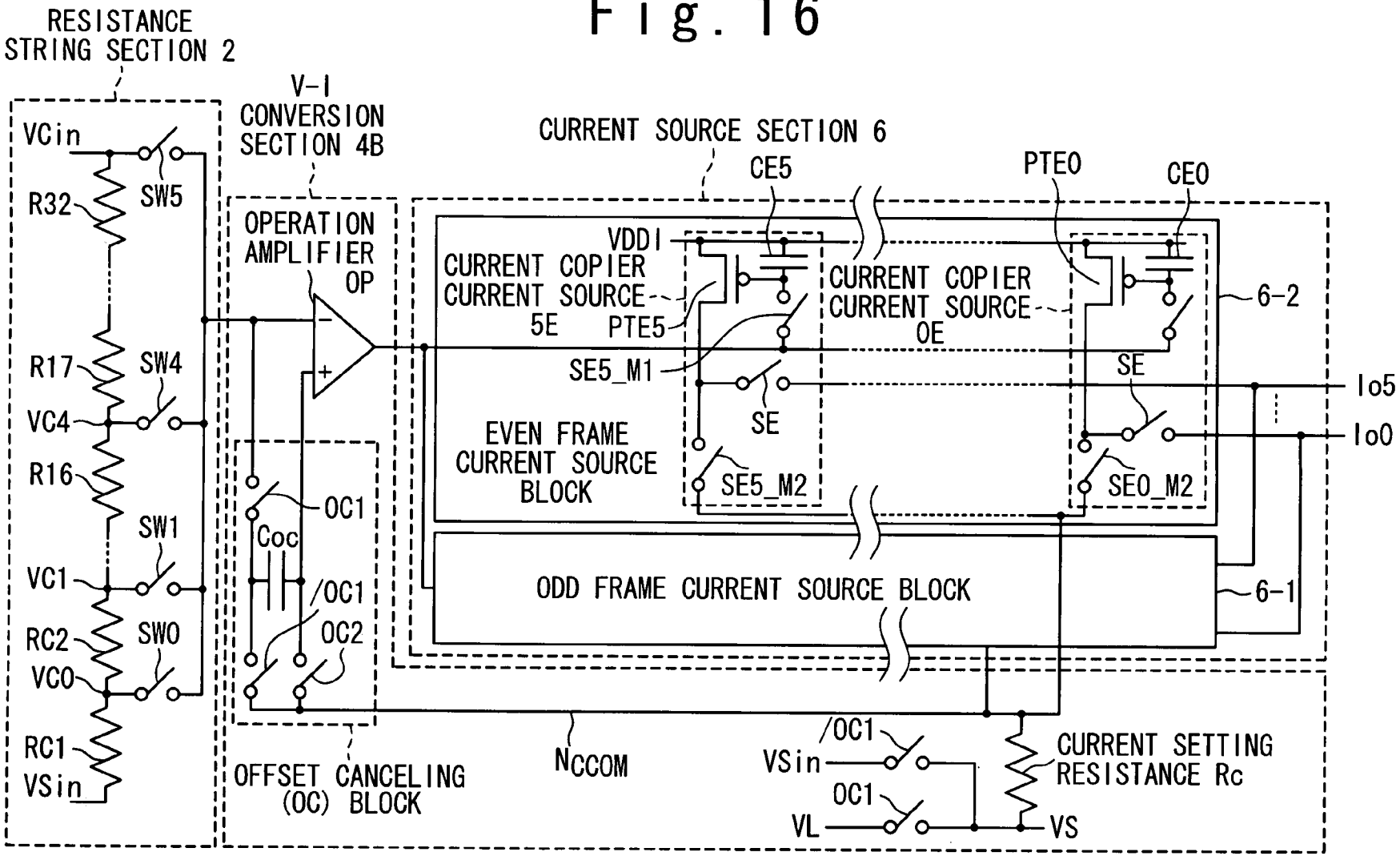
FIG. 16 is a diagram showing the circuit structure of the reference current source circuit according to a third embodiment of the present invention.
Figures 17A, 17B, 17C, 17D, 17E, 17F, 17G, 17H, 17I, 17J, 17K, 17L, 17M:
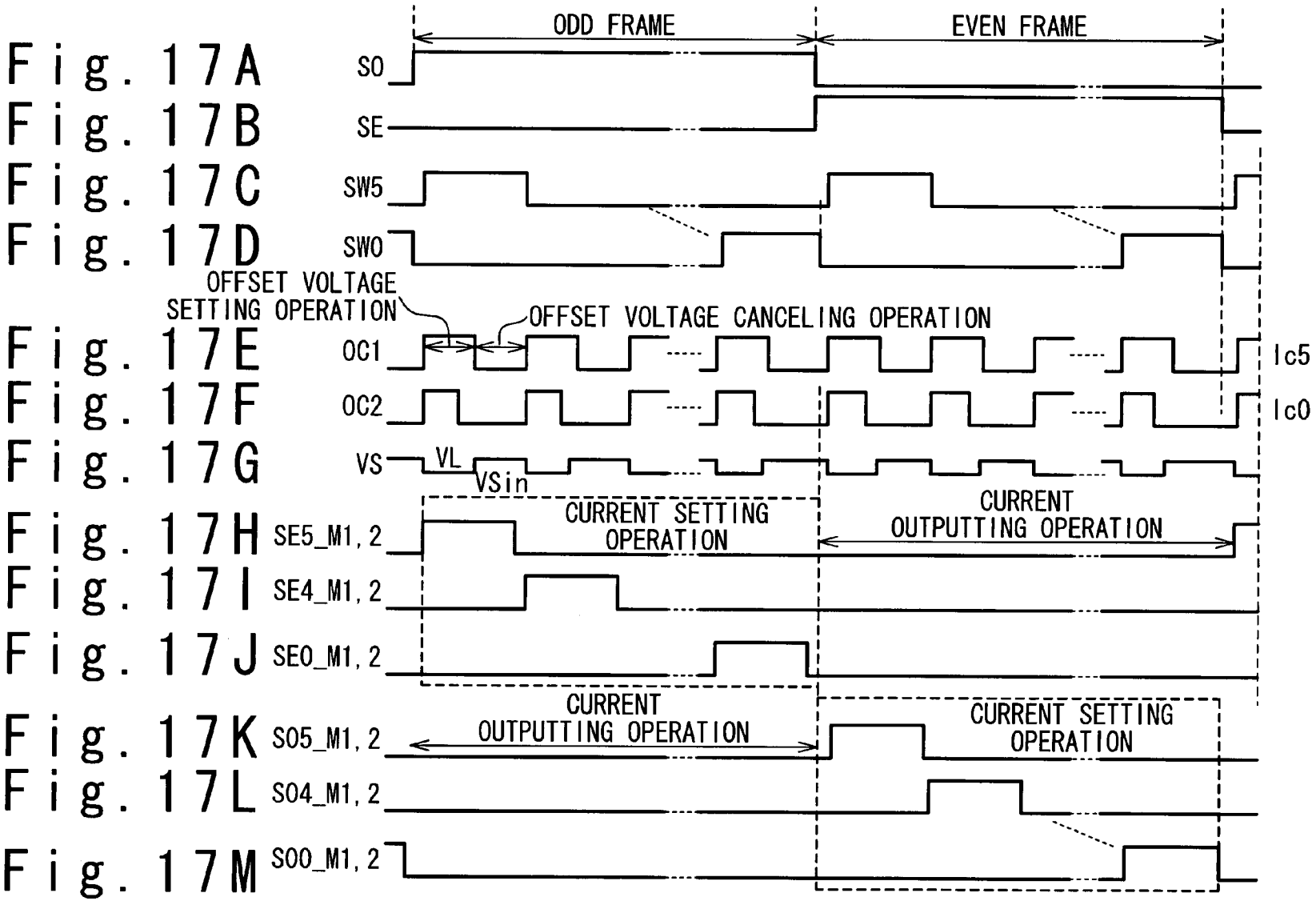
FIGS. 17A to 17M timing charts showing an operation of the reference current source circuit in the third embodiment.

The current source circuit according to the third embodiment can cancel an offset voltage of the operation amplifier OP even when the offset voltage of the operation amplifier OP in the V-I conversion section 4A of the second embodiment is large. The circuit structure in the third embodiment is shown in FIG. 16 and an operation of the structure is shown in the timing chart of FIGS. 17A to 17M.

The third embodiment basically has the same circuit structure and operation as those of the second embodiment. However, the switch OC1B is replaced by a switch /OC1. Also, one end of the current setting resistance Rc on the opposite side of the node $N_{CCOM}$ is connected with the voltage Vsin via a switch /OC1 and a voltage VL via a switch OC1. The switches OC1 are turned on in response to the control signal OC1 and the switches /OC1 are turned on in response to the control signal /OC1 which is an inverted signal of the control signal OC1.

In the third embodiment, the voltage VSin is not always applied to the current setting resistance Rc. A voltage VL is applied to the current setting resistance Rc in the offset voltage setting state of the current setting operation, and the voltage VSin is applied in the offset canceling state after that. The voltage VL is lower than the offset voltage of the operation amplifier OP in the V-I conversion section 4B.

In the third embodiment, the voltage VL is applied to one end of the current setting resistance Rc in the offset voltage setting state. Therefore, a voltage VC0+Voff can be applied to the non-inversion input of the operation amplifier OP in the V-I conversion section 4B to cancel the offset. For example, in the third embodiment, when the current setting operation is carried out in the current copier current source 0E of the even frame current source block 6-2, the voltage VSin is not applied to the one end of the current setting resistance Rc, even if the offset voltage Voff of the operation amplifier OP in the V-I conversion section 4B is negative and the voltage VC0+Voff is smaller than Vsin. Thus, the voltage VC0+Voff can be applied to the non-inversion input of the operation amplifier OP in the V-I conversion section 4B in the offset voltage setting state. Thus, the offset cancellation can be carried out.

Fourth Embodiment

Figure 18:
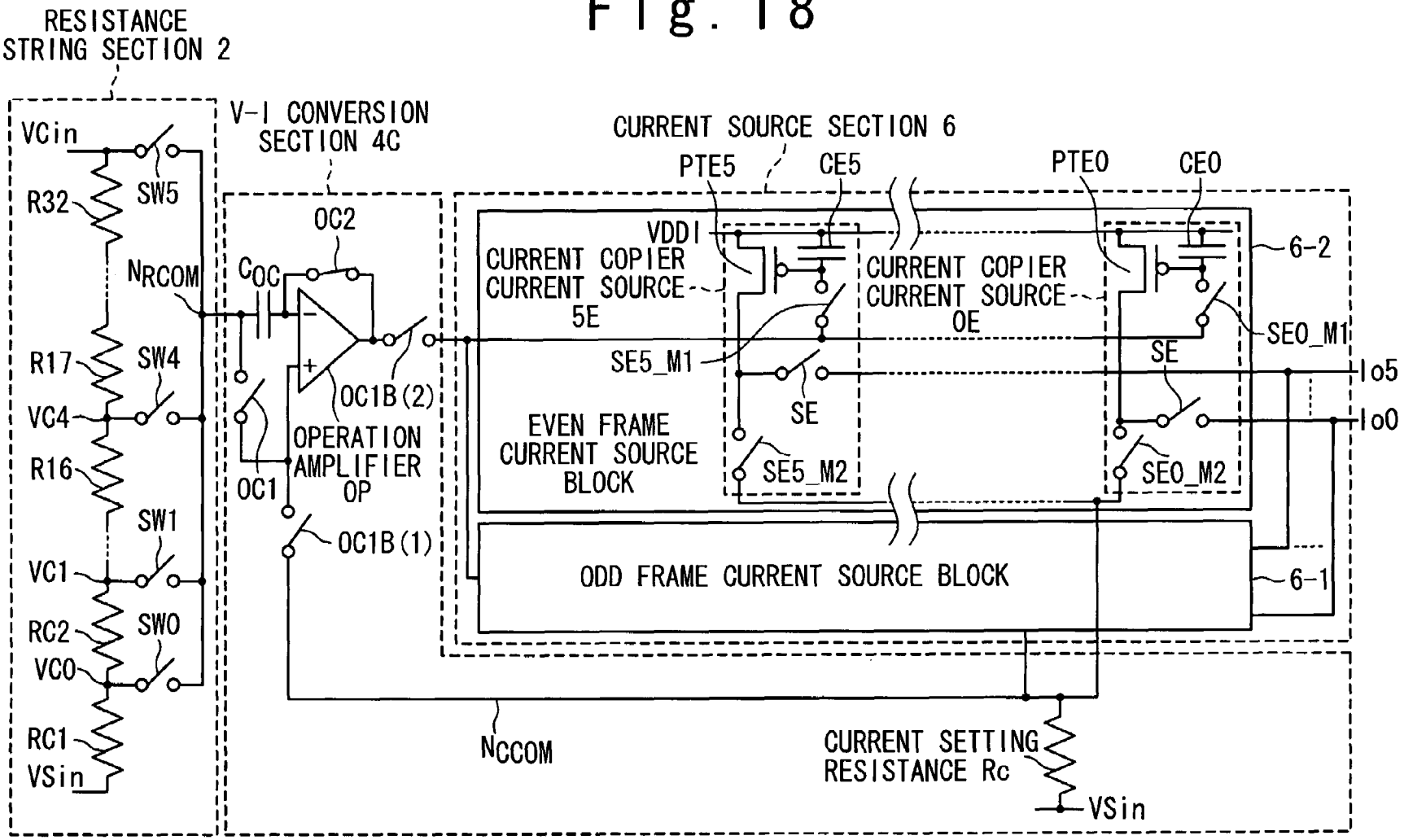
FIG. 18 is a diagram showing the circuit structure of the reference current source circuit according to a fourth embodiment of the present invention.

In the fourth embodiment, the function to cancel the offset voltage of the operation amplifier OP in the V-I conversion section 4B according to the third embodiment can be made faster. FIG. 18 shows the circuit structure of the current source circuit according to the fourth embodiment of the present invention. In the V-I conversion section 4C of the fourth embodiment, a capacitance Coc is connected between the output $N_{RCOM}$ of the resistance string section 2 and the inversion input of the operation amplifier OP in the V-I conversion section 4C. The inversion input of the operation amplifier OP is connected with the output of the operation amplifier OP via a switch OC2. A switch OC1B(1) is connected between the non-inversion input of the operation amplifier OP and the node $N_{CCOM}$ which is connected with one end of the current setting resistance Rc. The voltage VS1n is connected with the other end of the current setting resistance Rc. A switch OC1 is connected between the output $N_{RCOM}$ of the resistance string section 2 and the non-inversion input of the operation amplifier OP in the V-I conversion section 4C via a switch OC2. A switch OC1B(2) is connected between the output of the operation amplifier OP and the input of the current source section 6. The switches OC1, OC1B(1) and OC1B(2) are turned on in response to control signals OC1, OC1B(1) and OC1B(2), respectively.

As described above, the resistance string section 2 and the current source section 6 in the fourth embodiment are the same as those of each of the first to third embodiment.

Next, an operation of the current source circuit according to the fourth embodiment will be described. The timing charts showing the operation of the current source circuit according to the fourth embodiment is the same as those of the second embodiment shown in FIGS. 14A to 14L. The current setting operation of the even frame current source block 6-2 in the fourth embodiment will be described reference to the timing charts of FIGS. 14*a* to 14L.

It is in the odd frame period that the current setting operation is carried out by the even frame current source block 6-2. The output currents Io5 to Io0 are disconnected from the switches SE in the current copier current sources 5E to 0E of the even frame current source block 6-2 in response to the control signal SE in the odd frame period.

In the odd frame period, the switch SW5 in the resistance string section 2, the current copier current source the switches OC1 and OC2 in the V-I conversion section 4C, and the switches SE5_M1 in 5E and SE5_M2 in the even frame current source block 6-2 are turned on in response to the control signals SW5, OC1, OC2, OC1B, SE5_M1 and SE5_M2. The switches OC1B(1) and OC1B(2) in the V-I conversion section 4C are turned off to set the offset voltage setting state.

Figure 19A:
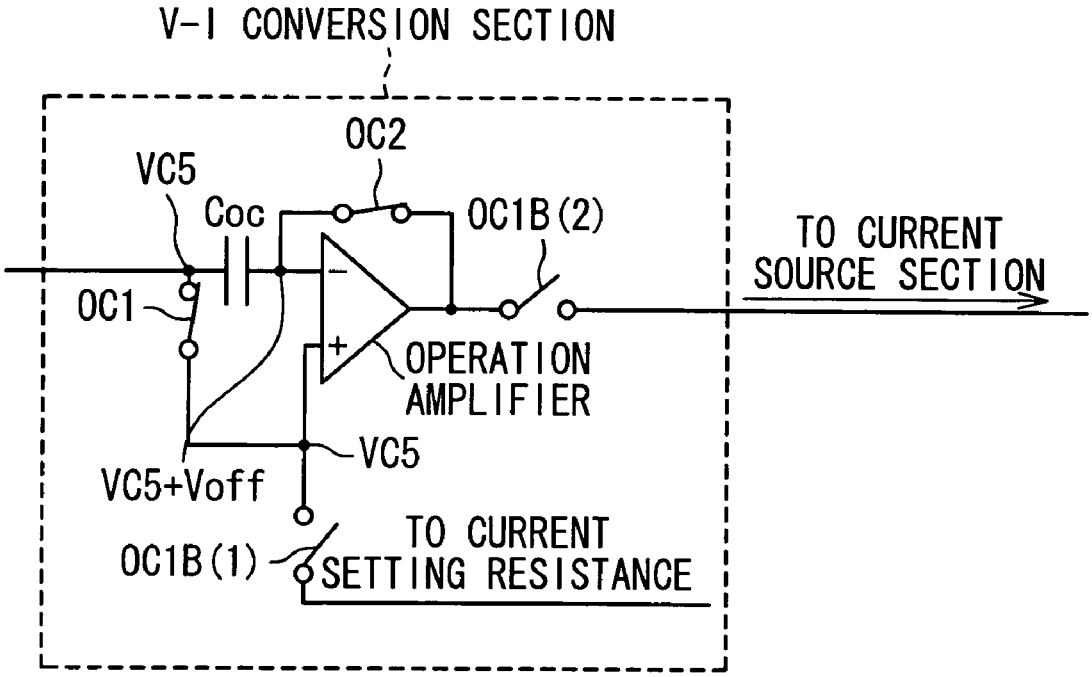
FIG. 19A is a diagram showing an offset voltage setting operation of the reference current source circuit in the fourth embodiment during the current setting operation.

As shown FIG. 19A, the voltage VC5 is applied to the one end of the capacitance Coc of the V-I conversion section 4C by the resistance string section 2 in this state. Also, the operation amplifier OP in the V-I conversion section 4C is disconnected from the current setting resistance Rc in the V-I conversion section 4C and the current source section 6, and the voltage VC5 is applied to the non-inversion input of the operation amplifier OP. If it is supposed that the offset voltage of the operation amplifier OP is Voff, the Voltage VC5+Voff is applied to the inversion input of the operation amplifier OP through the imaginary short-circuit.

Subsequently, the switches OC1 and OC2 in the V-I conversion section 4C are turn off and the switches OC1B(1) and OC1B(2) are turned on in response to the control signals OC1, OC2, and OC1B as the offset voltage canceling state. The other switches keep the previous states.

Figure 19B:
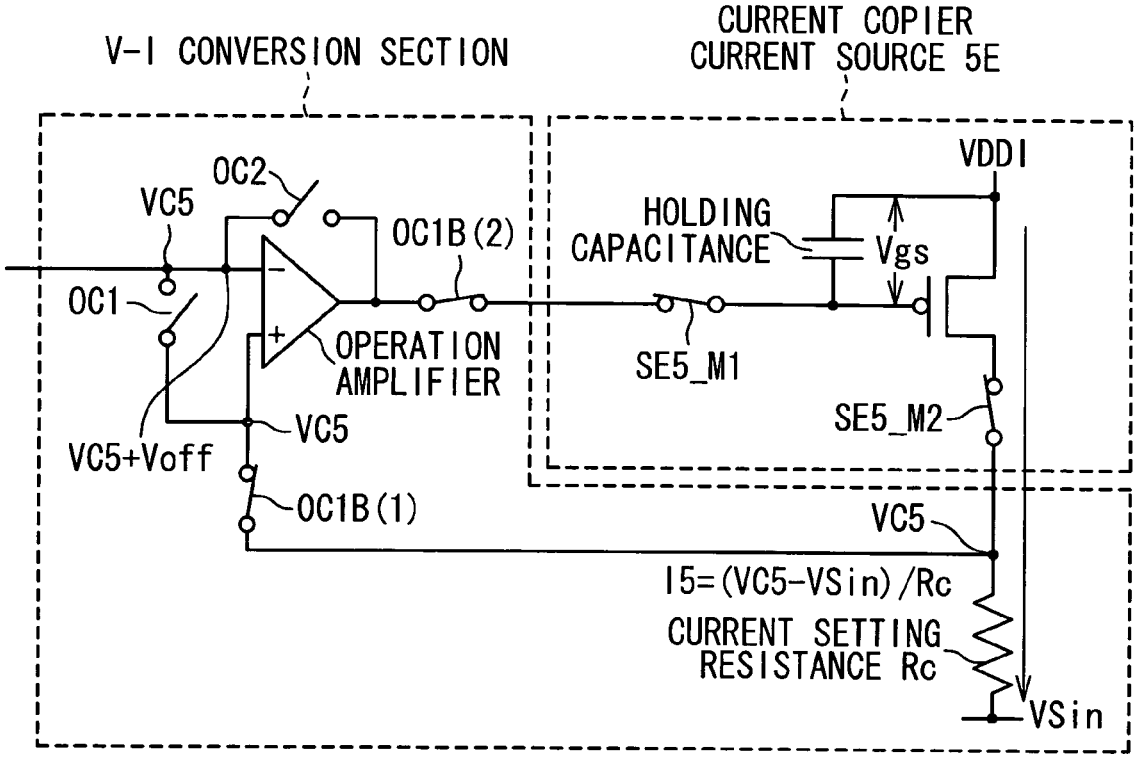
FIG. 19B is a diagram showing the offset voltage cancellation operation of the reference current source circuit in the fourth embodiment.

In this state, like the first to third embodiments, a new V-I conversion section is constituted by the operation amplifier OP in the V-I conversion section 4C, the P-type transistor in each current copier current source in the even frame current source block 6-2 and the current setting resistance Rc. However, as shown FIG. 19B, the voltage VC5 is applied to the one end of the capacitance Coc as in the previous state. Therefore, the voltage at the other end of the capacitance Coc which is connected with the inversion input of the operation amplifier OP in the V-I conversion section 4C is held to VC5+Voff. For this reason, in the new V-I conversion section 4C, the voltage VC5 is applied to the non-inversion input of the operation amplifier OP in the V-I conversion section 4C as in the previous state. Therefore, when the operation amplifier OP of the V-I change has an offset voltage, the voltage VC5 is applied to the current setting resistance Rc, as shown in FIG. 19B. The current I5 (=(VC5−VSin)/Rc) can flow through the P-type transistor of the current copier current source in the even frame current source block 6-2. Thus, the current setting operation of the current copier current source 5E in the even frame current source block 6-2 ends.

Subsequently, the current setting operation is carried out from the current copier current sources 4E to 0E in the even frame current source block 6-2 in according with the timing charts of FIGS. 14A to 14L in the odd frame period. Thus, voltages is held by the capacitances CE5 to CE0 for the gates of the P-type transistors PTE5 to PTE0 in the current copier current sources 5E to 0E of the even frame current source block 6-2, such that the currents I4 (=(VC4−VSin)/Rc), I3 (=(VC2−VSin)/Rc), I2 (=(VC2−VSin)/Rc), I1 (=(VC1−VSin)/Rc), I0 (=(VC0−VSin)/Rc) which flow through the P-type transistors PTE4 to PTE0. Thus, the current setting operation ends.

Here, like the first embodiment, an attention should be paid to the timing of the switch control. In the fourth embodiment, it is needed that the switches SWi and SEi_M2 are turned off at the same time as or layer than the switch SEi_M1. This is true in the even frame period, too. The timing charts shown in FIGS. 14*a* to 14L are an example and the switches SEi_M1 and SEi_M2 are turned off at a time and then switch SWi is turned off.

In the next even frame period, the drains of the P-type transistors PTE5 to PTE0 of 5E in the current copier current sources 5E to 0E of the even frame current source block 6-2 are connected with the outputs Io5 to Io0 of the current source circuit by the switches SE of the current copier current sources 5E to 0E in response to the control signal SE. Thus, the current I5 to I0 are outputted. On the other hand, in the even frame period, the odd frame current source block 6-1 carries out t period, the current setting operation like the operation carried out by the even frame current source block 6-2 in the odd frame period. The above-mentioned operations are repeats a set of the odd and even frames and the current source circuit can always output the current I5 to I0.

The fourth embodiment has an advantage that the current with a higher current ratio precision can be outputted without undergoing influence by the offset voltage of the operation amplifier OP in the V-I conversion section 4C. In addition, the fourth embodiment has an advantage that the offset voltage setting operation can be reduced, by carrying out the offset voltage setting operation by only the operation amplifier OP. On the other hand, in the third embodiment, the offset voltage setting operation is carried out by a circuit of the operation amplifier, the current copier current source and the current setting resistance.

Fifth Embodiment

Figure 20:
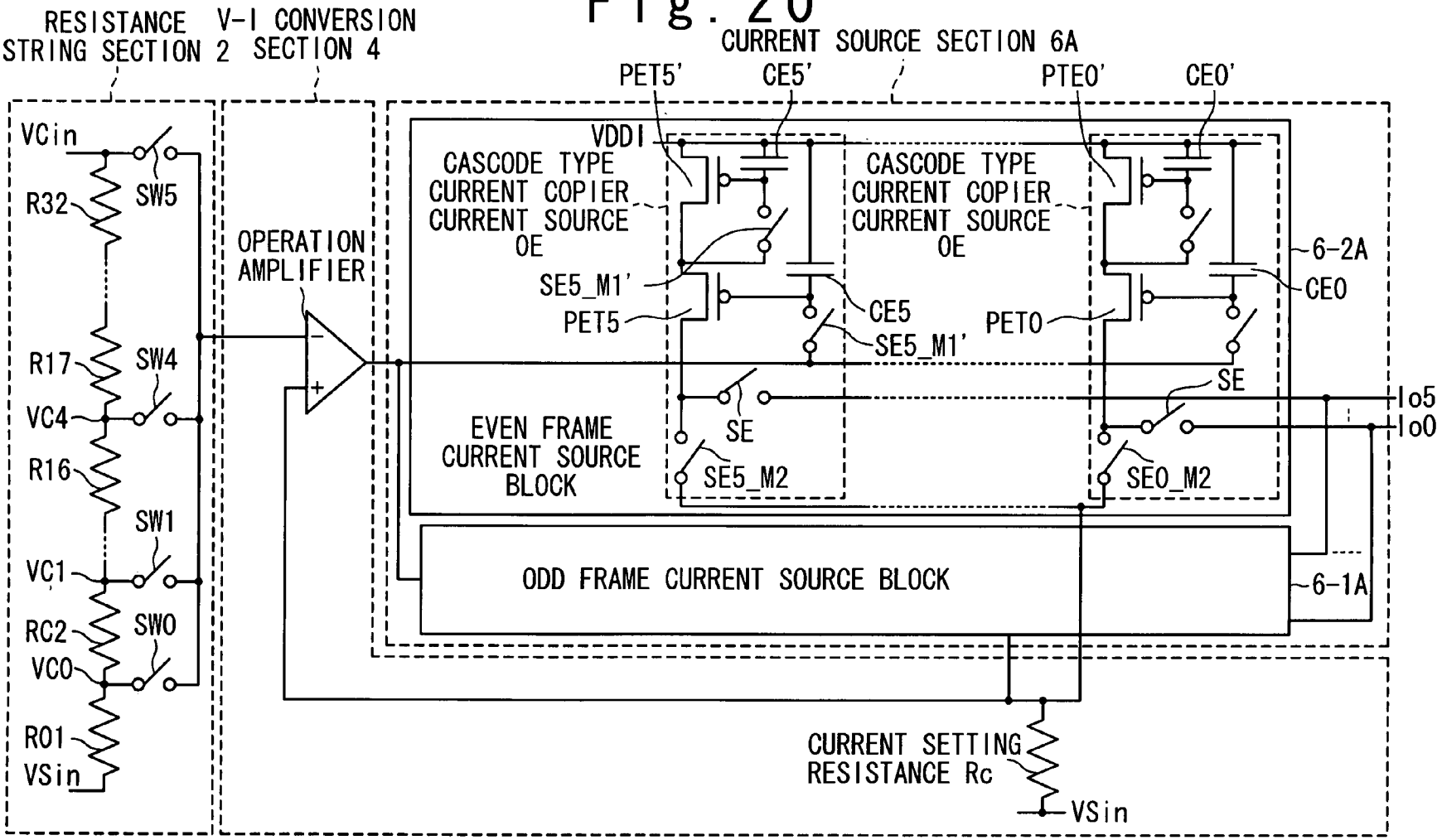
FIG. 20 is a diagram showing the circuit structure of the reference current source circuit according to a fifth embodiment of the present invention.

In the current source circuit in the fifth embodiment is adopted the current copier current source with a higher current ratio precision regardless of the characteristics of the power supply voltage and the current load, compared with the first embodiment. The current source circuit in the fifth embodiment is shown in FIG. 20. Referring to FIG. 20, in a cascode type current copier current source 5E in the even frame current source block 6-2A of the current source section 6A, a current copier circuit is inserted between the source of the P-type transistor PTE5 and the voltage VDDI in the first embodiment. That is, a P-type transistor PTE5' is connected between the voltage VDDI and the source of a P-type transistor PTE5. A capacitance CE5' is connected between the voltage VDDI and the gate of the P-type transistor PTE5'. A switch SE5_M1' is connected between the other end of the capacitance CE5 and the drain of the P-type transistor PTE5', as shown in FIG. 20. By this structure, like a cascode circuit of a current mirror, the current source circuit can output predetermined currents regardless of the power supply voltage change and the current load characteristic change.

Figure 21A:
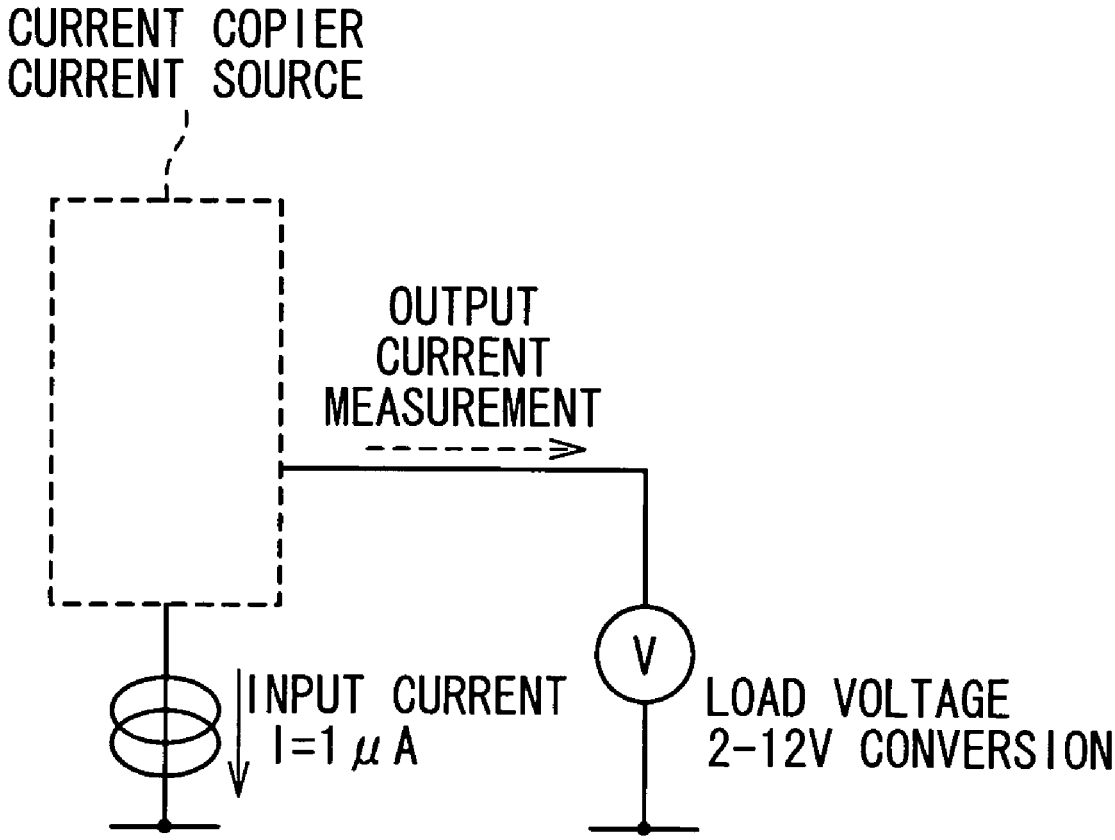
FIGS. 21A is a diagram showing a simulation circuit for the characteristic confirmation in a cascode-type current copier current source used for the fifth embodiment.
Figure 21B:
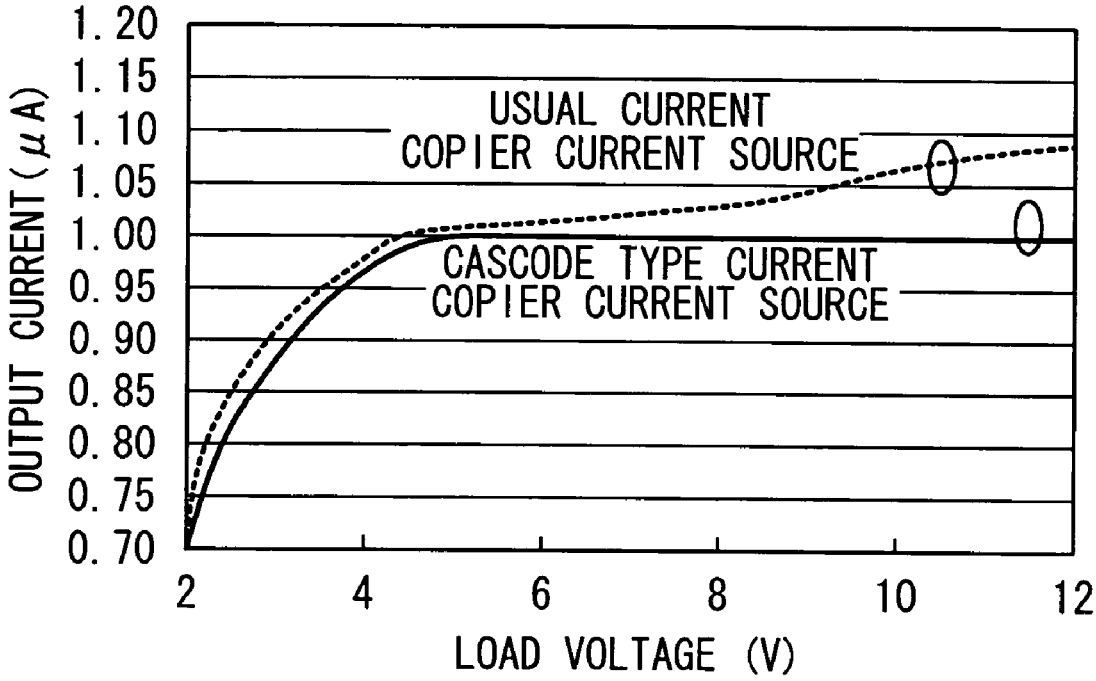
FIG. 21B is a graph showing relation between a load voltage and a current.

The output currents are examined through circuit simulation about the cascode-type current copier current source in the fifth embodiment and the current copier current source of the first embodiment. That is, a circuit simulation is carried out to examine the change of the output current due to the change of the current load voltage when the current is outputted after an input current is set to 1 μA. FIG. 21A shows a simulation block and FIG. 21B shows the simulation result when the current load voltage is changed from 2 V to 12 V. As the show in FIG. 21B, it could be seen as a result of the simulation that current load voltage dependence is very small, compared with a usual current copier current source. Therefore, by adopting the cascode-type current copier current source, the current source circuit in the fourth embodiment does not depend on the power supply voltage and current load and can output currents in a higher precision.

Also, if the idea of the fifth embodiment is applied to any of the second to fourth embodiments, it is possible to output current in a further higher precision.

The circuit structure of such a cascode-type current copier can be applied to a more general current source, e.g., a pixel circuit of the organic EL display apparatus, in addition to the reference current source circuit.

Figure 22:
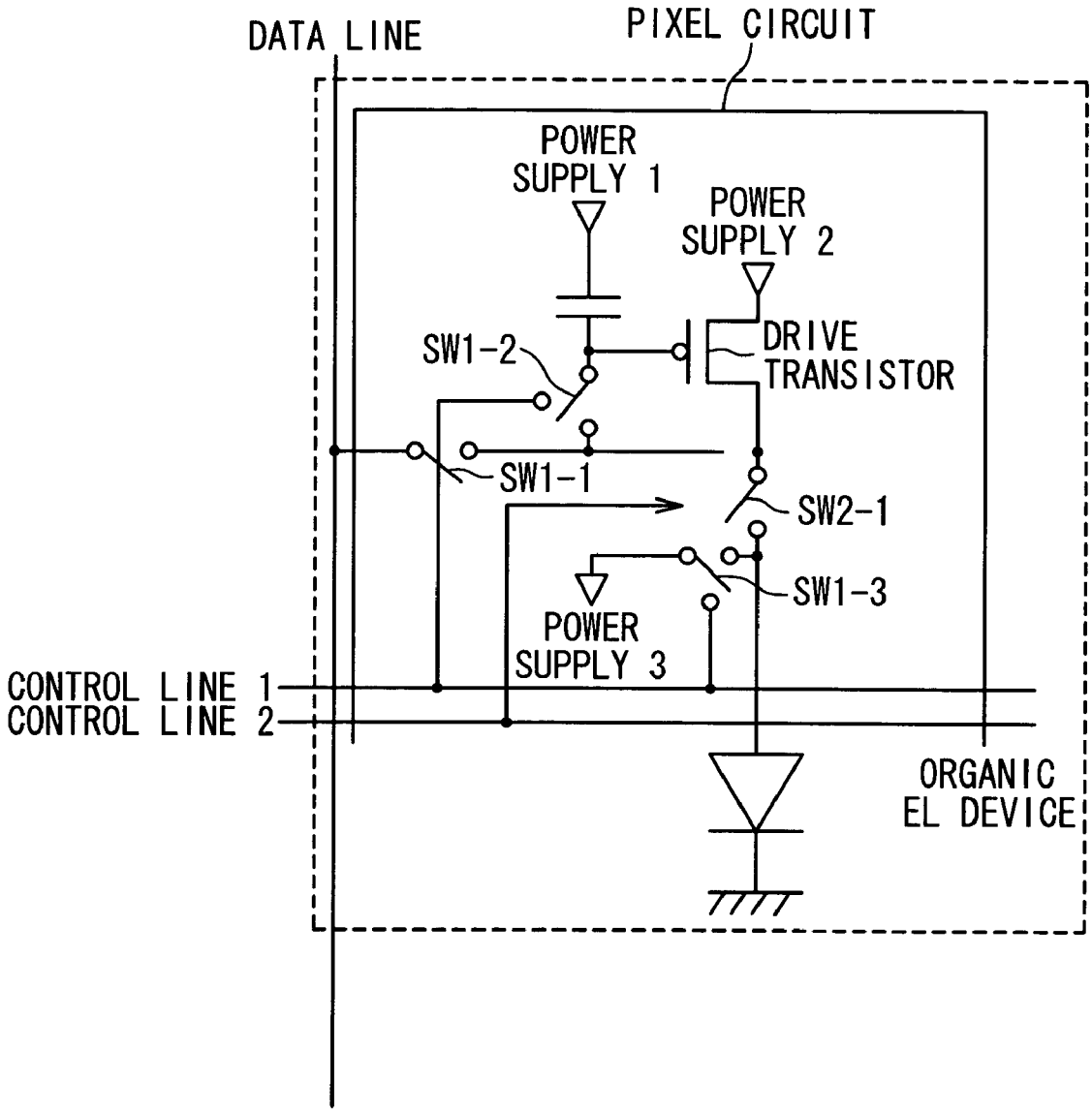
FIG. 22 is a diagram showing an example of a current copier pixel circuit.
Figure 23:
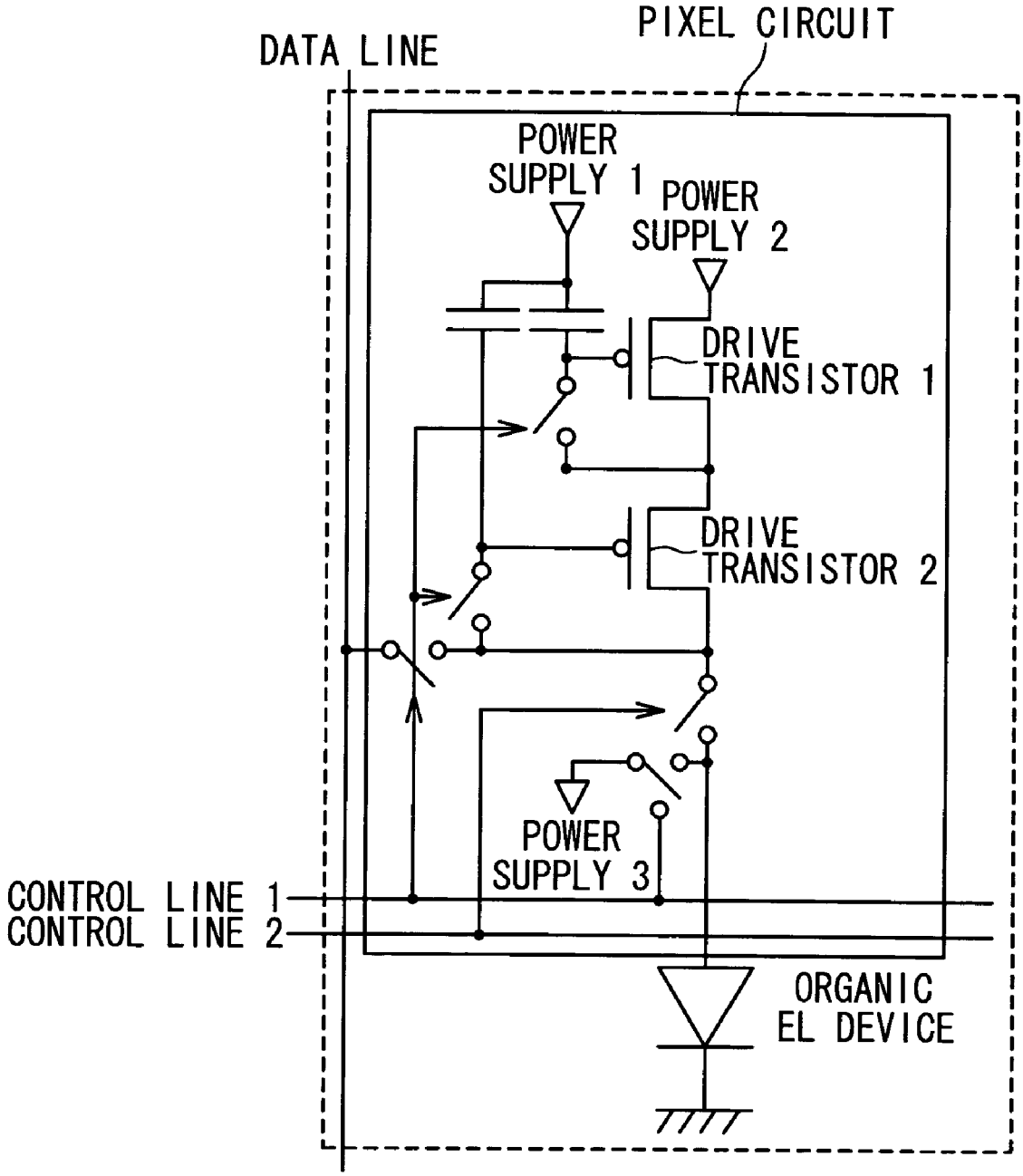
FIG. 23 is a diagram showing a pixel circuit using the cascode-type current copier of the present invention.

The pixel circuit using the current copier is shown in FIG. 22, and the pixel circuit using the cascode-type current copier is shown in FIG. 23.

The pixel circuit of FIG. 22 operates as follows. That is, in the first operation state, when switches SW1-1 to SW1-3 are tuned on in response to a control signal 1 and a switch SW2-1 is turned off in response to a control signal 2, the drain of a drive transistor and the gate thereof are short-circuited so that a current supplied via a data line flows into the drive transistor. As a result, a voltage equivalent to the flowing current is applied to the gate of drive transistor.

In the second operation state, when the switches SW1-1 to SW1-3 are turned off in response to the control signal 1, and the switch SW2-1 turned on in response to the control signal 2, the gate voltage of the drive transistor which is set in the first operation state is held by a capacitance. Thus, a current with the same value as the current flowing in the first operation state is supplied to the organic EL device from the drive transistor.

Through such an operation, the circuit can supply to the organic EL device in a high precision, the current with the same value as the current which flows in the first operation state, regardless of the current characteristic of the drive transistor.

In the pixel circuit using the cascode-type current copier of FIG. 23, a similar operation to the pixel circuit of FIG. 22 is carried out. Thus, in addition to the advantage of the circuit of FIG. 22, current can be supplied in a high precision even if the voltage-current characteristic of the organic EL device changes.

Sixth Embodiment

Figure 24:
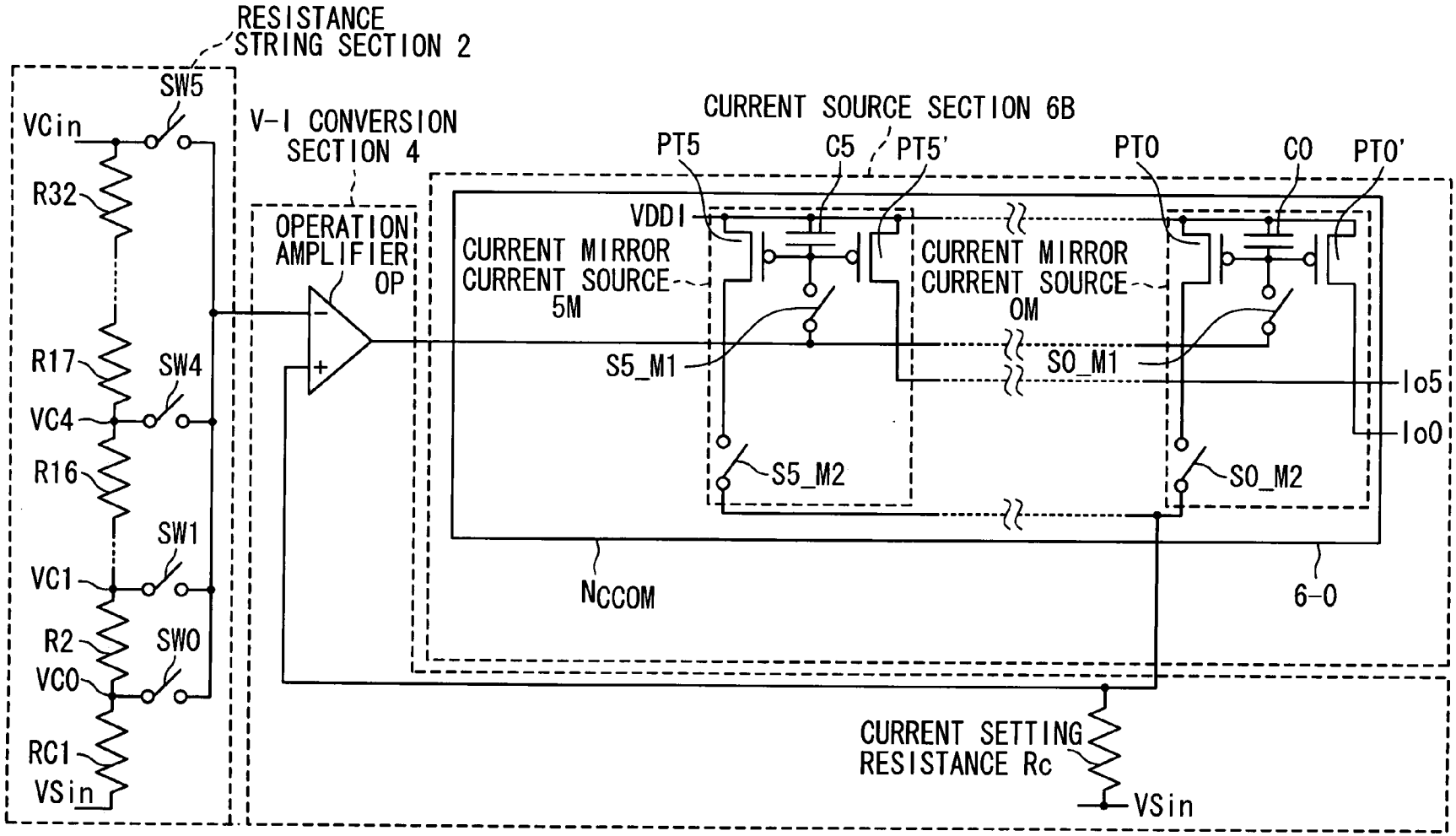
FIG. 24 is a diagram showing the circuit structure of the reference current source circuit according to a sixth embodiment of the present invention.
Figures 25A, 25B, 25C, 25D, 25E:
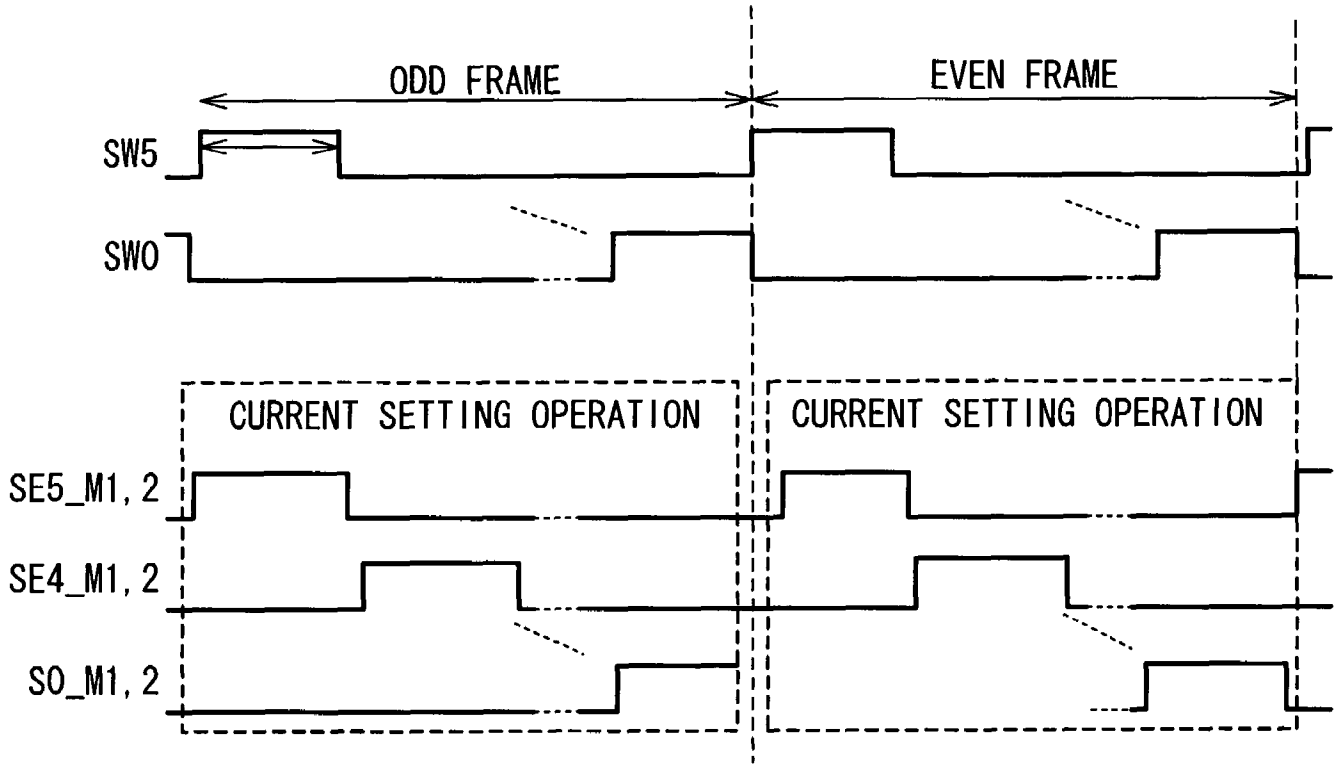
FIGS. 25A to 25E are timing charts showing the operation of the reference current source circuit in the sixth embodiment.
Figure 26:
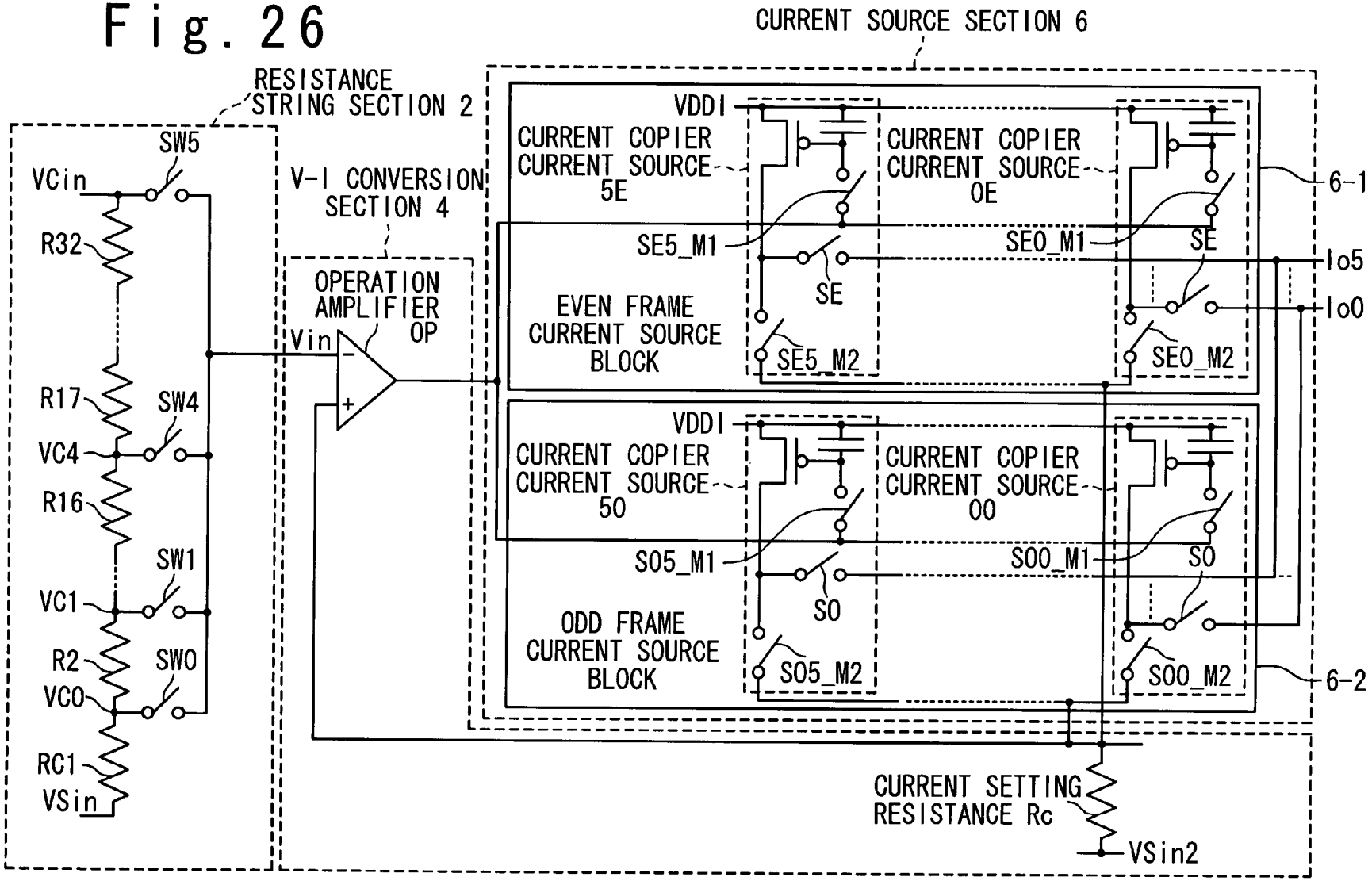
FIG. 26 is a diagram showing the circuit structure of the reference current source circuit according to a seventh embodiment of the present invention.

In the current source circuit in the sixth embodiment, current mirror current sources 5M to OM are adopted instead of the current copier current sources in the first embodiment, as shown in FIG. 24. The sixth embodiment can be used when the transistors are formed in a neighbor area so that a characteristic deviation between the transistors is small.

In the sixth embodiment, since the current mirror current sources 5M to OM are used, it is not necessary to use the two current source blocks, i.e., the odd frame current source block 6-1 and the even frame current source block 6-2. Therefore, a single current source block 6-0 is only required so that the circuit scale can be made smaller than the first embodiment, and the operation can be simplified than the first embodiment. FIGS. 25A to 25E shows the timing charts in the sixth embodiment.

In the sixth embodiment, six current mirror current sources 5M to 0M are provided. In each current mirror current source, a P-type transistor PTi and a P-type transistor PTi' constitute a current mirror. A capacitance Ci is connected between the voltage VDDI and the gates of the transistors PTi and PTi'. A switch Si_M1 is connected between the gates of the transistors PTi and PTi' and the output of the operation amplifier OP. A switch Si_M2 is connected between the drain of the transistor PTi and the node $N_{CCOM}$ which is connected with one end of the current setting resistance Rc. The drain of the transistor PTi' is connected with the output Ioi. The switches SW5 to SW0, Si_M1 and Si_M2 are controlled as shown in FIGS. 25A to 25E.

In the sixth embodiment, like the first embodiment, a current is set to the current mirror current source based on the voltage ratio which is determined based on the resistance ratio in the resistance string section 2 and the resistance value of the current setting resistance Rc common to all the current mirror current sources 5M to 0M. Therefore, it is possible to determine the current ratio in a high precision without depending on the absolute value of each resistance. Also, it is possible to simply adjust the current value while keeping the current ratio, by adjusting the voltage VCin applied to the resistance string. Therefore, even if the resistance value of the current setting resistance Rc is different from a design value, it is possible to simply adjust the current so as to output the current with a designed value by adjusting the voltage VCin

Seventh Embodiment

In the current source circuit of the first embodiment, the same voltage VSin is applied to the one end of the resistance string section 2 and the one end of the current setting resistance Rc. However, in the seventh embodiment, different voltages VSin1 and Vsin2 are applied to the one end of the resistance string section 2, and the one end of the current setting resistance Rc. The other structure and the operation are coincident with those of the first embodiment. In the seventh embodiment, by separating the voltage VSin into a voltage VSin1 and a voltage VSin2 and adjusting the value of the voltage VSin2, it is possible to accurately equalize the applied voltage applied to the one end of the resistance string section 2 and the voltage applied to the one end of the current setting resistance Rc. Therefore, the current source circuit can be simply arranged.

Moreover, in the seventh embodiment, when the operation amplifier OP of the V-I conversion section 4 has an offset voltage, it is possible to absorb the error due to the offset voltage by changing the voltage VSin2. Oppositely, it is possible to add a offset component to the current output, by changing the voltage VSin2 in such a manner that the voltage applied to the one end of the resistance string section 2 and the voltage applied to the one end of the current setting resistance Rc are made different in the current setting state.

Eighth Embodiment

Figure 27:
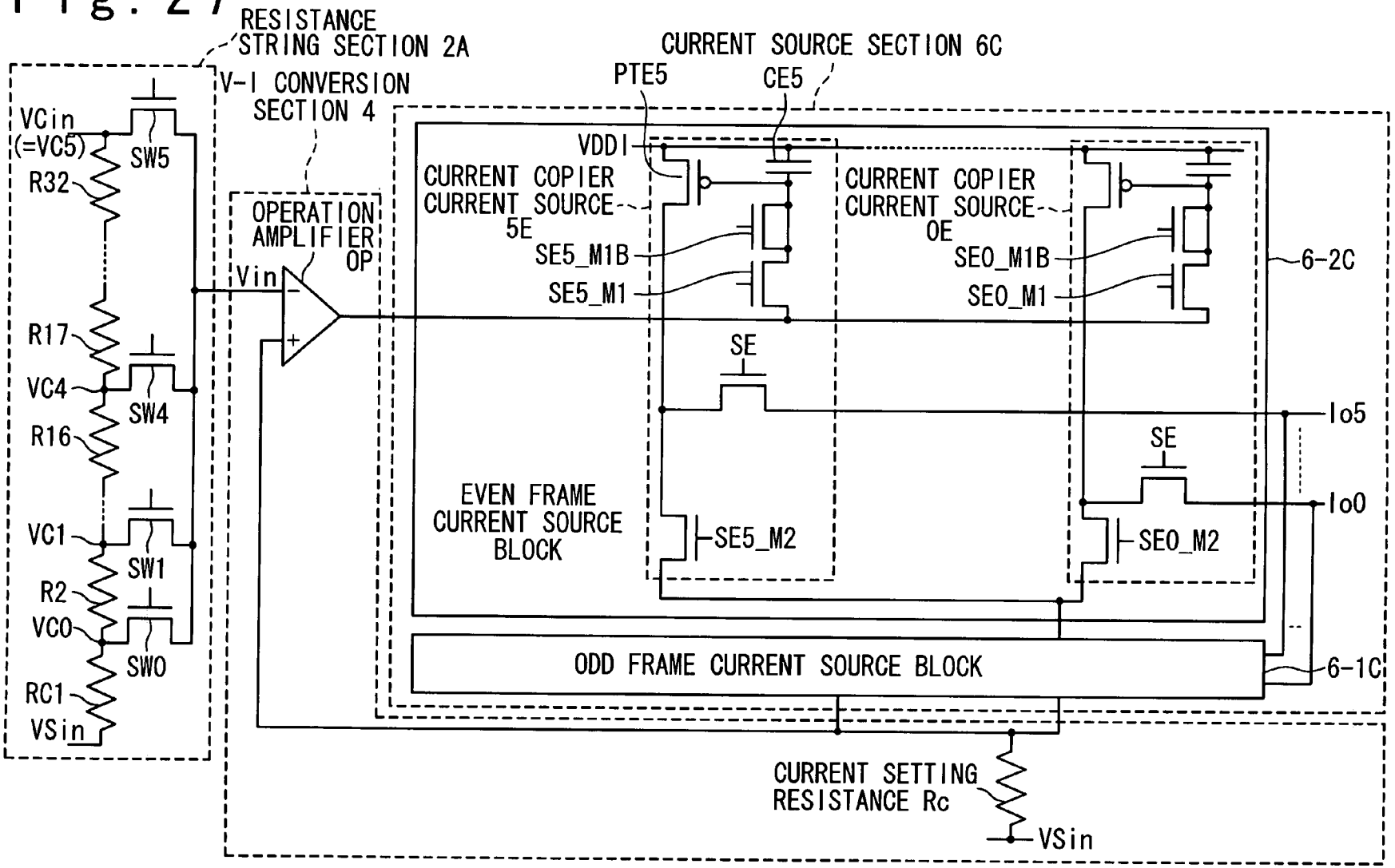
FIG. 27 is a diagram showing the circuit structure of the reference current source circuit according to an eighth embodiment of the present invention.

FIG. 27 is a circuit diagram showing the current source circuit according to the eighth embodiment of the present invention. Referring to FIG. 27, in the eighth embodiment, all the switches of the current source circuit in the first embodiment are replaced with N-type transistors. Moreover, dummy transistors are added to cancel switching noise by movement of charge which always appears when a transistor is used as the switch. Because the N-type transistor is used, the timings of the operation are the same as the timing charts in the first embodiment shown in FIGS. 11A to 11J. The operation other than the dummy transistors is the same as that of the first embodiment.

The dummy transistor SEi_M1B is connected between the capacitance CEi and the switch transistor SEi_M1 for disconnecting the capacitance from another wiring line in the current copier current source. The inversion signal SEi_M1B of the control signal SEi_M1 is applied to the gate of the transistor SEi_M1B and the source and the drain are short-circuited. Moreover, a product of the width W and the length L in the dummy transistor is ½ of a product of the width W and the length L in the switch transistor Sei_M1. Thus, when the switch transistor Sei_M1 is switched from an ON state to an OFF state, switching noise due to charge transferring from the transistor Sei_M1 to the capacitance CEi can be eliminated by the dummy transistor. Therefore, the eighth embodiment can output current in higher precision than in the first embodiment.

The idea of the eighth embodiment can be applied not only to the first embodiment, but also any of the second to sixth embodiments in the same way and the same effect can be achieved.

Also, in the eighth embodiment, the N-type transistor is used as the switch but a P-type transistor may be used. In this case, the control signal should be inverted.

In addition to the above description, it is not always necessary that the voltage applied to the source of the P-type transistor PTEi or PTi is equal to the voltage applied to one end of the capacitance CEi or Ci in the current copier current source or current mirror current source of the current source circuit according to the first to eighth embodiments.

Ninth Embodiment

It is sufficient to provide a single reference current source circuit if a display section is driven by a single current driver or the display section and the current driver are mounted on a same glass substrate as in LTPS. Therefore, the reference current source circuit according to any of the first to eighth embodiments can output reference currents with suitable values by adjusting the voltage VCin, even when all the components of the current source circuit are formed in the current driver IC and formed on the glass substrate.

Figure 28:
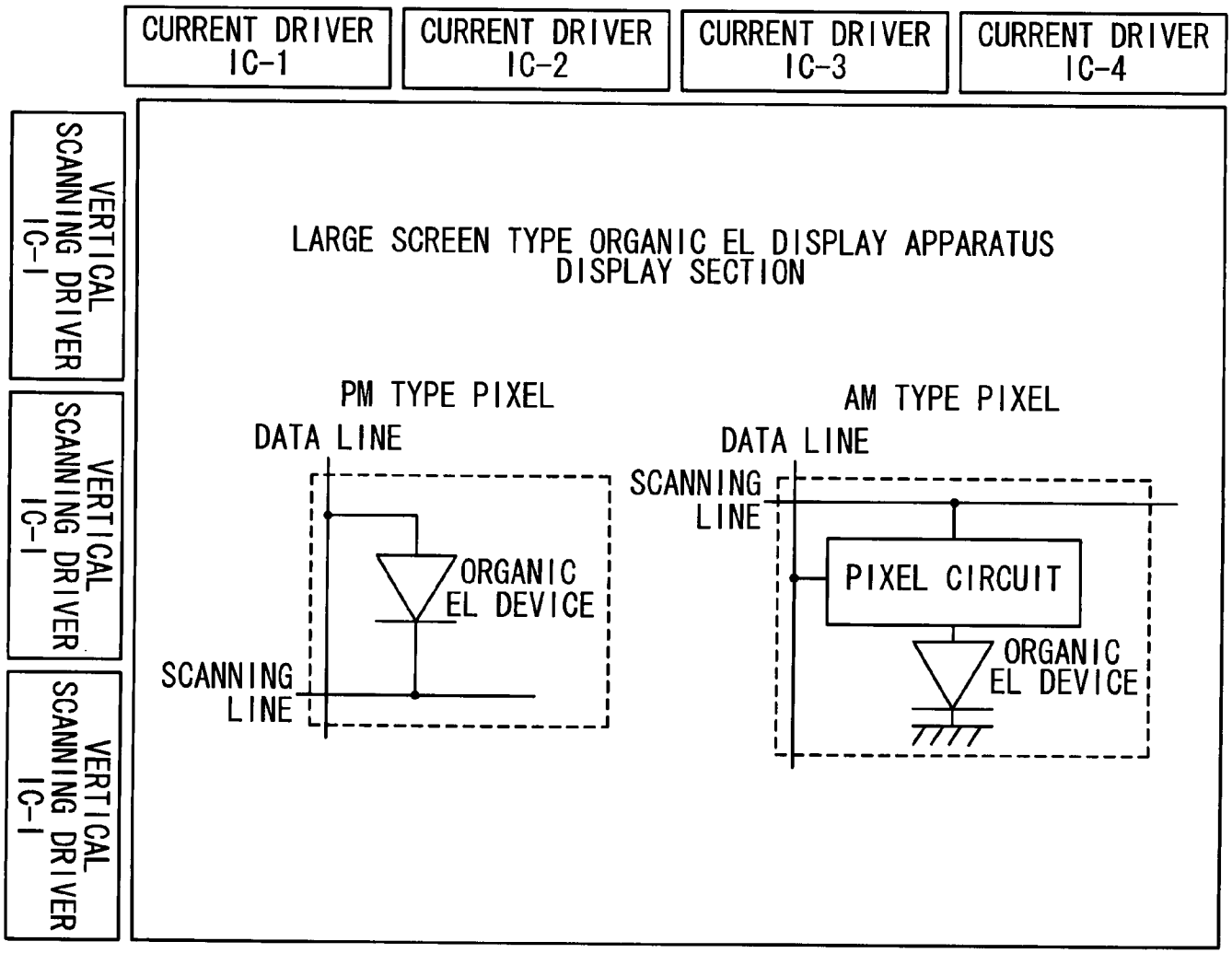
FIG. 28 is a block diagram of a large-sized organic EL display apparatus which uses a plurality of current driver ICs.
Figure 29:
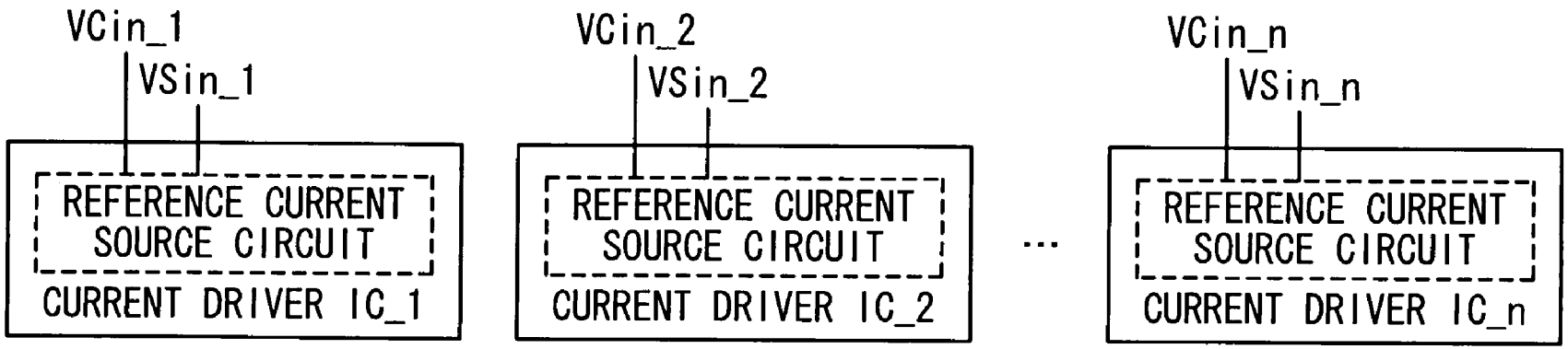
FIG. 29 is a diagram showing the arrangement of the plurality of current driver ICs of the reference current source circuit in a ninth embodiment of the present invention.

On the other hand, as shown in FIG. 28, there would be case that a display section of a large screen type display apparatus is driven by a plurality of current driver ICs and all the components of the reference current source circuit of the present invention are mounted into each current driver IC. In this case, when the values of the current setting resistance Rc are different from each other for each current driver IC due to manufacture process deviation, the output currents from the reference currents differs for each driver IC even if the voltage VCin which is common to all the current driver ICs is adjusted. As a result, there is a possibility that color difference occurs in the display for every driver IC. The simplest method of solving such a problem is to provide the voltages Vcin and VSin for every driver IC, as shown in FIG. 29. By adjusting the voltages VSin_1 to VSin_n and the voltages VCin_1 to VCin_n, the reference currents of the respective driver ICs can be arranged.

Here, as the reference current source circuit in the ninth embodiment, the current source circuit according to either of the first to eighth embodiments from the first embodiment can be used. It should be noted that in the current source circuit of the seventh embodiment, the three voltages applied to each IC such as VCin, VSin1, and VSin2 are necessary.

Tenth Embodiment

Figure 30:
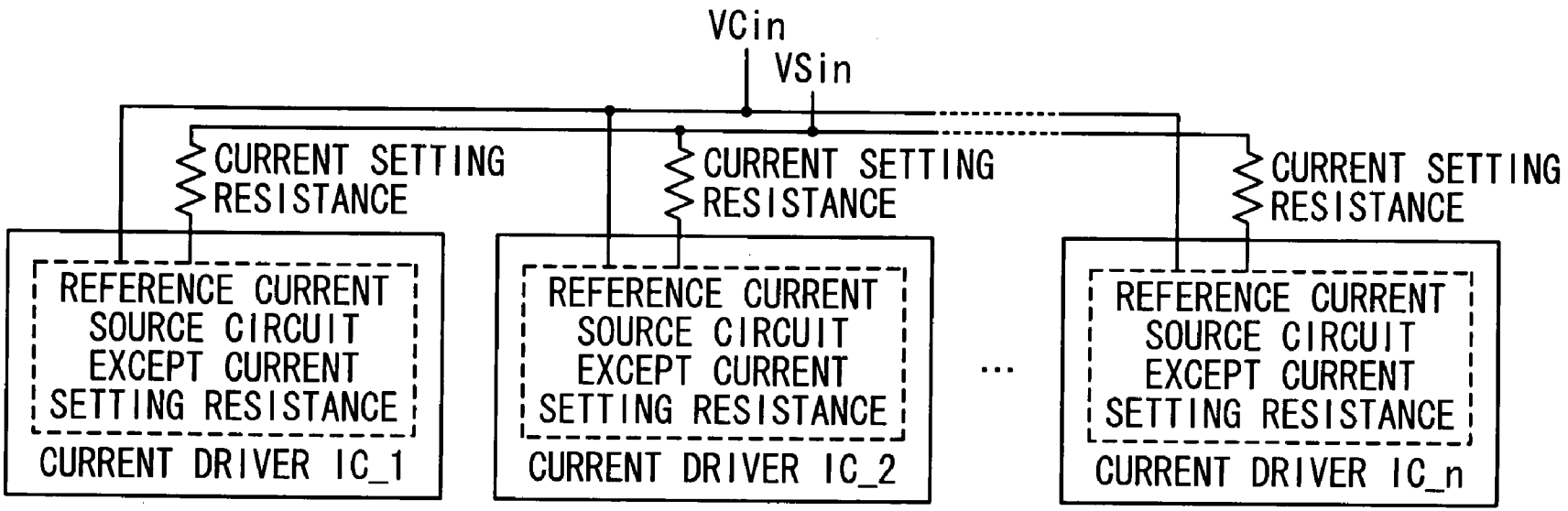
FIG. 30 is a diagram showing the arrangement of the plurality of current driver ICs of the reference current source circuit in a tenth embodiment of the present invention.

In the tenth embodiment, unlike ninth embodiment, the current setting resistance Rc in the reference current source circuit is provided outside the driver IC, as shown in FIG. 30. It should be noted that the reference current source circuit in the tenth embodiment has the same circuit structure as either of the first to eighth embodiments.

In the tenth embodiment, the current setting resistance Rc can be set in a higher precision, since the current setting resistance Rc is provided outside the driver IC. In this case, it is not necessary to provide the voltage independently for every driver IC. Unlike the current setting resistance, the resistance string section of resistances can be formed into the current driver IC by making each resistance large to an extent that a wiring line resistance can be ignored, because only the resistance ratio is a problem.

Eleventh Embodiment

Figure 31:
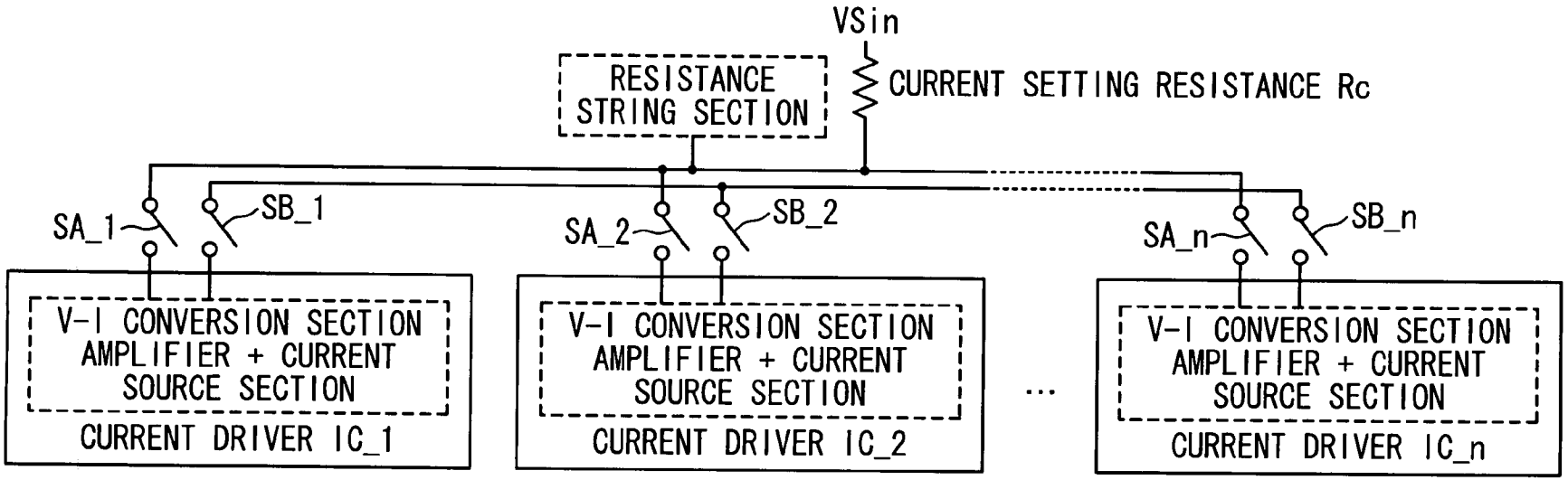
FIG. 31 is a diagram showing the arrangement of the plurality of current driver ICs of the reference current source circuit in an eleventh embodiment of the present invention.

As shown in FIG. 31, in the eleventh embodiment, of the components of the reference current source circuit according to any of the first to eighth embodiments, the resistance string section and the current setting resistance are provided outside the current driver IC. One set of the resistance string sections and the current setting resistance is provided commonly for all the current driver ICs and connected to the for all the current driver ICs via switches SA_1 to SA_n and SB_1 to SB_n which are respectively operated in response to signals SA_1 to SA_n and SB_1 to SB_n. However, these switches may be provided in each current driver IC.

In the current setting operation in the eleventh embodiment, the current setting operation is carried out to each current source of the current source section in the current driver IC IC_1, and then the current setting operation is carried out to each current source of the current source section in the current driver IC IC_2. Thus, the current setting operation is carried out to each current source of the current source section in all the current driver ICs IC_n during a predetermined period, e.g., during one frame in order. The current setting operation is the same as the operations of the first to eighth embodiments. Therefore, it is possible to set current values to the plurality of current driver ICs without decreasing the precision of the output current.

Figure 32:
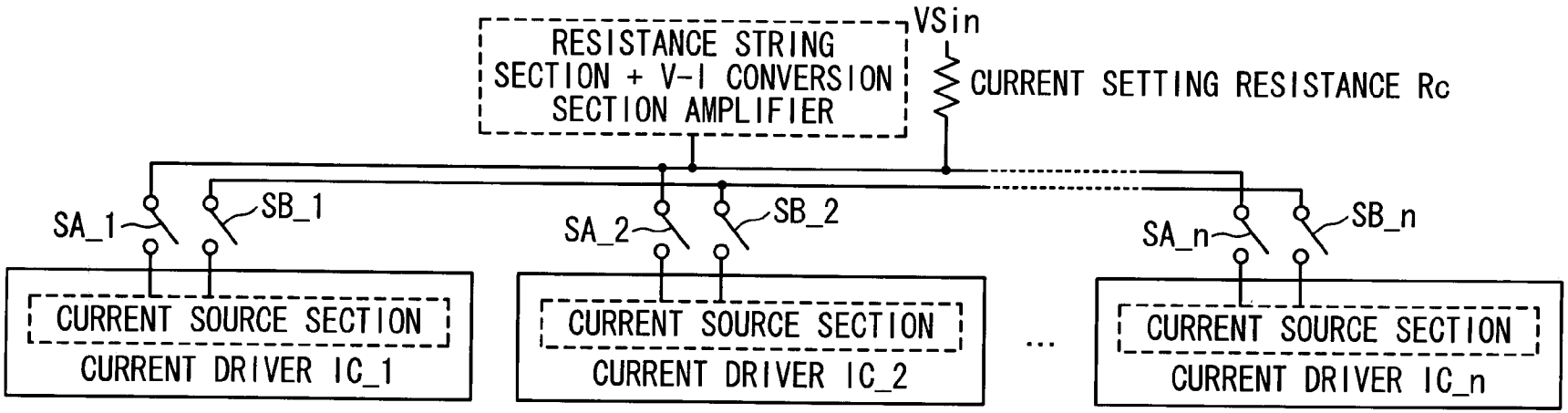
FIG. 32 is a diagram showing a modification of the arrangement of the plurality of current driver ICs of the reference current source circuit in the eleventh embodiment.

In the eleventh embodiment, the circuit scale can be made small, compared with the ninth and tenth embodiments, because the resistance string section and the current setting resistance can be made common. Moreover, as shown in FIG. 32, the circuit structure is possible in which the resistance string section and the V-I conversion section are provided outside the current driver ICs and used in common to all the current driver ICs.

Twelfth Embodiment

Figure 33:
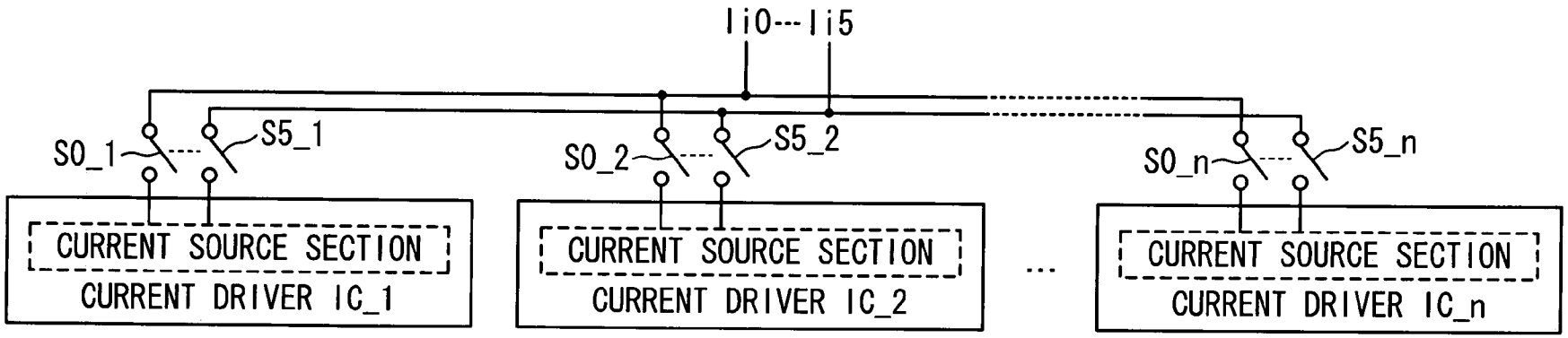
FIG. 33 is a diagram showing the arrangement of the plurality of current driver ICs of the reference current source circuit in a twelfth embodiment of the present invention.
Figure 34:
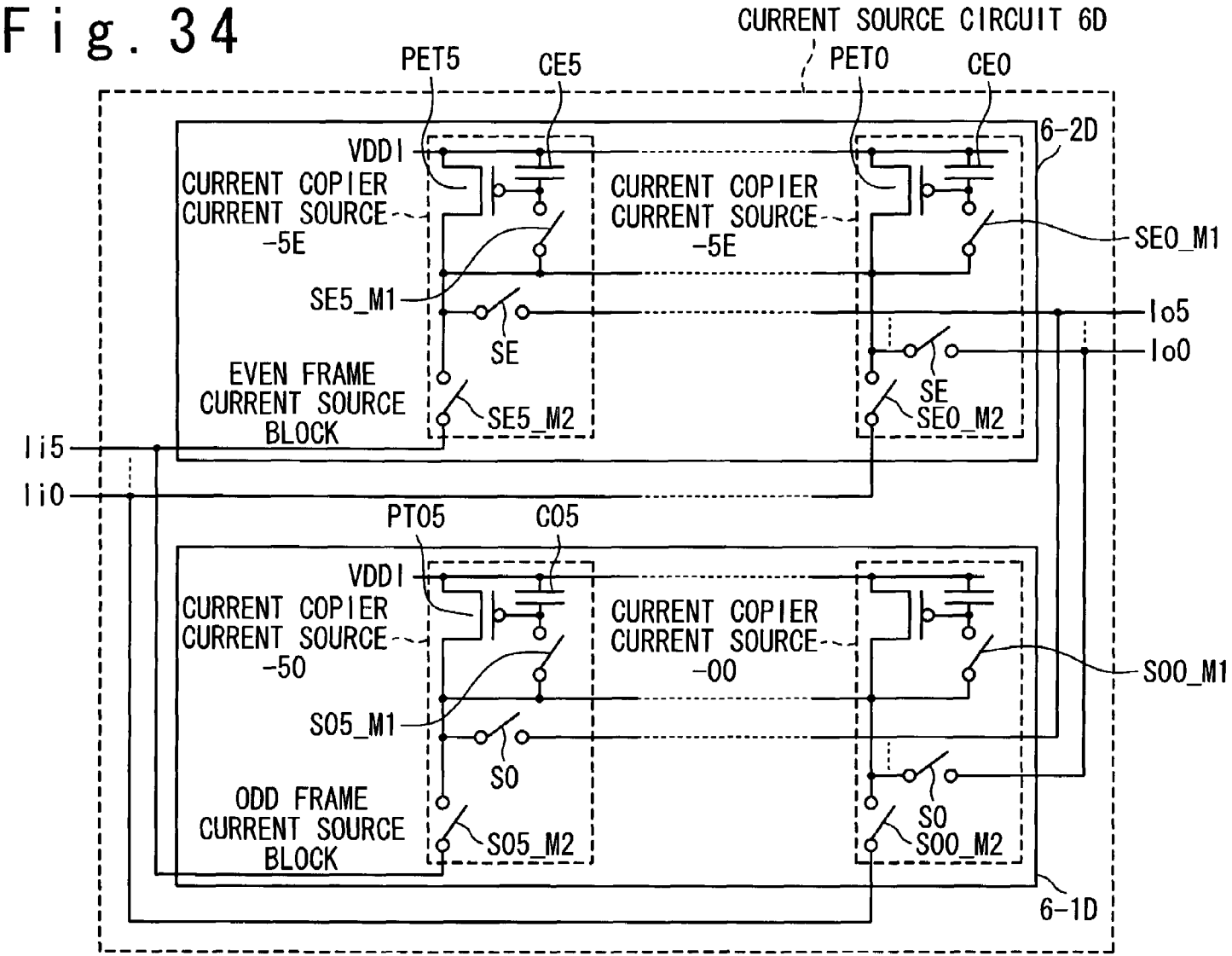
FIG. 34 is a diagram showing the circuit structure of the current source section in the twelfth embodiment.

FIG. 34 shows the circuit structure in the twelfth embodiment. As shown in FIG. 33, in the twelfth embodiment, only the current source section is left in each current driver IC. The current source section of each driver IC is connected with wiring lines for supplying reference current Ii5 to Ii0 via switches S0_1 to S0_n, S1_1 to S1_n, S2_1 to S2_n, S3_1 to S3_n, S4_1 to S4_n and S5_1 to S5_n. These switches may be provided in each current driver ICs.

In the twelfth embodiment, the currents are directly supplied to the current source section. Therefore, the current source section according to any of the first to eighth embodiments must be changed. The change to the current source section is shown in FIG. 34.

In the current source section shown in FIG. 34, the switch SEi_M1 of the current copier current source iE in the even frame current source block 6-2D is provided between the gate and drain of the P-type transistor PTEi. The switch SEi_M2 is provided between the drain of the P-type transistor PTEi and the input Iii of the current source section 6D. Similarly, the switch SOi_M1 of the current copier current source iO in the odd frame current source block 6-1D is provided between the gate and drain of the P-type transistor PTOi and the switch SOi_M2 is provided between the drain of the P-type transistor PTOi and the input Iii of the current source section 6D. Through the change in the arrangement, in the current source section 6D, the current setting operation is carried out such that a voltage corresponding to the current from the input Iii is set to the gate of the P-type transistor PTEi or PTOi. In the current outputting operation, the substantially same current as the inputted current can be outputted in accordance with the set voltage. Also, it is possible that the same change is applied to the current source section of the second to eighth embodiments.

In the current setting operation of the twelfth embodiment, during a predetermined period of one frame, all the switches Si_1 are turned on and all the switches Si_2 to Si_5 are turned off. The current setting operation is carried out at the same time to the six current copier current sources 5E to 0E of the even frame current source block 6-2D in the current driver IC IC_1. Then, during a next predetermined period of one frame, all the switches Si_2 are turned on and all the switches Si_1 and Si_3 to Si_5 are turned off. The current setting operation is carried out at the same time to the six current copier current sources 5E to 0E of the even frame current source block 6-2D in the current driver IC IC_2. This current setting operation is repeated to the current driver IC IC_n. In this frame, the odd frame current source block 6-1 is supplying the reference currents to the current driver IC. In the next frame, the odd frame current source block 6-1 in each current driver IC carries out the current setting operation and the even frame current source block 6-2 outputs the reference currents.

The current setting operation in the twelfth embodiment is the same as those of the current source sections in the first to eighth embodiments. Therefore, it is possible to set the current to the plurality of current driver Ics without decrease of precision of the output currents. Also, in the twelfth embodiment, each current driver IC is composed of only the current source section, and the circuit scale can be made small, compared with the ninth to eleventh embodiments.

Thirteenth Embodiment

Figure 35:
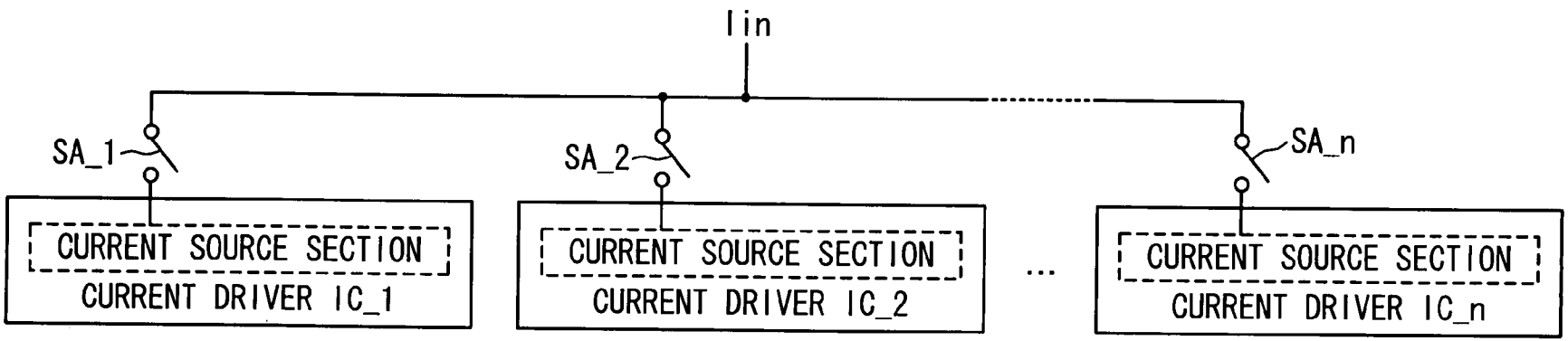
FIG. 35 is a diagram showing the arrangement of the plurality of current driver ICs of the reference current source circuit in a thirteenth embodiment of the present invention.

As shown in FIG. 35, in the thirteenth embodiment, only the current source section is provided in each current driver IC. The current source section in each driver IC and a wiring line for supplying a reference current Iin from the outside of the IC are connected through a corresponding one of switches SA_n to SA_1. The switches SA_1 to SA_n may be provided inside the current driver Ics. The current setting operation of the thirteenth embodiment is carried out, in a predetermined period, to the current source section in the current driver IC IC_1, and then the current setting operation is carried out to the current source section in the current driver IC IC_2. Thus, the current setting operation is carried out to the current source in current driver IC IC_n in order. In this case, since the current source section uses one kind of the reference currents Iin in the thirteenth embodiment, the current source section is configured as shown in FIG. 36.

Figure 36:
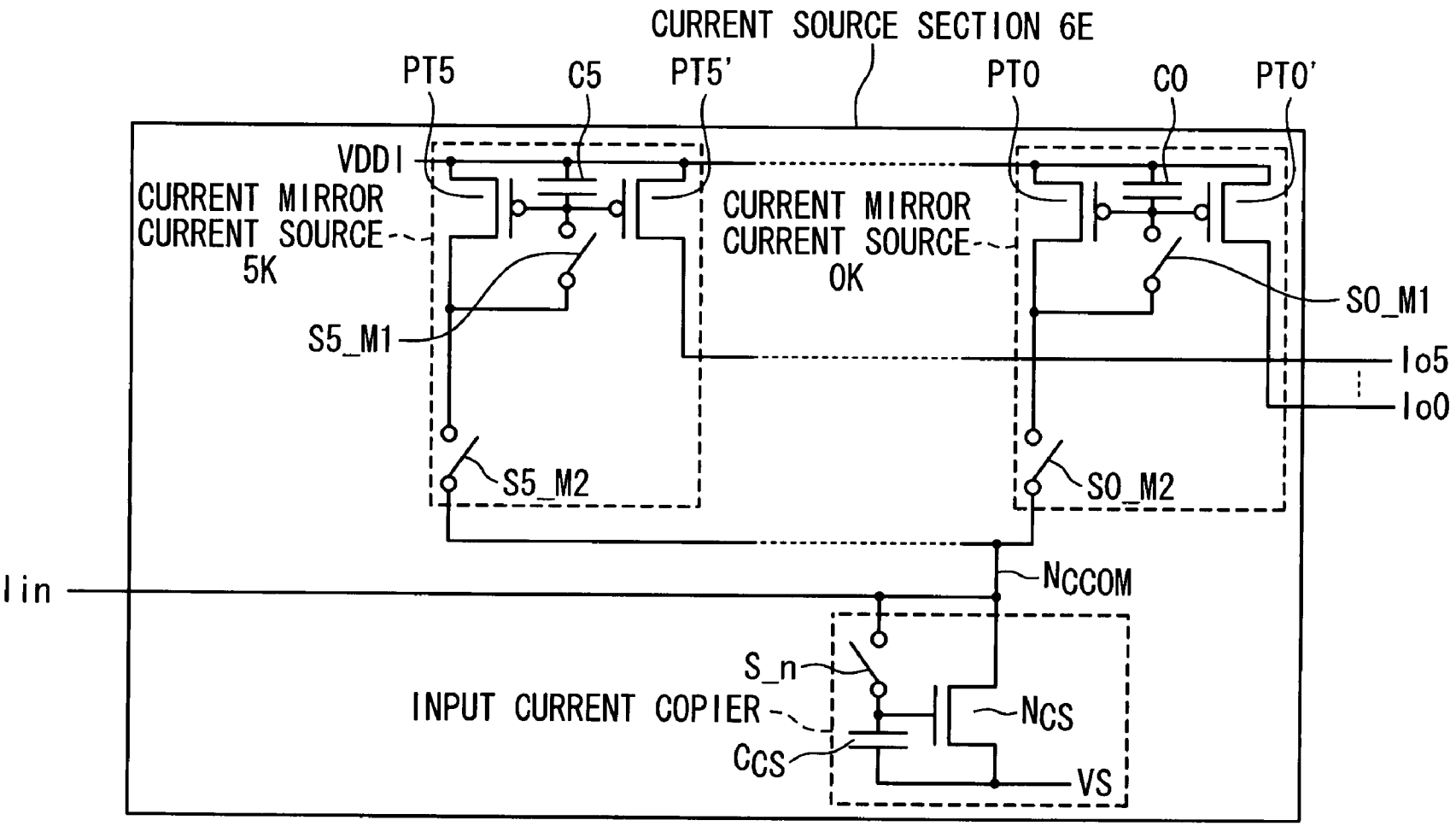
FIG. 36 is a diagram showing the circuit structure of the current source section in the thirteenth embodiment.
Figures 37A, 37B, 37C, 37D, 37E, 37F, 37G, 37H, 37I:
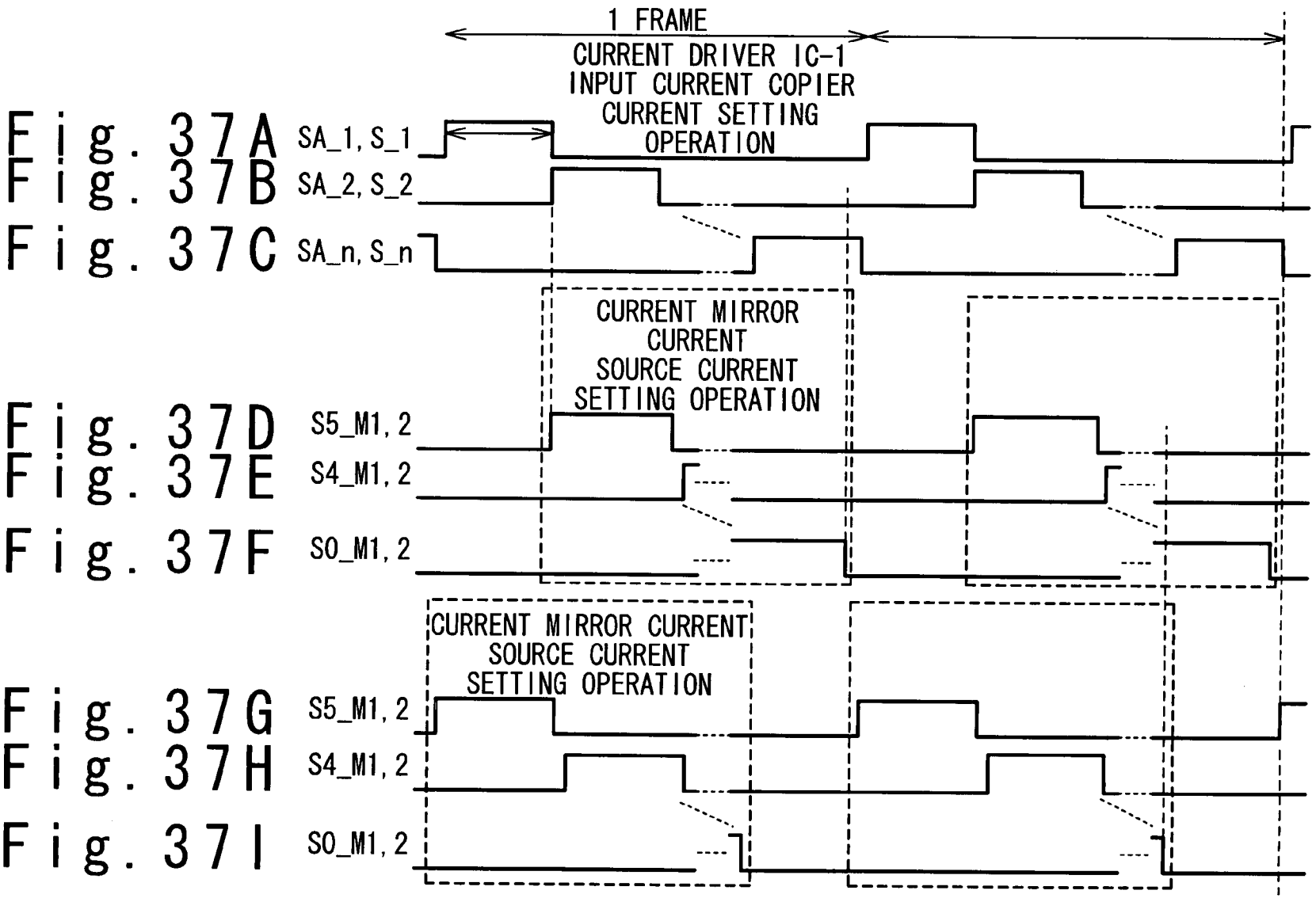
FIGS. 37*a* to 37I are timing charts showing the operation of the reference current source circuit in the thirteenth embodiment.
Figures 39A, 39B, 39C, 39D, 39E, 39F, 39G, 39H, 39I, 39J:
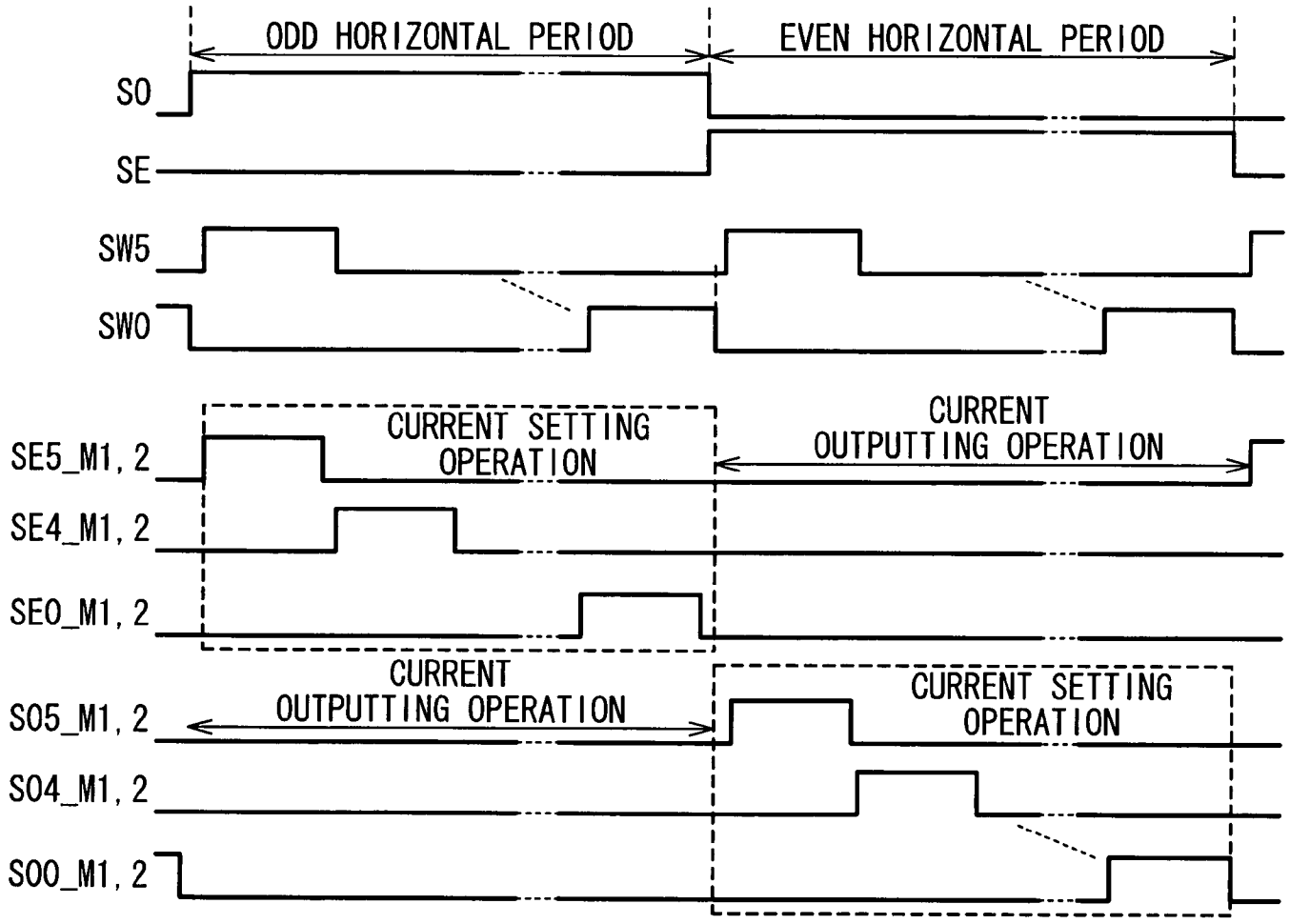
FIGS. 39*a* to 39J are timing charts showing the operation of the reference current source circuit in the fourteenth embodiment.

Referring to FIG. 36, the current source section in each current driver IC of the thirteenth embodiment is composed of six current mirror current sources 5K to 0K and an input current copier block. The current mirror current source 2-i is composed of the switch Si_M1 connected the gate and drain of a bias P-type transistor PTi and the switch Si_M2 connected the drain of the bias P-type transistor PTi and a common node $N_{SCOM}$. The switches Si_M1 and Si_M2 are controlled in response to the control signals Si_M1 and Si_M2. The current mirror current source 2-i is further composed of an output P-type transistor PTi' for the current mirror with the bias transistor PTi and the capacitor Ci connected between the voltage VDDI and the gate of the bias P-type transistor Pti. A current ratio of the bias P-type transistor PTi and the output P-type transistor Pti' is a:b. When an input current Iin is I5(=32×I0), a=32 and b=1 in the current mirror current source 0K, a=16 and b=1 in the current source 1K, a=8 and b=1 in the current source 2K, a=4 and b=1 in the current source 3K, a=2 and b=1 in the current source 4K, and a=1 and b=1 in the current source 5K. In the current source section 6E of the thirteenth embodiment, the transistors in the current mirror current source have a small deviation in characteristics.

The input current copier block is composed of an N-type transistor Ncs connected between the common node $N_{SCOM}$ and a voltage VS, a capacitance Ccs connected between the gate of the N-type transistor Ncs and the voltage VS and a switch S_n connected between the common node $N_{SCOM}$ and the gate of the N-type transistor Ncs.

An operation of the thirteenth embodiment is shown in the timing charts shown in FIGS. 37A to 37I. In the thirteenth embodiment, the input reference current Iin is supplied from the outside of the ICs to the input current copier blocks of the current driver ICs in order in accordance with control signals SA_i and S_n in a predetermined period. Thus, the gate voltage of the N-type transistor Ncs is set by the capacitance Ccs such that the reference current Iin flows through the N-type transistor Ncs. Thus, each current mirror current source iK can output the current Ioi thereafter, since the input current copier block is set to the reference current Iin. At this time, in the current mirror current source iK in the current source section 6E, because the P-type transistors PTi and PTi' have the above-mentioned current drive ability ratio, the output currents Io0 to Io5 are outputted to have a ratio of 1:2:4:8:16:32 based on the current Iin set to the N-type transistor Ncs.

Fourteenth Embodiment

In the structure of the fourteenth embodiment, the circuit structures shown in the above embodiments are changed and used for the current driver circuit to output analog currents in accordance with the digital display data. FIG. 38 shows such a circuit structure of the drive circuit used in the fourteenth embodiment. In the fourteenth embodiment, the resistance string section 2 in the first embodiment is changed into a resistance string section 2C, in which a switch selection circuit 22 is added. The switch selection circuit 22 controls of the switches SW1 to SW63 in accordance with the digital display data such that one of the voltage VC0 to VC63 is selected. Like the first embodiment, the output current is determined based on the selected voltage and the current setting resistance Rc. The current range of the output current is minimum current I0 (=0=(VSin−VSin)/Rc) to maximum current I63 (=(VC63−VSin)/Rc).

The operation of the reference current source circuit in the fourteenth embodiment is the same as that of the first embodiment except that the operation of the switches in the resistance string section 2C is determined based on the digital display data. However, in the fourteenth embodiment, a period for the current setting operation or the current outputting operation is one horizontal period, in spite of one frame in the first embodiment, as shown in FIGS. 39A to 39J.

The fourteenth embodiment has six outputs Io0 to Io5, and can drive six loads at a time. The number of outputs can be increased to the number of current copier current sources in which the current setting operation can be carried out for one horizontal period. Also, by producing the current setting resistance Rc precisely, the precision of the output current can be improved. If a plurality of current source circuits in the fourteenth embodiment are provided, it is possible to increase the number of outputs.

It should be noted that the idea of the fourteenth embodiment can be applied to each of the second to eighth embodiments.

Figure 40:
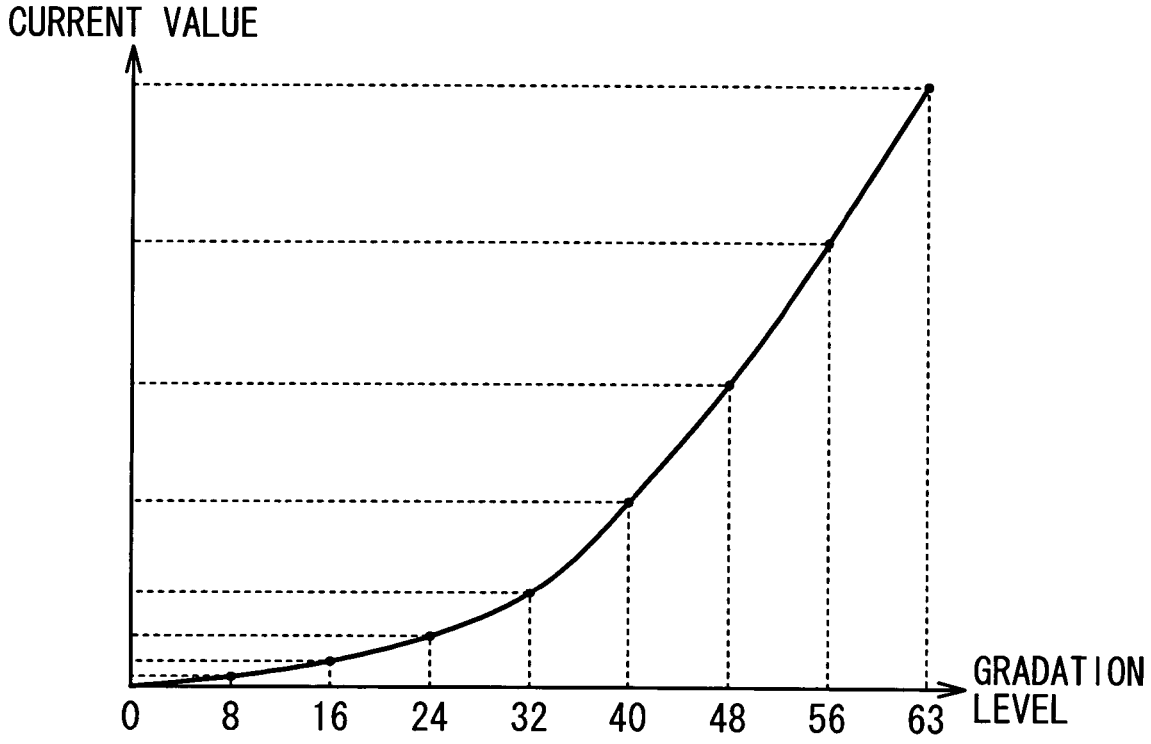
FIG. 40 is a graph showing an example in which a relation between the gradation and the current is non-linear in the fourteenth embodiment.

Also, the resistance values of R1 to R63 in the resistance string section of the fourteenth embodiment may be same, or may be set such that the output current has a function value shown in FIG. 40. In this case, it is possible to cope with shift of the current-brightness characteristic of the organic EL device from a straight line. This means a fact that it is possible to carry out a gamma correction to a display unit.

It should be noted that the number of outputs and the number of the current sources in the above embodiments are only for the description, and the present invention is not basically limited to them.

As described above, according to the present invention, even if there is a deviation in the current characteristic of the transistors, the current source circuit can output a plurality of output currents with a higher precision.

Also, according to the current source circuit of the present invention, the values of elements of the current source circuit can be changed while a ratio of the plurality of output currents is kept.

Also, according to the current source circuit of the present invention, the value of the output current can be kept even if there is a deviation in the power supply voltage and the current load characteristic.

Also, a current source circuit with a higher precision is provided for the plurality of current driver ICs.

Also, the current driver IC is provided in which the gamma correction is possible.

What is claimed is:

1. A current source circuit, comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the reference current and said output current is maintained based on sensing an amount of current output from said current source section, wherein each of said plurality of current sources comprises a transistor and a holding capacitor, and said conversion section comprises:

a current setting resistance through which passes said current output from said current source section; and an amplifier which outputs the reference current based on the voltage signal, said current setting resistance, and said transistor in each of said current sources, wherein:

said voltage output section comprises:

a plurality of resistances connected in series between a first voltage and a second voltage; and a switch set connected to said plurality of resistances to output as the voltage signal, a voltage generated by said plurality of resistances and the first and second voltages, said amplifier comprises an operation amplifier which has an inversion input connected to receive the voltage signal from said voltage output section and an non-inversion input connected to one end of said current setting resistance, the other end of said current setting resistance being connected to receive a third voltage, and said operation amplifier outputs the reference current.

2. The current source circuit according to claim 1, wherein the second voltage is same as the third voltage.

3. The current source circuit according to claim 1, wherein the second voltage is different from the third voltage.

4. A current source circuit, comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the-reference current and said output current is maintained based on sensing an amount of current output from said current source section, wherein each of said plurality of current sources comprises:

a first switch, a second switch, and a third switch;

a first transistor and a second transistor connected in series, wherein a source of said first transistor is connected to receive a known voltage, a gate of said first transistor is connected to a drain of said first transistor via said first switch, and a gate of said second transistor is connected to receive said reference current via said second switch;

a first holding capacitance which is connected between said known voltage and said gate of said first transistor; and a second holding capacitance which is connected between said known voltage and said gate of said second transistor, a drain of said second transistor is connected to a conversion common node via said third switch, and the output current is outputted from said drain of said second transistor.

5. A current source circuit, comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the reference current and said output current is maintained based on sensing an amount of current output from said current source section, wherein each of said plurality of current sources comprises:

a first switch and a second switch;

a transistor which has a source connected to receive a known voltage; and a holding capacitance connected between the known voltage and a gate of said transistor, said gate of said transistor being connected to receive the reference current via said first switch, wherein:

a drain of said transistor is connected to a conversion common node via said second switch, and the output current is outputted from said drain of said transistor.

6. The current source circuit according to claim 5, wherein said conversion section comprises:

a current setting resistance; and an operation amplifier which has an inversion input connected to receive the voltage signal from said voltage output section and an non-inversion input connected to one end of said current setting resistance as said conversion common node, said operation amplifier outputting the reference current.

7. A current source assembly, comprising:

a plurality of current driver ICs, each of which includes a current source circuit according to claim 6, other than said current setting resistance, and a current setting resistance common to said plurality of current driver ICs.

8. A current source assembly, comprising:

a plurality of current driver ICs, each of which includes a current source circuit according to claim 6, other than said voltage output section and said current setting resistance;

a voltage output section which outputs a voltage signal; and a current setting resistance, wherein said voltage output section and said current setting resistance are common to said plurality of current driver ICs, and are respectively connected via two switches with each of said plurality of current driver ICs.

9. A current source assembly, comprising:

a plurality of current driver ICs, each of which includes a current source circuit, wherein each current source circuit comprises a circuit according to claim 6, other than said voltage output section and said conversion section;

two switches; and a set of a voltage output section which outputs a voltage signal and a conversion section, wherein said voltage output section and said conversion section are common to said plurality of current driver ICs, and are respectively connected via said two switches with each of said plurality of current driver ICs.

10. A current source circuit comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the reference current and said output current is maintained based on sensing an amount of current output from said current source section, wherein each of said plurality of current sources comprises:

a first switch and a second switch;

a first transistor and a second transistor, each of which has a source connected to receive a known voltage and which together comprise a current mirror; and a holding capacitance connected between the known voltage and gates of said first transistor and said second transistor, said holding capacitance being connected to receive the reference current via said first switch, wherein;

a drain of said first transistor is connected to a conversion common node via said second switch, and the output current is outputted from a drain of said second transistor.

11. The current source circuit according to claim 10, wherein said conversion section comprises:

a current setting resistance; and an operation amplifier which has an inversion input connected to receive the voltage signal from said voltage output section and a non-inversion input connected to one end of said current setting resistance, said operation amplifier outputting the reference current.

12. A current source assembly, comprising:

a plurality of current driver ICs, each of which includes a current source circuit according to claim 11, other than said current setting resistance; and a current setting resistance common to said plurality of current driver ICs.

13. A current source assembly, comprising:

a plurality of current driver ICs, each of which includes a current source circuit according to claim 11, other than said voltage output section and said current setting resistances;

a voltage output section which outputs a voltage signal; and a current setting resistance, wherein said voltage output section and said current setting resistance are common to said plurality of current driver ICs, and are respectively connected via two switches with each of said plurality of current driver ICs.

14. A current source assembly, comprising:

a plurality of current driver ICs, each of which includes a current source circuit, wherein each current source circuit comprises a circuit according to claim 11, other than said voltage output section and said conversion section;

two switches; and a set of a voltage output section which outputs a voltage signal and a conversion section, wherein said voltage output section and said conversion section are common to said plurality of current driver ICs, and are respectively connected via said two switches with each of said plurality of current driver ICs.

15. A current source circuit, comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the reference current and said output current is maintained based on sensing an amount of current output from said current source section, wherein each of said plurality of current sources comprises:

a first switch and a second switch;

a transistor which has a source connected to receive a known voltage; and a holding capacitance which is connected between the known voltage and a gate of said transistor and which is connected to a drain of said transistor via said first switch, said drain of said transistor is connected to receive the reference current via said second switch, and the output current is outputted from said drain of said transistor.

16. The current source circuit according to claim 15, further comprising a third switch, wherein:

said current source circuit comprises a plurality of current driver ICs, each of which includes a current source section, and the reference current is common to said plurality of current driver ICs and is connected to each of said plurality of current driver ICs via said third switch.

17. A current source circuit, comprising:

a voltage output section which outputs a voltage signal;

a current source section having a plurality of current source blocks, each current source block comprising a plurality of current sources, each current source being arranged and configured to supply a respective output current and to output said output current from a respective current source block; and a conversion section which is connected between said voltage output section and said current source section and outputs a reference current to each of said plurality of current sources based on the voltage signal, such that the output current from each of said plurality of current sources is set based on the reference current and said output current is maintained based on sensing an amount of current output from said current source section, wherein:

each of said plurality of current sources comprises:

a first switch and a second switch;

a first transistor and a second transistor, each of which has a source connected to receive a first known voltage and which together comprise a current mirror, and a holding capacitance which is connected between the known voltage and gates of said first transistor and said second transistor, and which is connected to a drain of said first transistor via said first switch, said drain of said first transistor is connected to receive the reference current via said second switch, the output current is outputted from a drain of said second transistor, said current source section further comprises an input current copier which is provided in common to said plurality of current sources and which comprises:

a third switch;

a third transistor having a drain connected to receive the reference current, a source connected to receive a second known voltage, and a gate connected to receive the reference current via said third switch; and a second holding capacitance connected between said source and said gate of said third transistor.

18. The current source circuit according to claim 17, further comprising a third switch, wherein:

said current source circuit comprises a plurality of current driver ICs, each of which contains a current source section, and the reference current is common to said plurality of current driver ICs and is connected to each of said plurality of current driver ICs via said third switch.

19. A method of outputting output currents, the method comprising:

outputting a voltage signal from a voltage output section;

outputting a reference current to a current source section from a conversion section based on the voltage signal and a voltage drop across a current setting resistance in said conversion section, an output current of said current source section passing through said current setting resistance to maintain said reference current;

carrying out a current setting operation of setting a value of an output current produced by each of a plurality of current sources in each of a plurality of current source blocks in said current source section based on said reference current; and carrying out a current outputting operation of outputting plurality of currents from each of said current source blocks by producing an output current of the set value from each of said plurality of current sources, wherein:

carrying out the current setting operation comprises sequentially carrying out the current setting operation in said plurality of current sources during a first period, and carrying out the current outputting operation comprises sequentially carrying out the current outputting operation in said plurality of current sources during a second period next to the first period, wherein each of said plurality of current sources comprises:

a first switch, a second switch, and a third switch;

a transistor which has a source connected to receive a known voltage; and a holding capacitance connected between the known voltage and a gate of said transistor, said gate of said transistor being connected to receive the reference current via said first switch, wherein:

a drain of said transistor is connected to said current setting resistance via said second switch, the output current is outputted from said drain of said transistor via said third switch, sequentially carrying out the current outputting operation comprises:

turning on said first and second switches in order in said plurality of current sources; and turning off said third switch in order in said plurality of current sources, and sequentially carrying out the current outputting operation comprises:

turning off said first and second switches in all of said plurality of current sources; and turning on said third switch in all of said plurality of current sources.

20. A method of outputting output currents, the method comprising:

outputting a voltage signal from a voltage output section;

outputting a reference current to a current source section from a conversion section based on the voltage signal and a voltage drop across a current setting resistance in said conversion section, an output current of said current source section passing through said current setting resistance to maintain said reference current;

carrying out a current setting operation of setting a value of an output current produced by each of a plurality of current sources in each of a plurality of current source blocks in said current source section based on said reference current; and carrying out a current outputting operation of outputting plurality of currents from each of said current source blocks by producing an output current of the set value from each of said plurality of current sources, wherein:

carrying out the current setting operation comprises sequentially carrying out the current setting operation in said plurality of current sources during a first period, and carrying out the current outputting operation comprises sequentially carrying out the current outputting operation in said plurality of current sources during a second period next to the first period, wherein each of said plurality of current sources comprises:

a first switch and a second switch;

a first transistor and a second transistor, each of which has a source connected to receive a known voltage and which together comprise a current mirror; and a holding capacitance connected between the known voltage and gates of said first transistor and said second transistor, said holding capacitance being connected to receive the reference current via said first switch, wherein:

a drain of said first transistor is connected to said current setting resistance via said second switch, the output current is outputted from said drain of said second transistor, sequentially carrying out the current outputting operation comprises turning on said first and second switches in order in said plurality of current sources, sequentially carrying out said current outputting operation comprises turning on said first and second switches in all of said plurality of current sources, and sequentially carrying out the current setting operation and sequentially carrying out the current outputting operation are carried out at a same time.

21. A method of outputting output current, the method comprising:

outputting a voltage signal from a voltage output section;

outputting a reference current to a current source section from a conversion section based on the voltage signal and a voltage drop across a current setting resistance in said conversion section, an output current of said current source section passing through said current setting resistance to maintain said reference current;

carrying out a current setting operation of setting a value of an output current produced by each of a plurality of current sources in each of a plurality of current source blocks in said current source section based on said reference current; and carrying out a current outputting operation of outputting plurality of currents from each of said current source blocks by producing an output current of the set value from each of said plurality of current sources, wherein:

carrying out the current setting operation comprises sequentially carrying out the current setting operation in said plurality of current sources during a first period, and carrying out the current outputting operation comprises sequentially carrying out the current outputting operation in said plurality of current sources during a second period next to the first period, wherein each of said plurality of current sources comprises:

a first switch, a second switch, a third switch, and a fourth switch;

a first transistor and a second transistor connected in series, wherein a source of said first transistor is connected to receive a known voltage, a gate of said first transistor is connected to a drain of said first transistor via said first switch, and a gate of said second transistor is connected to receive said reference current via said second switch;

a first holding capacitance which is connected between said known voltage and said gate of said first transistor; and a second holding capacitance which is connected between said known voltage and said gate of said second transistor, wherein:

a drain of said second transistor is connected to said current setting resistance via said third switch, and said output current is outputted from said drain of said second transistor via said fourth switch, sequentially carrying out the current setting operation comprises:

turning on said first to third switches in order in said plurality of current sources; and turning off said fourth switch in order in said plurality of current sources, and sequentially carrying out the current outputting operation comprises:

turning off said fist to third switches in all of said plurality of current sources; and turning on said fourth switch in all of said plurality of current sources.

* * * * *